United States Patent [19]

Sasaki

[11] Patent Number: 4,572,884

[45] Date of Patent: Feb. 25, 1986

[54] STILBENE DERIVATIVES AND ELECTROPHOTOGRAPHIC PHOTOCONDUCTOR COMPRISING ONE STILBENE DERIVATIVE

[75] Inventor: Masaomi Sasaki, Susono, Japan

[73] Assignee: Ricoh Company, Ltd., Tokyo, Japan

[21] Appl. No.: 554,422

[22] Filed: Nov. 22, 1983

[30] Foreign Application Priority Data

| | | | |
|---|---|---|---|
| Nov. 25, 1982 | [JP] | Japan | 57-205437 |
| Nov. 25, 1982 | [JP] | Japan | 57-205438 |
| Nov. 26, 1982 | [JP] | Japan | 57-207251 |
| Nov. 26, 1982 | [JP] | Japan | 57-207252 |

[51] Int. Cl.[4] ..... G03G 5/06

[52] U.S. Cl. ..... 430/72; 430/73

[58] Field of Search ..... 430/58, 59, 72, 73

[56] References Cited

U.S. PATENT DOCUMENTS

| | | | |
|---|---|---|---|
| 3,246,983 | 4/1966 | Sus et al. | 430/71 |
| 4,072,519 | 2/1978 | Pearson et al. | 430/72 |
| 4,105,447 | 8/1978 | Fox | 430/72 |
| 4,450,218 | 5/1984 | Takei et al. | 430/59 |

*Primary Examiner*—John L. Goodrow

*Attorney, Agent, or Firm*—Flynn, Thiel, Boutell & Tanis

[57] ABSTRACT

Stilbene derivatives of the formula an electrophotographic photoconductor comprising an electroconductive support material and a photosensitive layer comprising at least one stilbene derivative of the same formula are disclosed, in which $R^1$ represents a lower alkyl group, an alkoxy group or an unsubstituted or substituted phenoxy group or a hydroxyl group, $R^2$ represents hydrogen, a lower alkyl group or an unsubstituted or substituted phenyl group, Ar represents or a 9-anthryl group, $R^3$ represents hydrogen, an alkyl group, an alkoxy group halogen or substituted amino group represented by (in which $R^4$ and $R^5$ each represent an alkyl group, an unsubstituted or substituted aralkyl group, or an unsubstituted of substituted aryl group), m is an integer of 0, 1, 2 or 3, and n is an integer of 0 or 1.

2 Claims, 8 Drawing Figures

STILBENE DERIVATIVES AND ELECTROPHOTOGRAPHIC PHOTOCONDUCTOR COMPRISING ONE STILBENE DERIVATIVE

BACKGROUND OF THE INVENTION

The present invention relates to stilbene derivatives and an electrophotographic photoconductor comprising a photosensitive layer containing at least one of the stilbene derivatives overlayed on an electroconductive support material.

Conventionally, a variety of inorganic and organic electrophotographic photoconductors are known. As inorganic photoconductors for use in electrophotography, there are known types, in which the photoconductive material is, for instance, selenium, cadmium sulfide and zinc oxide. In an electrophotographic process, a photoconductor is first exposed to corona charges in the dark, so that the surface of the photoconductor is electrically charged uniformly. The thus uniformly charged photoconductor is then exposed to original light images and the portions exposed to the original light images selectively become electroconductive so that electric charges dissipate from the exposed portions of the photoconductor, whereby latent electrostatic images corresponding to the original light images are formed on the surface of the photoconductor. The latent electrostatic images are then developed by the so-called toner which comprises a colorant, such as a dye or a pigment, and a binder agent made, for instance, of a polymeric material; thus, visible developed images can be obtained on the photoconductor. It is necessary that photoconductors for use in electrophotography have at least the following fundamental properties: (1) chargeability to a predetermined potential in the dark; (2) minimum electric charge dissipation in the dark; and (3) quick dissipation of electric charges upon exposure to light.

While the above-mentioned inorganic electrophotographic photoconductors have many advantages over other conventional electrophotographic photoconductors, at the same time they have several shortcomings from the viewpoint of practical use.

For instance, a selenium photoconductor, which is widely used at present, has the shortcoming that its production is difficult and, accordingly, its production cost is high. Further, it is difficult to work it into the form of a belt due to its poor flexibility, and it is so vulnerable to heat and mechanical shocks that it must be handled with the utmost care.

Cadmium sulfide photoconductors and zinc oxide photoconductors are prepared by dispersing cadmium sulfide or zinc oxide in a binder resin. They can be produced inexpensively compared with selenium photoconductors and are also used commonly in practice. However, the cadmium sulfide and zinc oxide photoconductors are poor in surface smoothness, hardness, tensile strength and wear resistance. Therefore, they are not suitable as photoconductors for use in plain paper copiers in which the photoconductors are used in quick repetition.

Recently, organic electrophotographic photoconductors, which are said not to have the such shortcomings of the inorganic electrophotographic photoconductors, have been proposed, and some of them are in fact employed for practical use. Representative examples of such organic electrophotographic photoconductors are an electrophotographic photoconductor comprising poly-N-vinylcarbazole and 2,4,7-trinitro-fluorene-9-one (U.S. Pat. No. 3,484,237); a photoconductor in which poly-N-vinylcarbazole is sensitized by a pyrylium salt type coloring material (Japanese Patent Publication No. 48-25658); a photoconductor containing as the main component an organic pigment (Japanese Laid-Open Patent Application No. 47-37543); and a photoconductor containing as the main component an eutectic crystaline complex (Japanese Laid-Open Patent Application No. 47-10735).

Although the above-mentioned organic electrophotographic photoconductors have many advantages over other conventional electrophotographic photoconductors, they still have several shortcomings from the viewpoint of practical use, in particular, for use in high speed copying machines, in terms of cost, production, durability and electrophotographic sensitivity.

SUMMARY OF THE INVENTION

It is therefore an object of the present invention to provide stilbene derivatives and an electrophotographic photoconductor or element comprising a photoconductive layer containing at least one of the stilbene derivatives and an electroconductive support material for supporting the photoconductive layer thereon, with high photosensitivity, which does not give rise to difficulties in producing the electrophotographic photoconductor, and which is comparatively inexpensive and excellent in durability.

The stilbene derivatives employed in the present invention are represented by the following general formula:

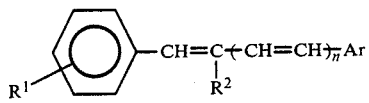

(I)

wherein $R^1$ represents a lower alkyl group, an alkoxy group or an unsubstituted or substituted phenoxy group, or a hydroxyl group, $R^2$ represents hydrogen, a lower alkyl group or an unsubstituted or substituted phenyl group; Ar represents

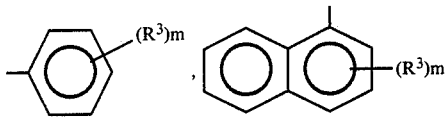

or a 9-anthryl group, $R^3$ represents hydrogen, an alkyl group, an alkoxy group, halogen or a substituted amino group represented by

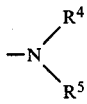

(in which $R^4$ and $R^5$ each represent an alkyl group, an unsubstituted or substituted aralkyl group, or an unsubstituted or substituted aryl group), m is an integer of 0, 1, 2 or 3 and n is an integer of 0 or 1.

The stilbene derivatives of the above type work as photoconductive materials in the electrophotographic photoconductor.

In the above formula, the substituents of the phenoxy group in $R^1$ or of the phenyl group in $R^2$, and the substituents of the aralkyl group or aryl group in $R^4$ or $R^5$ are, for example, an alkyl group, an alkoxy group, halogen, a dialkylamino group, a hydroxy group, a carboxyl group, and an ester group thereof, an acetyl group, an allyloxy group, a nitro group and a cyano group.

DETAILED DESCRIPTION OF THE PREFERRED EMBODIMENTS

In the electrophotographic photoconductor according to the present invention, at least one stilbene derivative of the previously described formula is contained in the photosensitive layer. Those stilbene derivatives can be employed in different ways, for example, as shown in FIG. 1, FIG. 2 and FIG. 3.

Figure 1:
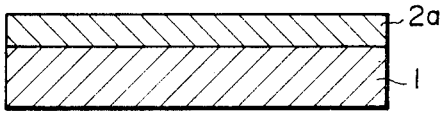
FIG. 1 is an enlarged schematic cross-sectional view of an embodiment of an electrophotographic photoconductor according to the present invention.

In the photoconductor shown in FIG. 1, a photosensitive layer 2*a* is formed on an electroconductive support material 1, which photosensitive layer 2*a* comprises a stilbene derivative, a sensitizer dye and a binder agent. In this photoconductor, the stilbene derivative works as a photoconductor material through which charge carriers are generated and transported. The generation and transportation of charge carrier are necessary for the light decay of the photoconductor. However, the stilbene derivative itself scarcely absorbs light in the visible light range and, therefore, it is necessary to add a sensitizer dye which absorbs light in the visible light range in order to form latent electrostatic images on the photoconductor by use of visible light.

Figure 2:
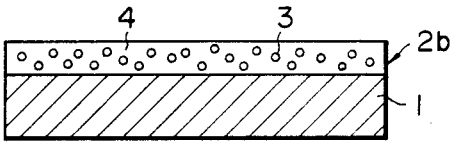
FIG. 2 is an enlarged schematic cross-sectional view of another embodiment of an electrophotographic photoconductor according to the present invention.
Figure 3:
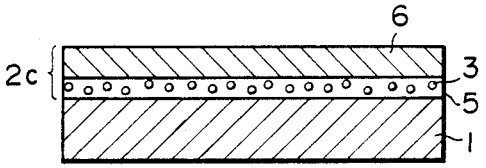
FIG. 3 is an enlarged schematic cross-sectional view of a further embodiment of an electrophotographic photoconductor according to the present invention.

Referring to FIG. 2, there is shown an enlarged cross-sectional view of another embodiment of an electrophotographic photoconductor according to the present invention.

In the figure, on the electroconductive support material 1, there is formed a photosensitive layer 2*b* comprising a charge generating material 3 dispersed in a charge transporting medium 4 which comprises a stilbene derivative and a binder agent. In this embodiment, the stilbene derivative and the binder agent in combination constitute the charge transporting medium 4. The charge generating material 3, which is, for example, an inorganic or organic pigment, generates charge carriers. The charge transporting medium 4 mainly serves to accept the charge carriers generated by the charge generating material 3 and to transport those charge carriers.

In this electrophotographic photoconductor, it is a basic requirement that the light-absorption wavelength regions of the charge generating material 3 and the stilbene derivative not overlap in the visible light range. This is because, in order that the charge generating material 3 produce charge carriers efficiently, it is necessary that light pass through the charge transporting medium 4 and reach the surface of the charge generating material 3. Since the stilbene derivatives of the formula (I) do not substantially absorb light in the visible range, they can work effectively as charge transporting materials in combination with the charge generating material 3 which absorbs the light in the visible region and generates charge carriers.

Referring to FIG. 3, there is shown an enlarged cross-sectional view of a further embodiment of an electrophotographic photoconductor according to the present invention. In the figure, there is formed on the electroconductive support material 1 a two-layered photosensitive layer 2*c* comprising a charge generating layer 5 consisting essentially of the charge generating material 3, and a charge transporting layer 6 containing a stilbene derivative of the previously described formula (I).

In this photoconductor, light which has passed through the charge transporting layer 6 reaches the charge generating layer 5, so that charge carriers are generated within the charge generating layer 5 in the region which the light has reached. The charge carriers which are necessary for the light decay for latent electrostatic image formation are generated by the charge generating material 3, accepted and transported by the charge transporting layer 6. In the charge transporting layer 6, the stilbene derivative mainly works for transporting charge carriers. The generation and transportation of the charge carriers are performed in the same manner as that in the photoconductor shown in FIG. 2.

The stilbene derivatives of the formula (I) for use in the present invention can be prepared by reacting a phenyl derivative of formula (II) with a carbonyl compound of formula (III) in the presence of a basic catalyst at temperatures ranging from room temperature to about 100° C.:

(II)

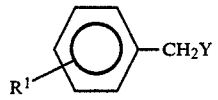

wherein $R^1$ represents a lower alkyl group, an alkoxy group or an unsubstituted or substituted phenoxy group, or a hydroxyl group, and Y represents a triphenylphosphonium group of the formula

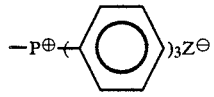

in which $Z^{\ominus}$ indicates a halogen ion; or a dialkoxyphosphorous group of the formula $—PO(OR)_2$ in which R indicates a lower alkyl group.

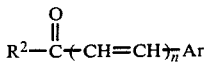

(III)

where $R^2$ represents hydrogen, a lower alkyl group or an unsubstituted or substituted phenyl group; Ar represents

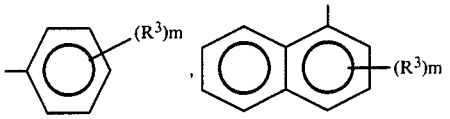

or a 9-anthryl group, $R^3$ represents hydrogen, an alkyl group, an alkoxy group, halogen or a substituted amino group represented by

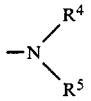

(in which $R^4$ and $R^5$ each represent an alkyl group, an unsubstituted or substituted aralkyl group, or an unsubstituted or substituted aryl group), m is an integer of 0, 1, 2 or 3 and n is an integer of 0 or 1.

In the above formulas (II) and (III), the substituents of the phenoxy or phenyl group in $R^1$ and $R^2$, and the substituents of the aralkyl group or aryl group in $R^4$ and $R^5$ are, for example, an alkyl group, an alkoxy group, halogen, a dialkylamino group, a hydroxy group, a carboxyl group, and an ester group thereof, an acetyl group, an allyloxy group, a nitro group and a cyano group.

Preparation of the stilbene derivative of the previously described formula (I) will now be explained.

In this preparation, the phenyl derivative of the formula (II) can be prepared without difficulty by heating a corresponding halomethyl compound and a trialkyl phosphite or triphenylphosphite without any solvent or in a solvent, such as toluene, tetrahydrofuran or N,N-dimethylformamide. As the trialkyl phosphite, those having alkyl groups with 1 to 4 carbon atoms, in particular, those having methyl groups or ethyl groups are preferable.

The thus prepared phenyl derivative of the formula (II) is allowed to react with the carbonyl derivative of the formula (III) in the presence of a basic catalyst at temperatures ranging from room temperature to about 100° C.

As the basic catalyst for the above reaction, sodium hydroxide, potassium hydroxide, sodium amide, sodium hyride, and alcoholates such as sodium methylate and potassium tert-butoxide, can be employed.

As the reaction solvent, the following can be employed: methanol, ethanol, isopropanol, butanol, 2-methoxyethanol, 1,2-dimethoxyethane, bis(2-methoxyethyl)ether, dioxane, tetrahydrofuran, toluene, xylene, dimethyl sulfoxide, N,N-dimethylformamide, N-methylpyrrolidone and 1,3-dimethyl-2-imidazolidinone.

Of the above solvents, polar solvents, for example, N,N-dimethylformamide and dimethyl sulfoxide are particularly suitable for this reaction.

The reaction temperature for the above reaction can be set in a relatively wide range, depending upon (i) the stability of the solvent employed in the presence of the basic catalyst, (ii) the reactivities of the condensation components, that is, the phenyl derivative of the formula (II) and the carbonyl compound of the formula (III), and (iii) the properties of the basic catalyst which works as a condensation agent in this reaction. When, for example, a polar solvent is employed as the reaction solvent, the reaction temperature can be set in the range of room temperature to about 100° C., more preferably in the range of room temperature to about 80° C. However, if it is desired to shorten the reaction time or when a less reactive condensation agent is employed, the reaction temperature can be elevated beyond the aforementioned range.

Of the stilbene derivatives of the previously described formula (I), a stilbene derivative of the following formula (Ia) can be synthesized as follows: a phenyl derivative of the formula (IIa) with an aldehyde derivative of the formula (IIIa) under the same reaction conditions using one of the previously described catalyst as follows:

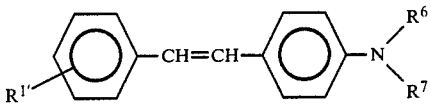

(Ia)

wherein $R^{1'}$ represents an alkoxy group or an unsubstituted or substituted phenoxy group, and $R^6$ and $R^7$ each represent a lower alkyl group, a benzyl group or an unsubstituted or substituted phenyl group.

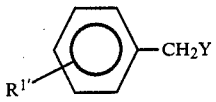

(IIa)

wherein $R^{1'}$ represents an alkoxy group or an unsubstituted or substituted phenoxy group, and Y represents a triphenylphosphonium group of the formula

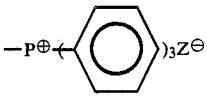

in which $Z^{\ominus}$ indicates a halogen ion or a dialkoxyphosphorous group of the formula $—PO(OR)_2$ in which R indicates a lower alkyl group.

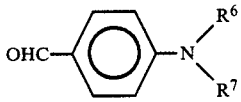

(IIIa)

wherein $R^6$ and $R^7$ each represent a lower alkyl group, a benzyl group or an unsubstituted or substituted phenyl group.

Preparation of stilbene derivatives of the formula (Ia) will now be explained in detail by referring to the following examples:

SYNTHESIS EXAMPLE 1 (SYNTHESIS OF STILBENE DERIVATIVE NO. 36 IN TABLE 5)

2.58 g (0.01 mol) of diethyl 4-methoxybenzylphosphonate and 2.73 g (0.01 mol) of 4-N,N-diphenylaminobenzaldehyde were dissolved in 15 ml of N,N-dimethylformamide. To this mixture, 1.69 g of potassium tertbutoxide was added with the temperature of the reaction mixture maintained in the range of 22° C. to 31° C. After the addition of the potassium tert-butoxide, the reaction mixture was stirred at room temperature for 4 hours and was then diluted with 15 ml of methanol. Crystals separated from the reaction mixture, which were separated by filtration, washed with water and dried. The yield was 3.21 g (84.9%). The melting point of the thus obtained crystals was 167.0°-168.0° C.

Upon recrystallization of the crystals from a mixed solvent of dioxane and ethanol, 4-methoxy-4'-N,N-diphenylaminostilbene (Stilbene Derivative No. 36 in Table 5) precipitated as light yellow needle-like crystals. The melting point of the thus obtained 4-methoxy-4'-N,N-diphenylaminostilbene was at 167.5°-168.5° C.

The results of the elemental analysis of the thus obtained 4-methoxy-4'-N,N'-diphenylaminostilbene were as follows:

| | % C | % H | % N |
|---|---|---|---|
| Found | 85.79 | 6.20 | 3.75 |
| Calculated | 85.90 | 6.15 | 3.71 |

The above calculation was based on the formula for 4-methoxy-4'-N,N-diphenylaminostilbene of $C_{27}H_{23}NO$.

Figure 4:
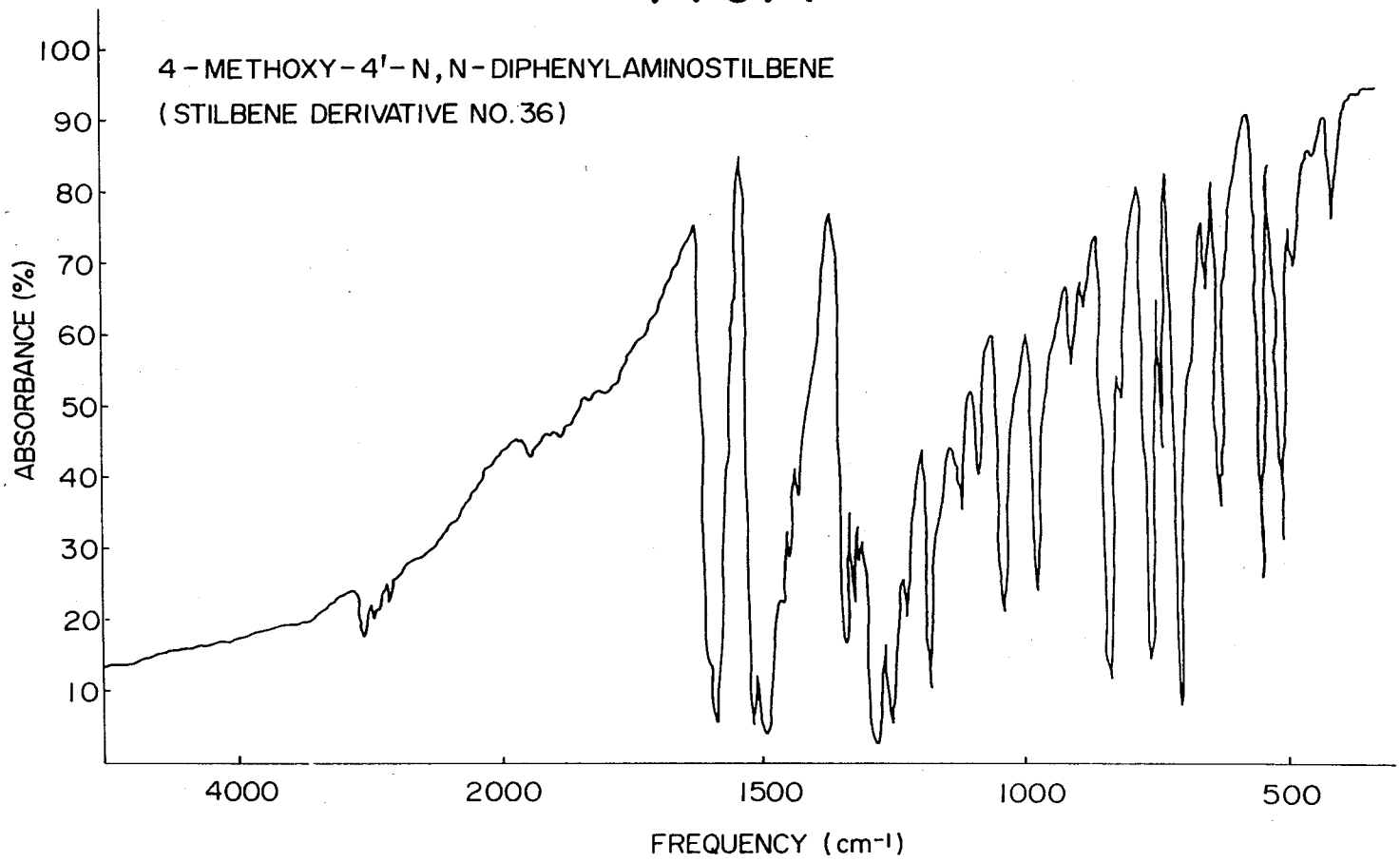
FIG. 4 is an infrared spectrum of 5-methoxy-4'-N,N-diphenylaminostilbene, which is Stilbene Derivative No. 36 in Table 5.

An infrared spectrum of the 4-methoxy-4'-N,N-diphenylaminostilbene, taken by use of a KBr pellet, indicated a peak at 965 $cm^{-1}$ which is characteristic of the out-of-plane=CH (trans) deformation vibrations as shown in FIG. 4.

SYNTHESIS EXAMPLES 2 THROUGH 9

Synthesis Example 1 was repeated except that 4-N,N-diphenylaminobenzaldehyde employed in the Synthesis Example 1 was replaced by the respective aldehydes listed in Table 1, whereby the novel stilbene derivatives listed in Table 1 were obtained.

TABLE 1

| Synthesis Example | Aldehyde | Stilbene Derivative | Stilbene Derivative No. in Table 5 |
|---|---|---|---|
| 2 | 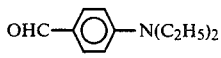 | 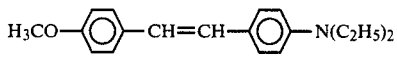 | 100 |
| 3 | 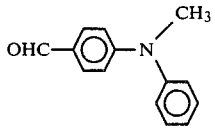 | 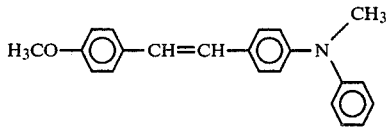 | 103 |
| 4 | 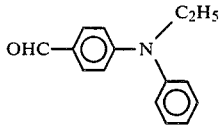 | 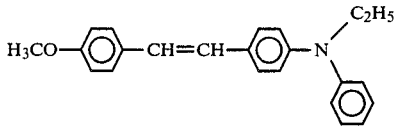 | 91 |
| 5 | 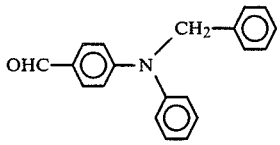 | 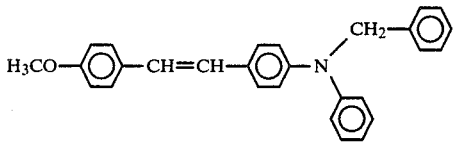 | 94 |
| 6 | 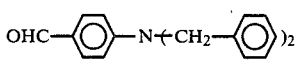 | 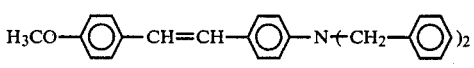 | 21 |
| 7 | 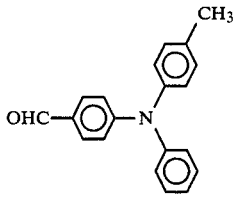 | 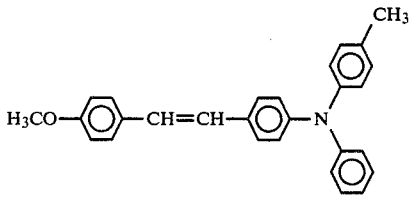 | 50 |

TABLE 1-continued

| Synthesis Example | Aldehyde | Stilbene Derivative | Stilbene Derivative No. in Table 5 |
|---|---|---|---|
| 8 | 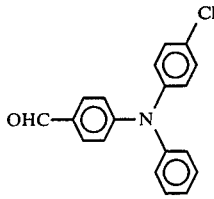 | 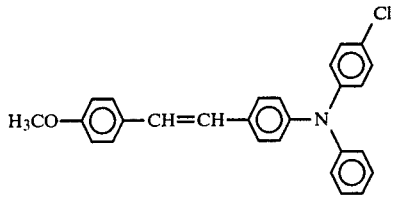 | 105 |
| 9 | 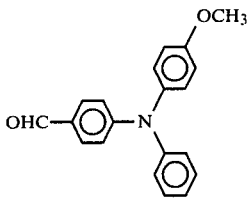 | 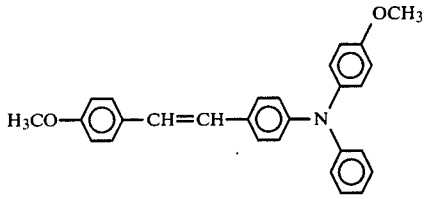 | 53 |

The yields and melting points and the results of the elemental analyses of the above stilbene derivatives prepared in Synthesis Examples 2 through 9 were in the following Table 2.

TABLE 2

| Synthesis Example No. | Yield (%) | Melting Point (°C.) | Elemental Analysis Found/Calculated % C | % H | % N |
|---|---|---|---|---|---|
| 2 | 79.0 | 123.0~123.5 | 81.17/81.08 | 8.29/8.25 | 5.02/4.98 |
| 3 | 91.5 | 176.5~177.5 | 83.62/83.76 | 6.66/6.72 | 4.37/4.44 |
| 4 | 89.0 | 128.0~129.0 | 83.95/83.84 | 6.94/7.05 | 4.25/4.25 |
| 5 | 87.0 | 131.5~132.0 | 85.99/85.89 | 6.36/6.45 | 3.47/3.58 |
| 6 | 85.3 | 150.5~151.0 | 85.72/85.88 | 6.68/6.72 | 3.47/3.45 |
| 7 | 91.6 | 142.0~142.5 | 85.82/85.89 | 6.53/6.45 | 3.63/3.58 |
| 8 | 97.6 | 144.0~144.5 | 78.78/78.72 | 5.37/5.40 | 3.41/3.40 |
| 9 | 87.0 | 127.5~128.5 | 82.54/82.51 | 6.22/6.20 | 3.54/3.44 |

SYNTHESIS EXAMPLE 10

To a mixture of 4.19 g (0.01 mol) of 4-methoxybenzylphosphonium chloride and 2.74 g (0.01 mol) of 4-N,N-diphenylaminobenzaldehyde, there was added 20 ml of N,N-dimethylformamide. To this mixture, 2.90 g of a 28% methanol solution of sodium methylate was added dropwise over a period of 20 minutes, with the temperature of the reaction mixture maintained between 21° C. and 30° C. After the addition of the methanol solution of sodium methylate, the reaction mixture was stirred at room temperature for 6 hours and was then diluted with 30 ml of water. The product was extracted with toluene. The organic layer portion was washed over water and was then dried. The toluene was removed by evaporation from the organic layer portion, whereby light yellow powder was obtained. The thus obtained light yellow powder was recrystallized from a mixed solvent of toluene and n-hexane in the presence of a small amount of iodine, whereby 2.46 g (65.1%) of 4-methoxy-4'-N,N-diphenylaminostilbene (Stilbene Derivative No. 36 in Table 5) was obtained as light yellow needle-like crystals. The melting point of the product was at 167.0°-168.5° C.

The results of the elemental analysis of the thus obtained 4-methoxy-4'-N,N-diphenylaminostilbene were as follows:

| | % C | % H | % N |
|---|---|---|---|
| Found | 85.72 | 6.09 | 3.70 |
| Calculated | 85.90 | 6.15 | 3.71 |

The above calculation was based on the formula for 4-methoxy-4'-N,N-diphenylaminostilbene of $C_{27}H_{23}NO$.

An infrared spectrum of the above synthesized 4-methoxy-4'-N,N-diphenylaminostilbene, taken by use of a KBr pellet, was identical with the infrared spectrum obtained in Synthesis Example 1 as shown in FIG. 4.

SYNTHESIS EXAMPLE 11 (SYNTHESIS OF STILBENE DERIVATIVE NO. 130 IN TABLE 5)

6.40 g (0.02 mol) of diethyl 3-phenoxybenzylphosphonate and 5.47 g (0.02 mol) of 4-N,N-diphenylaminobenzaldehyde were dissolved in 20 ml of N,N-dimethylformamide. To this mixture, 3.36 g of potassium tert-butoxide was added, with the temperature of the reaction mixture maintained in the range of 21° C. to 30° C. After the addition of the potassium tert-butoxide, the reaction mixture was stirred at room temperature for 8 hours and was then diluted with 40 ml of methanol. Crystals separated from the reaction mixture, which were separated by filtration, washed with water and dried. The yield was 8.10 g (92.0%). The melting point of the thus obtained crystals was 103.0°-105.0° C.

Upon recrystallization of the crystals from a mixed solvent of dioxane and ethanol, 3-phenoxy-4'-N,N-diphenylaminostilbene (Stilbene Derivative No. 130 in Table 5) precipitated as light yellow needle-like crystals. The melting point of the thus obtained 3-phenoxy-4'-N,N-diphenylaminostilbene was at 114.0°-116.0° C.

The results of the elemental analysis of the thus obtained 3-phenoxy-4'-N,N-diphenylaminostilbene were as follows:

| | % C | % H | % N |
|---|---|---|---|
| Found | 87.53 | 5.68 | 3.28 |
| Calculated | 87.43 | 5.74 | 3.19 |

The above calculation was based on the formula for 3-phenoxy-4'-N,N-diphenylaminostilbene of $C_{32}H_{35}NO$.

Figure 5:
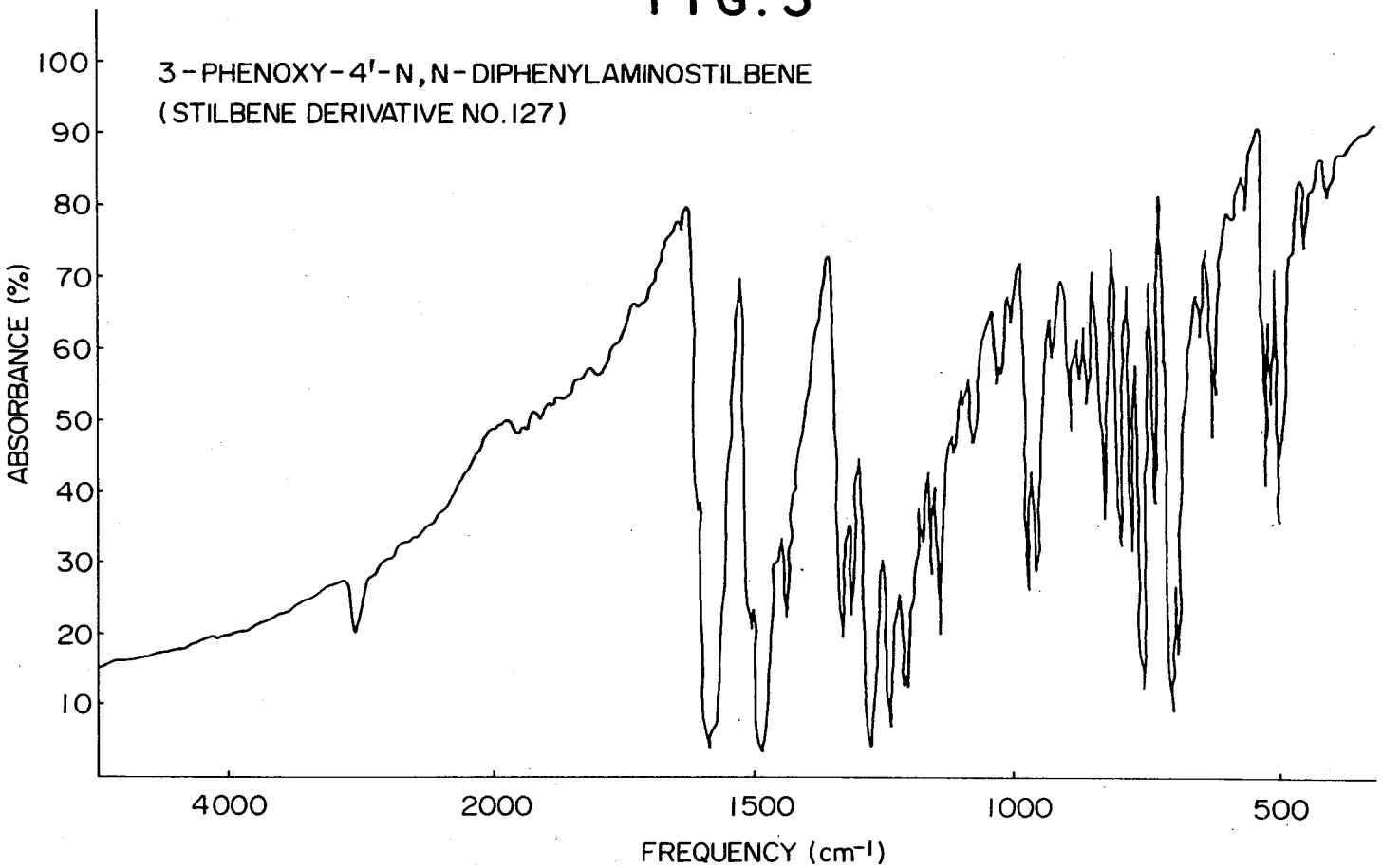
FIG. 5 is an infrared spectrum of 3-phenoxy-4'-N,N-diphenylaminostilbene, which is Stilbene Derivative No. 130 in Table 5.

An infrared spectrum of the 3-phenoxy-4'-N,N-diphenylaminostilbene, taken by use of a KBr pellet, indicated a peak at 970~950 $cm^{-1}$ which is characteristic of the out-of-plane=CH (trans) deformation vibrations as shown in FIG. 5.

SYNTHESIS EXAMPLES 12 THROUGH 18

Synthesis Example 11 was repeated except that 4-N,N-diphenylaminobenzaldehyde employed in Synthesis Example 11 was replaced by the respective aldehydes listed in Table 3, whereby the novel stilbene derivatives listed in Table 3 were obtained.

The yields and melting points and the results of the elemental analyses of the above stilbene derivatives prepared in Synthesis Examples 12 through 18 were in the following Table 4.

TABLE 4

| Synthesis Example No. | Yield (%) | Melting Point (°C.) | Elemental Analysis Found/Calculated % C | % H | % N |
|---|---|---|---|---|---|
| 12 | 72.5 | 78.5~79.0 | 84.07/83.91 | 7.32/7.35 | 4.22/4.08 |
| 13 | 94.2 | 115.0~116.0 | 87.32/87.32 | 6.15/6.26 | 2.97/3.00 |
| 14 | 90.0 | 88.5~90.0 | 86.05/85.90 | 6.09/6.15 | 3.78/3.71 |
| 15 | 89.5 | 120.5~121.5 | 87.35/87.37 | 5.93/6.01 | 3.10/3.09 |
| 16 | 89.5 | 141.5~142.5 | 87.35/87.37 | 6.06/6.01 | 3.08/3.09 |
| 17 | 85.9 | 126.0~127.0 | 81.17/81.08 | 5.22/5.11 | 3.05/2.96 |

TABLE 3

| Synthesis Example | Aldehyde | Stilbene Derivative | Stilbene Derivative No. in Table 5 |
|---|---|---|---|
| 12 | 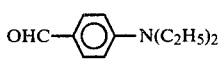 | 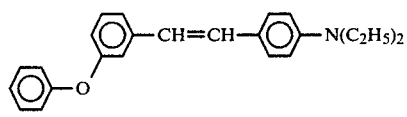 | 111 |
| 13 | 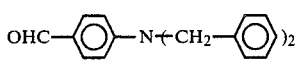 | 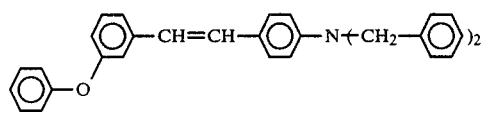 | 120 |
| 14 | 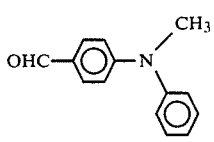 | 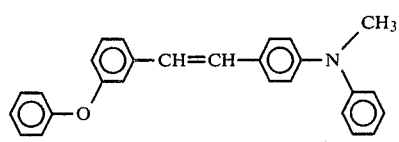 | 169 |
| 15 | 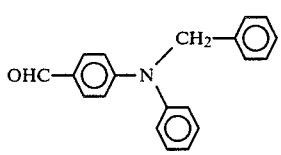 | 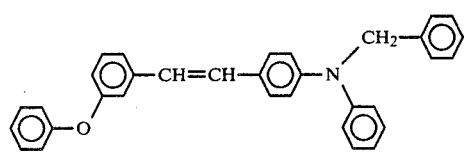 | 173 |
| 16 | 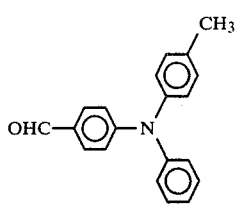 | 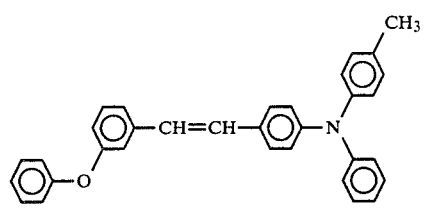 | 143 |
| 17 | 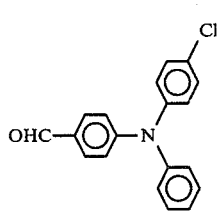 | 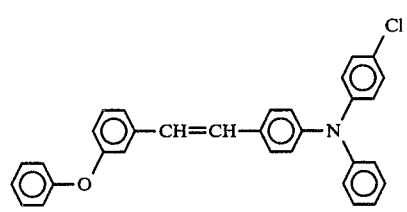 | 190 |
| 18 | 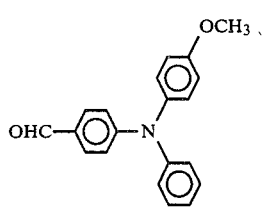 | 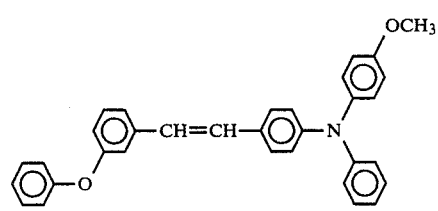 | 146 |

TABLE 4-continued

| Synthesis Example No. | Yield (%) | Melting Point (°C.) | Elemental Analysis Found/Calculated % C | % H | % N |
|---|---|---|---|---|---|
| 18 | 83.0 | 124.0~126.0 | 84.30/84.40 | 5.79/5.81 | 3.00/2.98 |

In addition to the stilbene derivatives described in Synthesis Examples 1 through 18, other stilbene derivatives of the formula (I), that is,

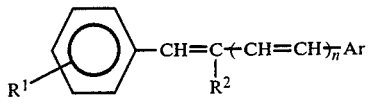

which are also particularly useful in the present invention, are listed in the following Table 5.

TABLE 5

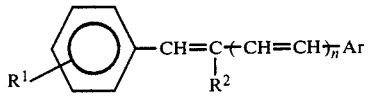

| Stilbene Derivative No. | n | Substituted Position 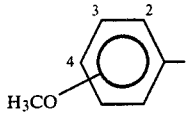 | $R^2$ | Ar |
|---|---|---|---|---|
| 1 | 0 | 4- | $CH_3$ | 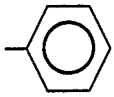 |
| 2 | 0 | 4- | 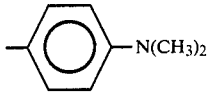 | 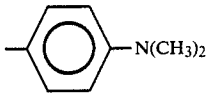 |
| 3 | 0 | 3- | 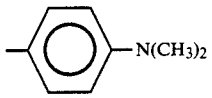 | 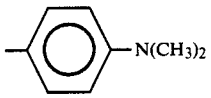 |
| 4 | 0 | 2- | 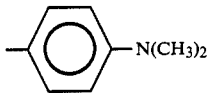 | 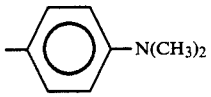 |
| 5 | 0 | 4- | 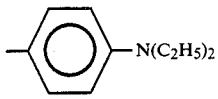 | 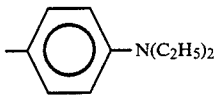 |
| 6 | 1 | 4- | H | 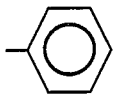 |
| 7 | 1 | 4- | H | 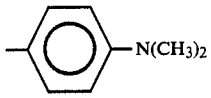 |
| 8 | 1 | 4- | H | 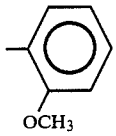 |
| 9 | 1 | 3- | H | 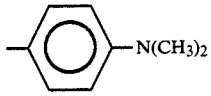 |

TABLE 5-continued
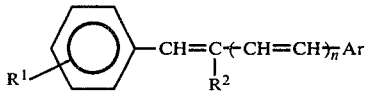
| | | | | |
|---|---|---|---|---|
| 10 | 1 | 2- | H | 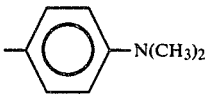  |
| 11 | 0 | 4- | $CH_3$ | 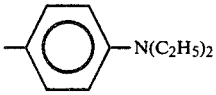  |
| 12 | 0 | 4- | H | 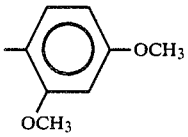  |
| 13 | 0 | 2- | H | 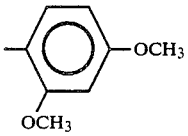  |
| 14 | 0 | 4- | H | 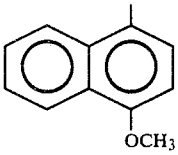  |
| 15 | 0 | 3- | H | 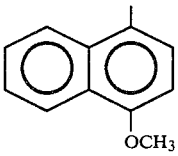  |
| 16 | 0 | 2- | H | 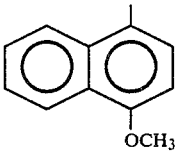  |
| 17 | 0 | 2- | H | 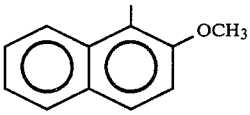  |
| 18 | 0 | 4- | H | 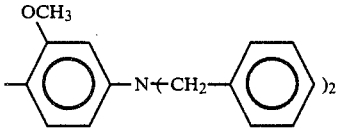  |
| 19 | 0 | 4- | H | 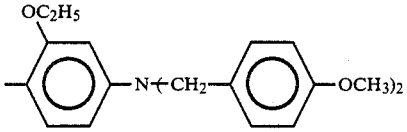  |

TABLE 5-continued
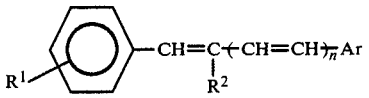
| | | | | |
|---|---|---|---|---|
| 20 | 0 | 2- | H | 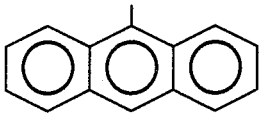 |
| 21 | 0 | 4- | H | 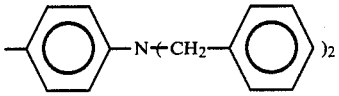 |
| 22 | 0 | 3- | H | 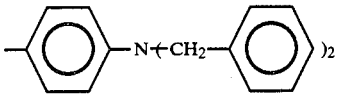 |
| 23 | 0 | 2- | H | 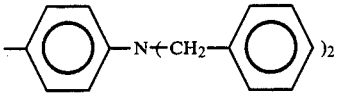 |
| 24 | 0 | 3- | H | 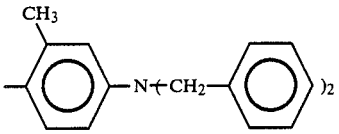 |
| 25 | 0 | 4- | H | 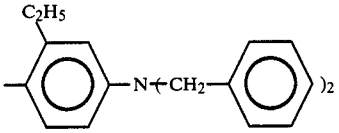 |
| 26 | 0 | 4- | H | 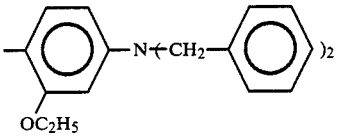 |
| 27 | 0 | 4- | H | 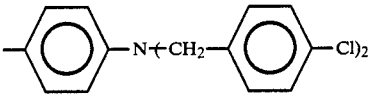 |
| 28 | 0 | 3- | H | 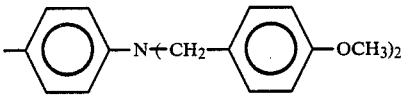 |
| 29 | 0 | 3- | H | 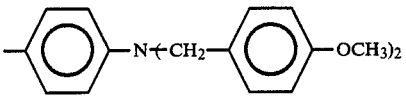 |
| 30 | 0 | 2- | H | 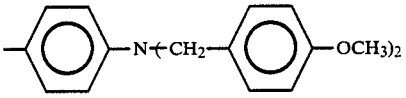 |
| 31 | 0 | 4- | H | 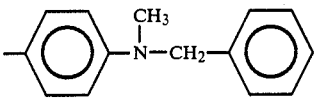 |

TABLE 5-continued
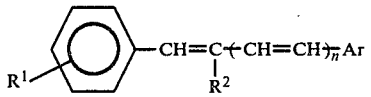
| | | | | |
|---|---|---|---|---|
| 32 | 0 | 4- | H | 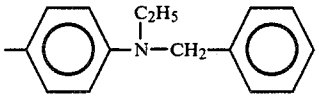 |
| 33 | 0 | 4- | H | 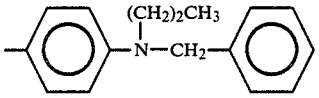 |
| 34 | 0 | 3- | H | 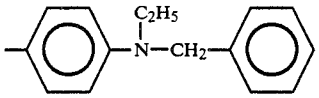 |
| 35 | 0 | 2- | H | 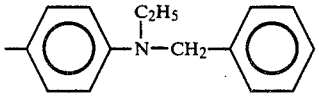 |
| 36 | 0 | 4- | H | 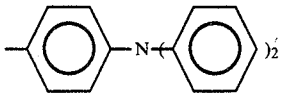 |
| 37 | 0 | 3- | H | 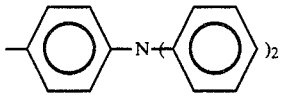 |
| 38 | 0 | 2- | H | 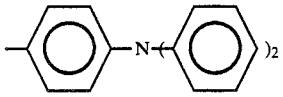 |
| 39 | 0 | 4- | H | 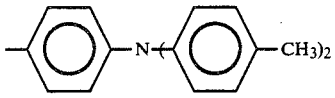 |
| 40 | 0 | 3- | H | 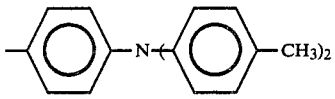 |
| 41 | 0 | 2- | H | 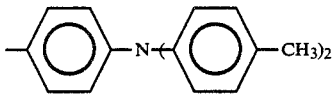 |
| 42 | 0 | 4- | H | 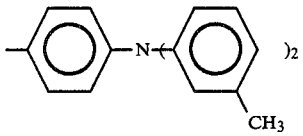 |
| 43 | 0 | 3- | H | 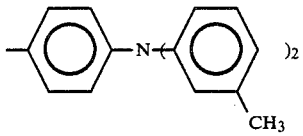 |

TABLE 5-continued
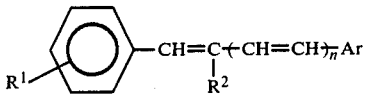
| | | | | |
|---|---|---|---|---|
| 44 | 0 | 4- | H | 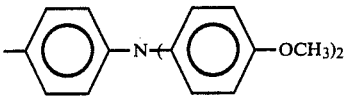 |
| 45 | 0 | 3- | H | 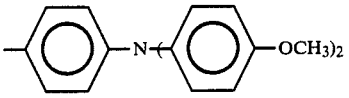 |
| 46 | 0 | 2- | H | 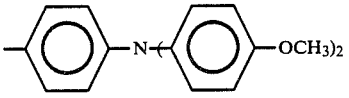 |
| 47 | 0 | 4- | H | 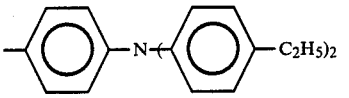 |
| 48 | 0 | 4- | H | 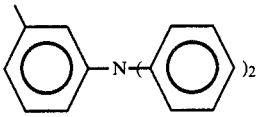 |
| 49 | 0 | 4- | H | 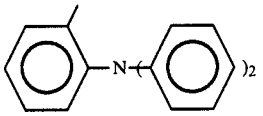 |
| 50 | 0 | 4- | H | 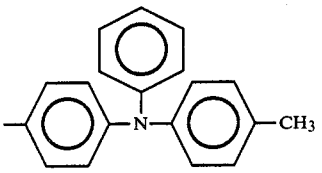 |
| 51 | 0 | 3- | H | 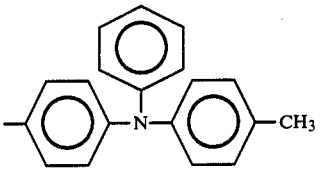 |
| 52 | 0 | 2- | H | 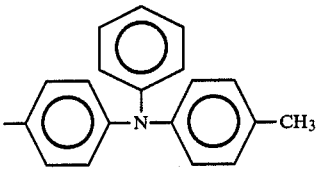 |
| 53 | 0 | 4- | H | 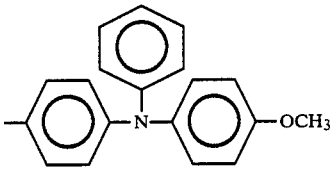 |

TABLE 5-continued
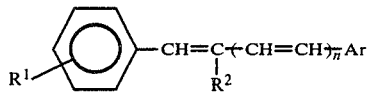
| | | | | |
|---|---|---|---|---|
| 54 | 0 | 3- | H | 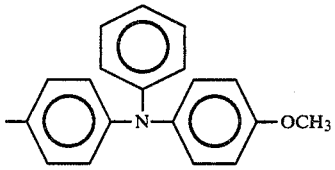  |
| 55 | 0 | 2- | H | 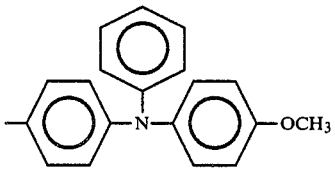  |
| 56 | 0 | 4- | H | 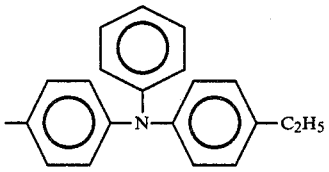  |
| 57 | 0 | 4- | H | 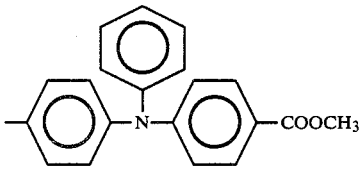  |
| 58 | 0 | 4- | H | 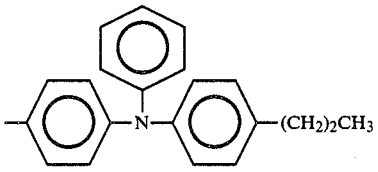  |
| 59 | 0 | 2- | H | 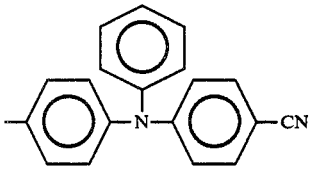  |
| 60 | 0 | 4- | H | 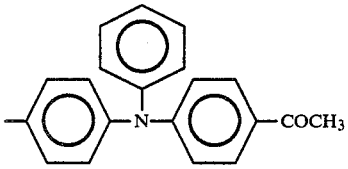  |
| 61 | 0 | 2- | H | 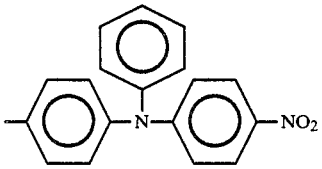  |

TABLE 5-continued
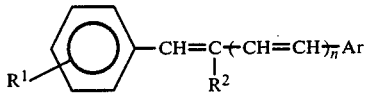
| | | | | |
|---|---|---|---|---|
| 62 | 0 | 2- | H | 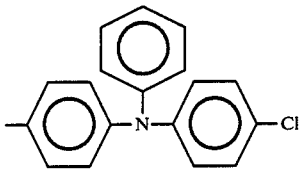 |
| 63 | 0 | 4- | H | 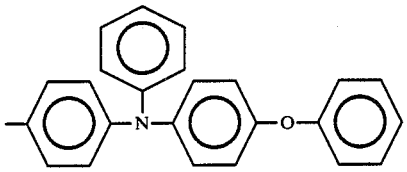 |
| 64 | 0 | 3- | H | 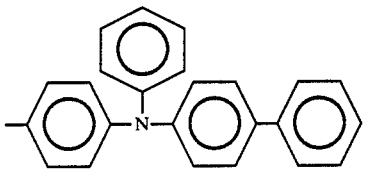 |
| 65 | 0 | 2- | H | 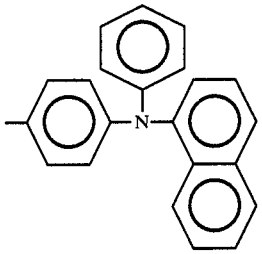 |
| 66 | 0 | 4- | H | 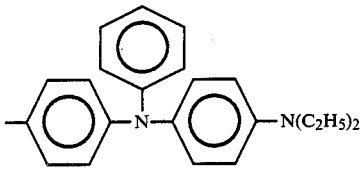 |
| 67 | 0 | 4- | H | 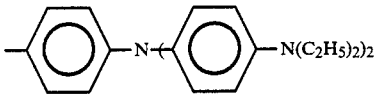 |
| 68 | 0 | 4- | H | 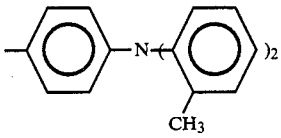 |
| 69 | 0 | 2- | H | 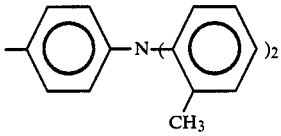 |

TABLE 5-continued
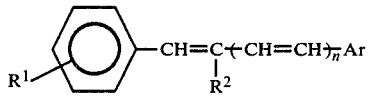
| | | | | |
|---|---|---|---|---|
| 70 | 0 | 3- | H | 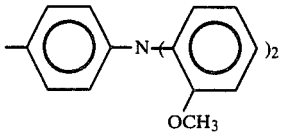 |
| 71 | 0 | 4- | H | 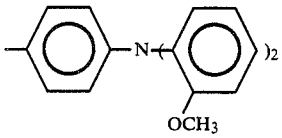 |
| 72 | 0 | 4- | H | 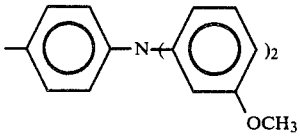 |
| 73 | 0 | 4- | H | 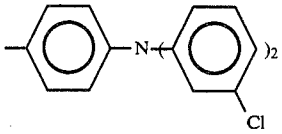 |
| 74 | 0 | 4- | H | 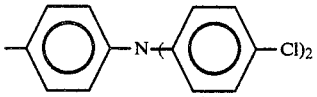 |
| 75 | 0 | 3- | H | 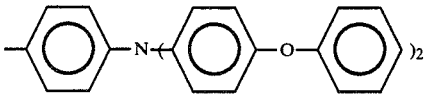 |
| 76 | 0 | 4- | H | 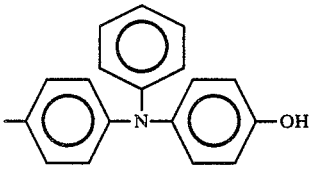 |
| 77 | 0 | 4- | H | 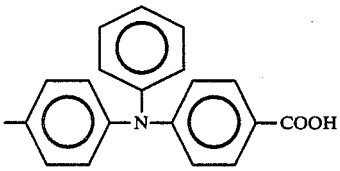 |
| 78 | 0 | 4- | H | 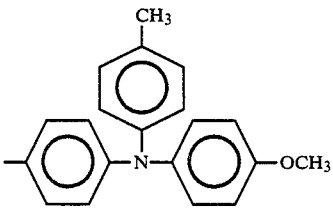 |

TABLE 5-continued
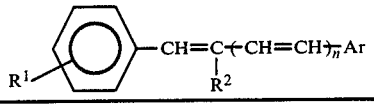
| | | | | |
|---|---|---|---|---|
| 79 | 0 | 3- | H | 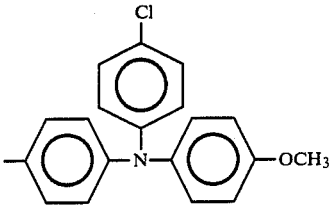 |
| 80 | 0 | 4- | H | 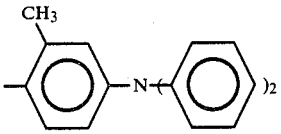 |
| 81 | 0 | 3- | H | 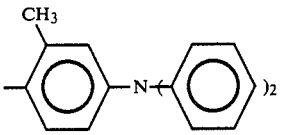 |
| 82 | 0 | 2- | H | 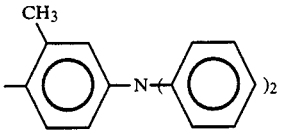 |
| 83 | 0 | 3- | H | 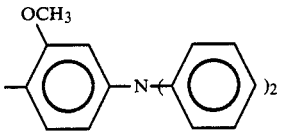 |
| 84 | 0 | 2- | H | 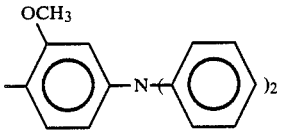 |
| 85 | 0 | 4- | H | 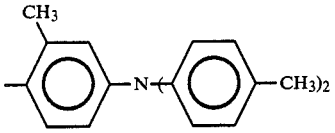 |
| 86 | 0 | 2- | H | 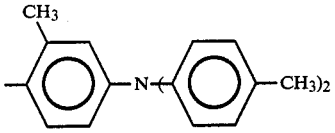 |
| 87 | 0 | 4- | H | 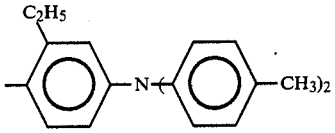 |
| 88 | 0 | 4- | H | 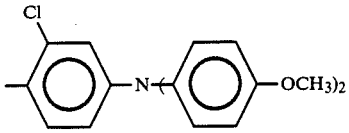 |

TABLE 5-continued
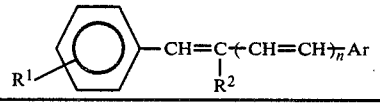
| | | | | |
|---|---|---|---|---|
| 89 | 0 | 3- | H | |
| 90 | 0 | 2- | H | |
| 91 | 0 | 4- | H | |
| 92 | 0 | 4- | H | |
| 93 | 0 | 4- | H | |
| 94 | 0 | 4- | H | |
| 95 | 0 | 4- | H | |
| 96 | 0 | 4- | H | |
| 97 | 0 | 3- | H | |

TABLE 5-continued
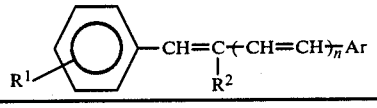
| | | | | |
|---|---|---|---|---|
| 98 | 0 | 2- | H | 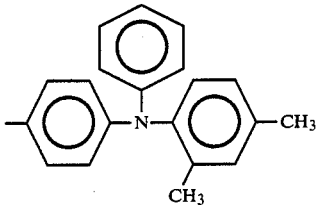 |
| 99 | 0 | 4- | H | 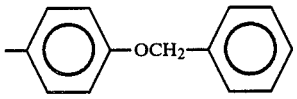 |
| 100 | 0 | 4- | H | 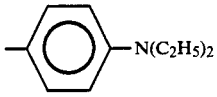 |
| 101 | 0 | 4- | H | 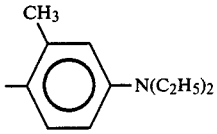 |
| 102 | 0 | 4- | H | 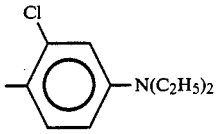 |
| 103 | 0 | 4- | H | 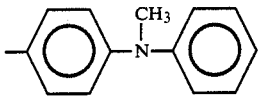 |
| 104 | 0 | 4- | H | 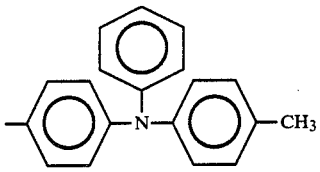 |
| 105 | 0 | 4- | H | 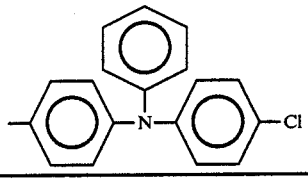 |
| Stilbene Derivative No. | n | $R^1$ | $R^2$ | Ar |
|---|---|---|---|---|
| 106 | 0 | 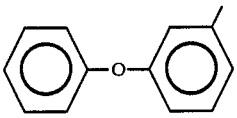 | 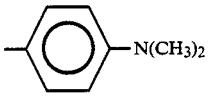 | 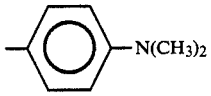 |

TABLE 5-continued
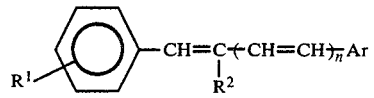
| | | | | |
|---|---|---|---|---|
| 107 | 0 | 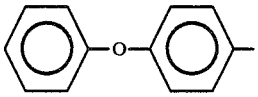 | 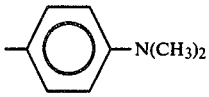 | 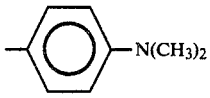 |
| 108 | 0 | 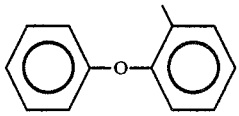 | 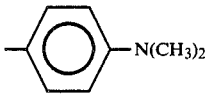 | 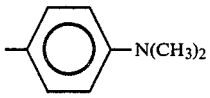 |
| 109 | 0 | 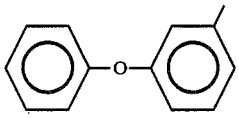 | $CH_3$ | 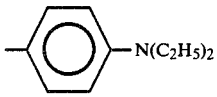 |
| 110 | 0 | 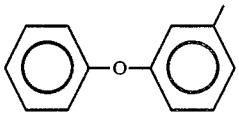 | H | 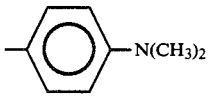 |
| 111 | 0 | 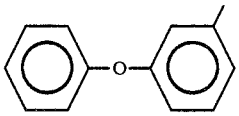 | H | 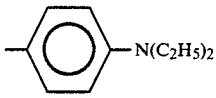 |
| 112 | 0 | 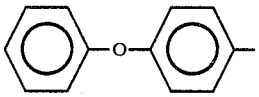 | H | 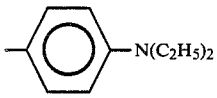 |
| 113 | 0 | 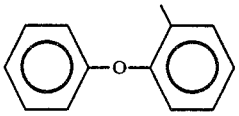 | H | 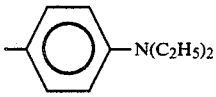 |
| 114 | 0 | 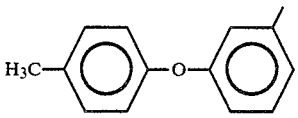 | H | 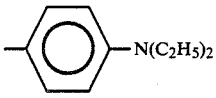 |
| 115 | 0 | 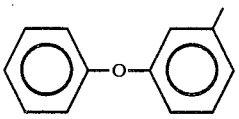 | H | 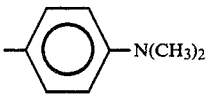 |
| 116 | 0 | 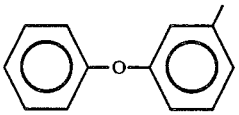 | H | 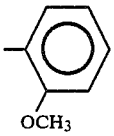 |
| 117 | 0 | 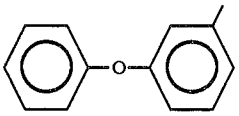 | H | 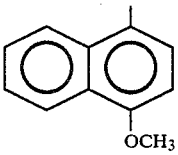 |

TABLE 5-continued
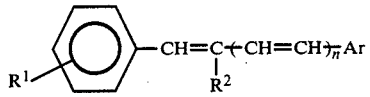
| | | | | |
|---|---|---|---|---|
| 118 | 0 | 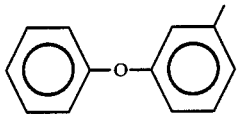 | H | 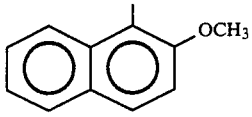 |
| 119 | 0 | 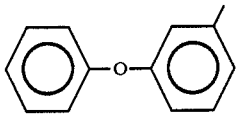 | H | 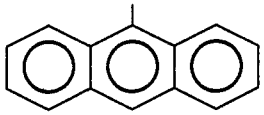 |
| 120 | 0 | 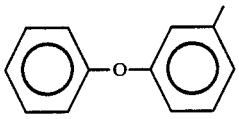 | H | 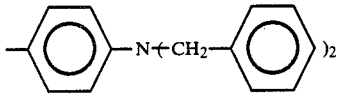 |
| 121 | 0 | 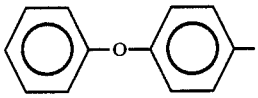 | H | 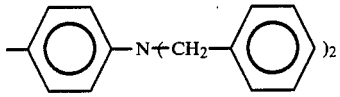 |
| 122 | 0 | 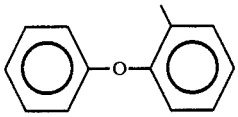 | H | 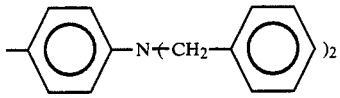 |
| 123 | 0 | 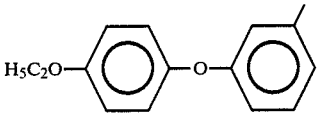 | H | 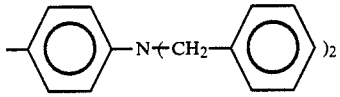 |
| 124 | 0 | 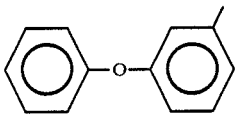 | H | 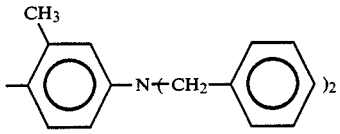 |
| 125 | 0 | 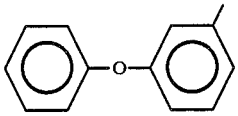 | H | 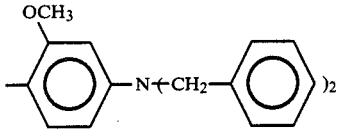 |
| 126 | 0 | 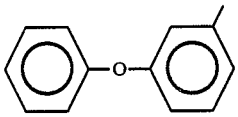 | H | 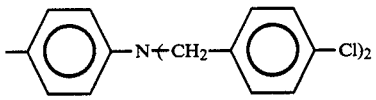 |
| 127 | 0 | 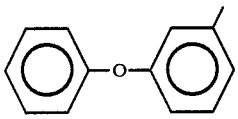 | H | 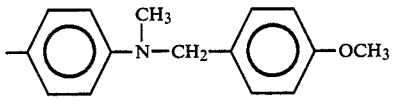 |
| 128 | 0 | 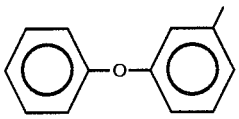 | H | 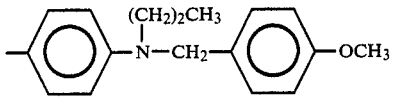 |

TABLE 5-continued
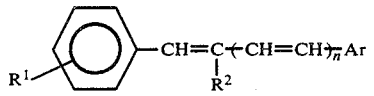
| | | | | |
|---|---|---|---|---|
| 129 | 0 | 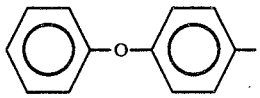 | H | 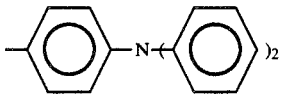 |
| 130 | 0 | 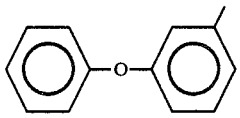 | H | 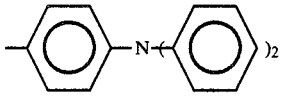 |
| 131 | 0 | 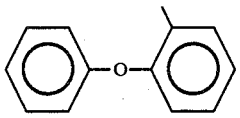 | H | 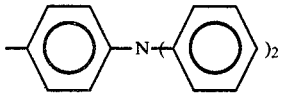 |
| 132 | 0 | 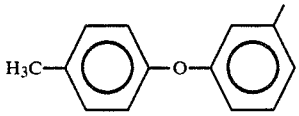 | H | 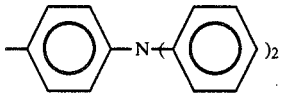 |
| 133 | 0 | 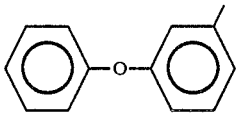 | H | 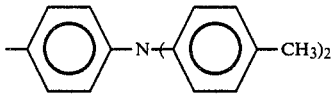 |
| 134 | 0 | 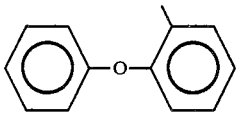 | H | 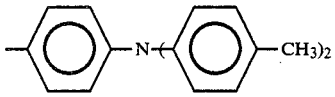 |
| 135 | 0 | 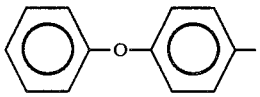 | H | 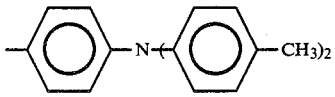 |
| 136 | 0 | 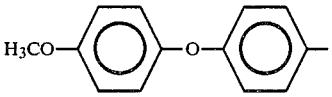 | H | 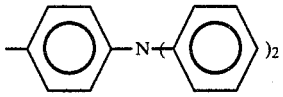 |
| 137 | 0 | 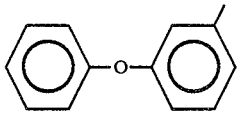 | H | 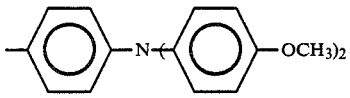 |
| 138 | 0 | 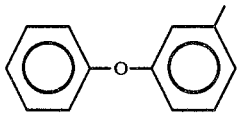 | H | 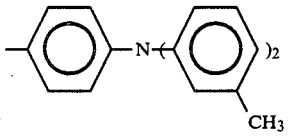 |
| 139 | 0 | 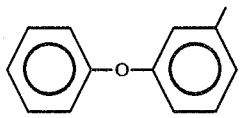 | H | 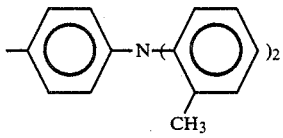 |

TABLE 5-continued
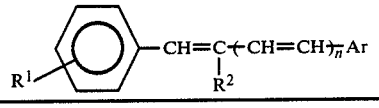
| | | | | |
|---|---|---|---|---|
| 140 | 0 | 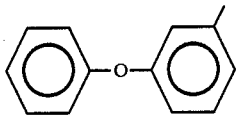 | H | 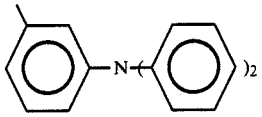 |
| 141 | 0 | 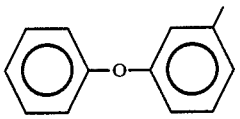 | H | 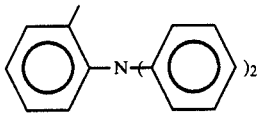 |
| 142 | 0 | 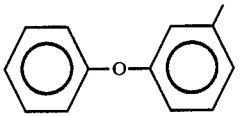 | H | 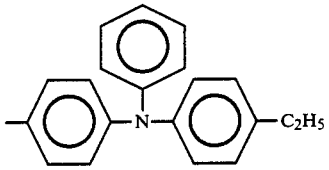 |
| 143 | 0 | 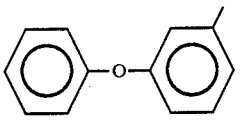 | H | 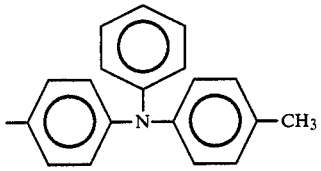 |
| 144 | 0 | 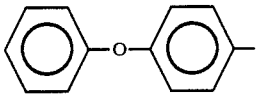 | H | 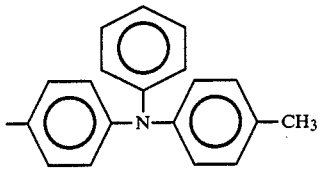 |
| 145 | 0 | 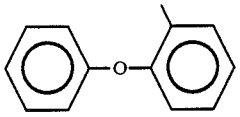 | H | 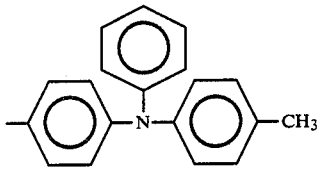 |
| 146 | 0 | 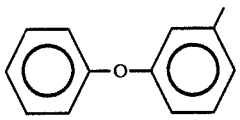 | H | 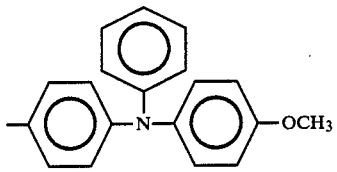 |
| 147 | 0 | 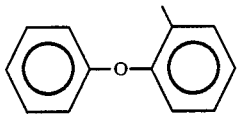 | H | 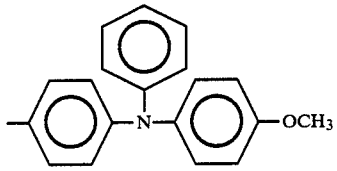 |

TABLE 5-continued
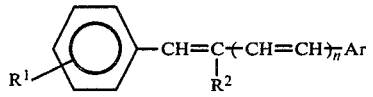
| | | | | |
|---|---|---|---|---|
| 148 | 0 | 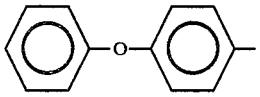 | H | 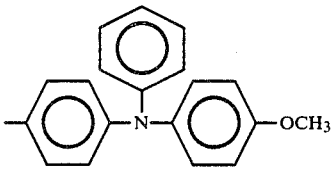 |
| 149 | 0 | 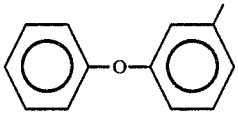 | H | 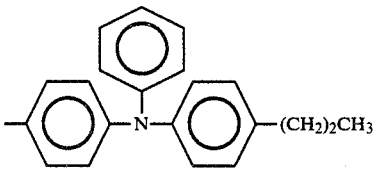 |
| 150 | 0 | 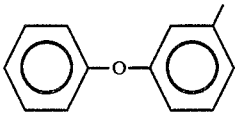 | H | 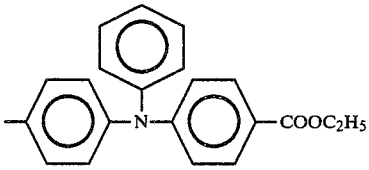 |
| 151 | 0 | 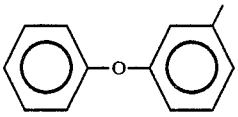 | H | 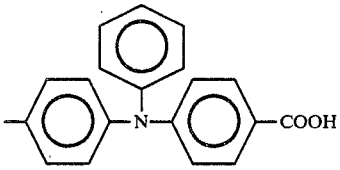 |
| 152 | 0 | 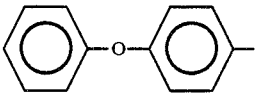 | H | 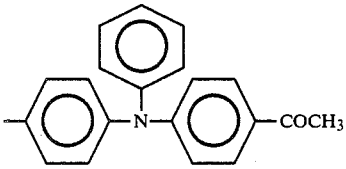 |
| 153 | 0 | 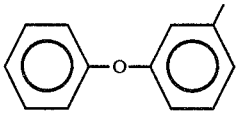 | H | 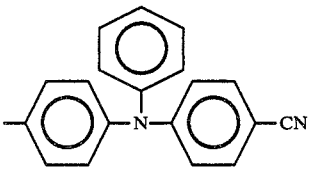 |
| 154 | 0 | 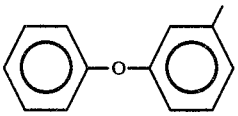 | H | 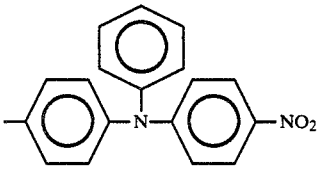 |
| 155 | 0 | 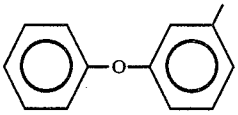 | H | 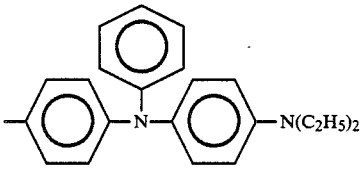 |

TABLE 5-continued
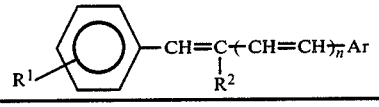
| | | | | |
|---|---|---|---|---|
| 156 | 0 | 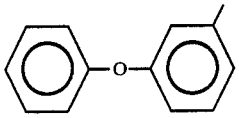 | H | 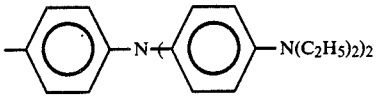 |
| 157 | 0 | 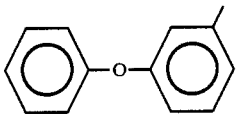 | H | 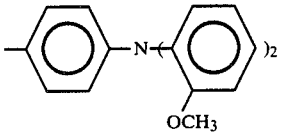 |
| 158 | 0 | 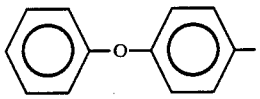 | H | 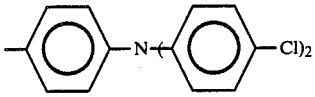 |
| 159 | 0 | 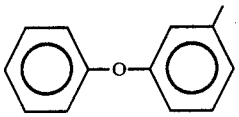 | H | 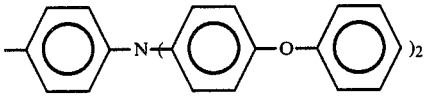 |
| 160 | 0 | 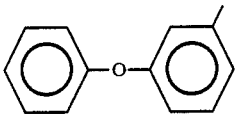 | H | 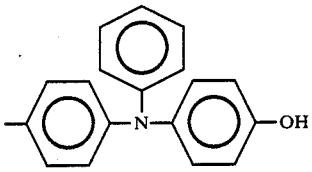 |
| 161 | 0 | 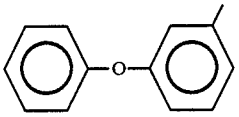 | H | 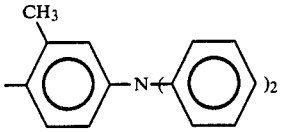 |
| 162 | 0 | 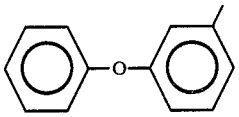 | H | 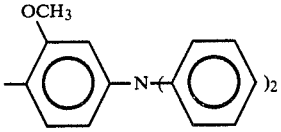 |
| 163 | 0 | 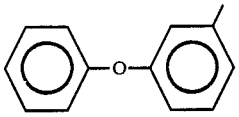 | H | 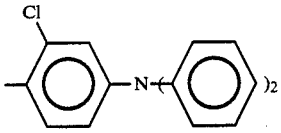 |
| 164 | 0 | 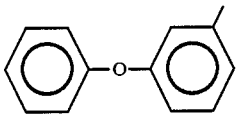 | H | 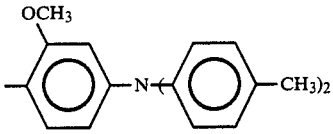 |
| 165 | 0 | 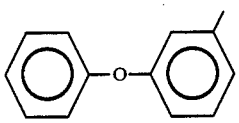 | H | 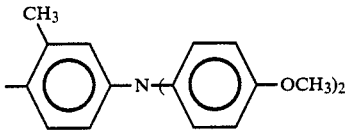 |

TABLE 5-continued
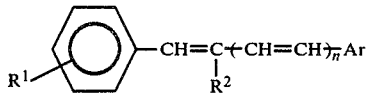
| | | | | |
|---|---|---|---|---|
| 166 | 0 | 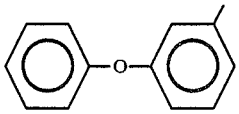 | H | 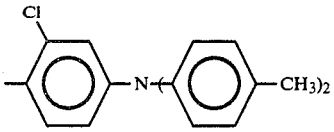 |
| 167 | 0 | 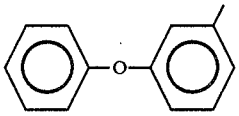 | H | 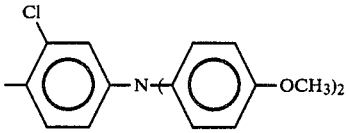 |
| 168 | 0 | 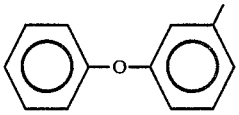 | H | 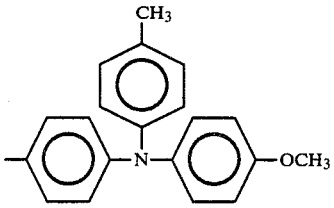 |
| 169 | 0 | 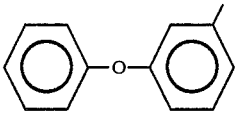 | H | 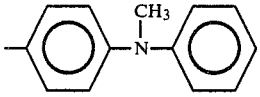 |
| 170 | 0 | 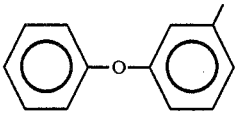 | H | 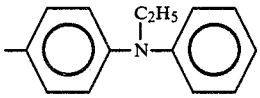 |
| 171 | 0 | 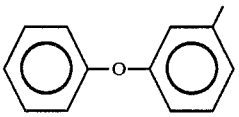 | H | 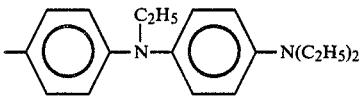 |
| 172 | 0 | 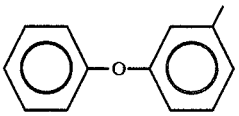 | H | 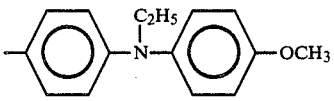 |
| 173 | 0 | 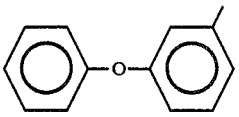 | H | 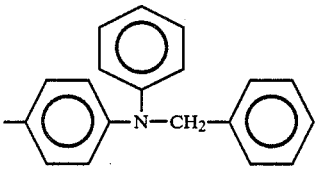 |
| 174 | 0 | 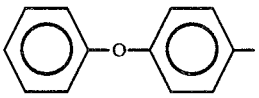 | H | 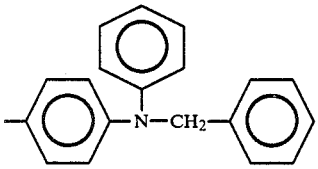 |

TABLE 5-continued
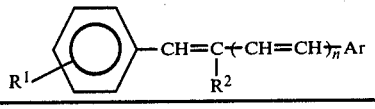
| | | | | |
|---|---|---|---|---|
| 175 | 0 | 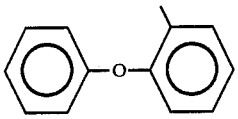 | H | 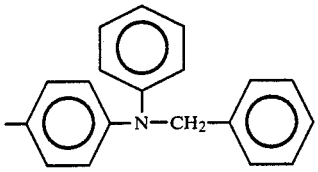 |
| 176 | 0 | 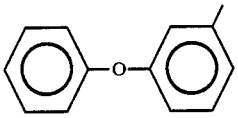 | H | 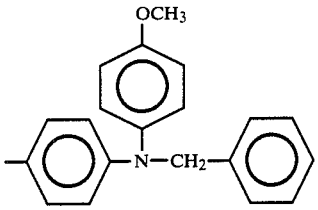 |
| 177 | 0 | 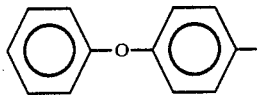 | H | 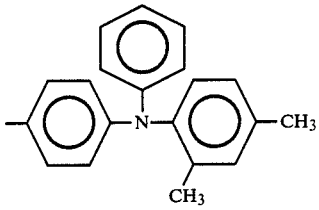 |
| 178 | 0 | 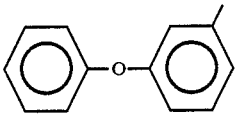 | H | 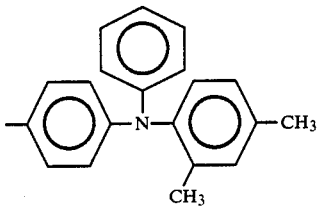 |
| 179 | 0 | 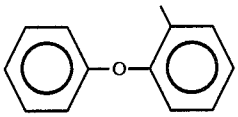 | H | 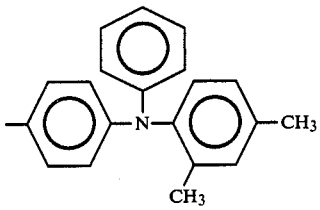 |
| 180 | 0 | 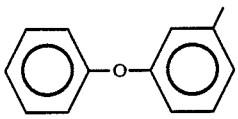 | H | 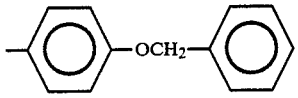 |
| 181 | 0 | 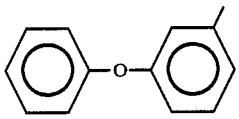 | H | 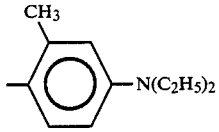 |

TABLE 5-continued
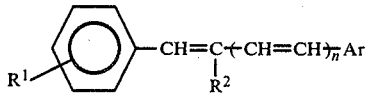
| | | | | |
|---|---|---|---|---|
| 182 | 0 | 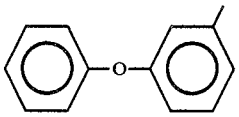 | H | 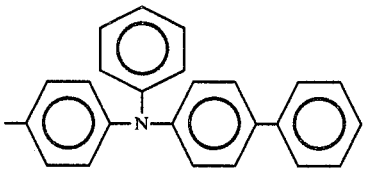 |
| 183 | 0 | 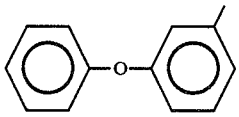 | H | 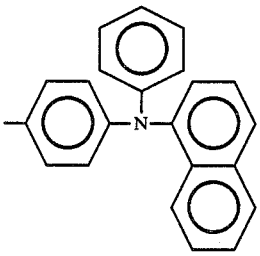 |
| 184 | 0 | 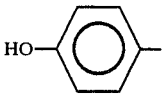 | H | 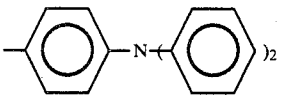 |
| 185 | 0 | 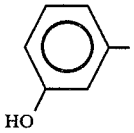 | H | 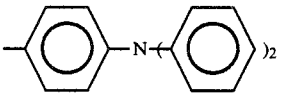 |
| 186 | 0 | 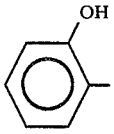 | H | 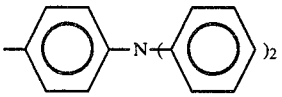 |
| 187 | 0 | 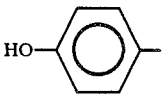 | H | 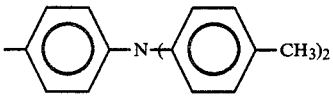 |
| 188 | 0 | 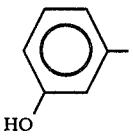 | H | 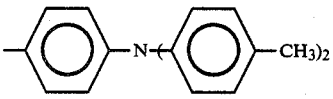 |
| 189 | 0 | 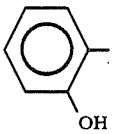 | H | 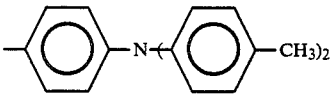 |

TABLE 5-continued

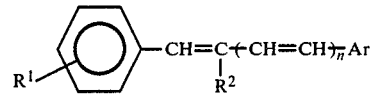

| | | | |
|---|---|---|---|
| 190 | 0 | H | 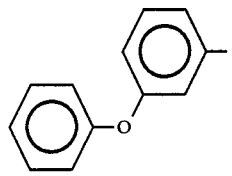 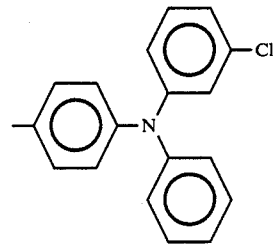 |

When an electrophotographic photoconductor according to the present invention as shown in FIG. 1 is prepared, at least one of the above prepared stilbene derivatives is dispersed in a binder resin solution, and a sensitizer dye is then added to the mixture, and the thus prepared photosensitive liquid is applied to an electroconductive support material 1 and dried, so that a photosensitive layer 2*a* is formed on the electroconductive support material 1.

It is preferable that the thickness of the photosensitive layer 2*a* be in the range of about 3 μm to about 50 μm, more preferably in the range of about 5 μm to about 20 μm. It is preferable that the amount of the stilbene derivatives contained in the photosensitive layer 2*a* be in the range of about 30 wt.% to about 70 wt.% of the total weight of the photosensitive layer 2*a*, more preferably about 50 wt.% of the total weight of the photosensitive layer 2*a*. Further, it is preferable that the amount of the sensitizer dye contained in the photosensitive layer 2*a* be in the range of about 0.1 wt.% to about 5 wt.% of the total weight of the photosensitive layer 2*a*, more preferably in the range of about 0.5 wt.% to about 3 wt.%, of the total weight of the photosensitive layer 2*a*.

As the sensitizer dye, the following can be employed in the present invention: triarylmethane dyes, such as Brilliant Green, Victoria Blue B, Methyl Violet, Crystal Violet, and Acid Violet 6B; xanthene dyes, such as Rhodamine B, Rhodamine 6G, Rhodamine G Extra, Eosin S, Erythrosin, Rose Bengale, and Fluorescein; thiazine dyes such as Methylene Blue; cyanin dyes such as cyanin; and pyrylium dyes, such as 2,6-diphenyl-4-(N,N-dimethylaminophenyl)thiapyrylium perchlorate and benzopyrylium salt (as described in Japanese Patent Publication 48-25658). These sensitizer dyes can be used alone or in combination.

An electrophotographic photoconductor according to the present invention as shown in FIG. 2 can be prepared, for example, as follows. A charge generating material 3 in the form of small particles is dispersed in a solution of one or more stilbene derivatives and a binder agent. The thus prepared dispersion is applied to the electroconductive support material 1 and is then dried, whereby a photosensitive layer 2*b* is formed on the electroconductive support material 1.

It is preferable that the thickness of the photosensitive layer 2*b* be in the range of about 3 μm to about 50 μm, more preferably in the range of about 5 μm to about 20 μm. It is preferable that the amount of the stilbene derivative contained in the photosensitive layer 2*b* be in the range of about 10 wt.% to about 95 wt.%, more preferably in the range of about 30 wt.% to about 90 wt.% of the total weight of the photosensitive layer 2*b*. Further, it is preferable that the amount of the charge generating material 3 contained in the photosensitive layer 2*b* be in the range of about 0.1 wt.% to about 50 wt.%, more preferably in the range of about 1 wt.% to about 20 wt.%, of the total weight of the photosensitive layer 2*b*.

As the charge generating material 3, the following can be employed in the present invention: inorganic pigments, such as selenium, a selenium-tellurium alloy, cadmium sulfide, a cadmium sulfide-selenium alloy, and α-silicon; and organic pigments, such as C.I. Pigment Blue 25 (C.I. 21,180), C.I. Pigment Red 41 (C.I. 21,200), C.I. Acid Red 52 (C.I. 45,100), and C.I. Basic Red 3 (C.I. 45,210); an azo pigment having a carbazole skeleton (Japanese Laid-Open Patent Application No. 53-95033), an azo dye having a distyrylbenzene skeleton (Japanese Laid-Open Patent Application No. 53-133445), an azo pigment having a triphenylamine skeleton (Japanese Laid-Open Patent Application No. 53-132347), an azo pigment having a dibenzothiophene skeleton (Japanese Laid-Open Patent Application No. 54-21728), an azo pigment having an oxazole skeleton (Japanese Laid-Open Patent Application No. 54-12742), an azo pigment having a fluorenone skeleton (Japanese Laid-Open Patent Application No. 54-22834), an azo pigment having a bisstilbene skeleton (Japanese Laid-Open Patent Application No. 54-17733), an azo pigment having a distyryl oxadiazole skeleton (Japanese Laid-Open Patent Application No. 54-2129), an azo dye having a distyryl carbazole skeleton (Japanese Laid-Open Patent Application No. 54-14967); a phthalocyanine-type pigment such as C.I. Pigment Blue 16 (C.I. 74,100); Indigo-type pigments such as C.I. Vat Brown 5 (C.I. 73,410) and C.I. Vat Dye (C.I. 73,030); and perylene-type pigments, such as Algo Scarlet B (made by Bayer Co., Ltd.) and Indanthrene Scarlet R (made by Bayer Co., Ltd). These charge generating materials can be used alone or in combination.

The photoconductor according to the present invention as shown in FIG. 3 can be prepared, for example, as follows. A charge generating material in vacuum-evaporated on the electroconductive support material 1, or a charge generating material in the form of fine particles is dispersed in a solution of a binder agent. This dispersion is applied to the electroconductive support material 1 and then dried, and, if necessary, the applied layer is subjected to buffing to make the surface smooth or to adjust the thickness of the layer to a predetermined thickness, whereby a charge generating layer 5 is formed. A charge transporting layer 6 is then formed on the charge generating layer 5 by applying a solution of one or more stilbene derivatives and a binder agent to the charge generating layer 5 and then drying. In this photoconductor, the charge generating material employed is the same as that employed in the photoconductor shown in FIG. 2. It is preferable that the thickness of the charge generating layer 5 be less than about 5 μm, more preferably less than about 2 μm. It is preferable that the thickness of the charge transporting layer 6 be in the range of about 3 μm to about 50 μm, more preferably in the range of about 5 μm to about 20 μm. In the case where the charge generating layer 5 comprises the charge generating material 3 in the form of fine particles, dispersed in a binder agent, it is preferable that the amount of the charge generating material 3 in the charge generating layer 5 be in the range of about 10 wt.% to about 95 wt.% of the entire weight of the charge generating layer 5, more preferably in the range of about 50 wt.% to about 90 wt.%. Further, it is preferable that the amount of the stilbene derivative contained in the charge transporting layer 6 be in the range of about 10 wt.% to about 95 wt.%, more preferably in the range of about 30 wt.% to about 90 wt.% of the total weight of the charge transporting layer 6.

As the electroconductive support material 1 for use in the present invention, a metal plate or metal foil, for example, made of aluminum, a plastic film on which a metal, for example, aluminum, is evaporated, or paper which has been treated so as to be electroconductive, can be employed.

As the binder agent for use in the present invention, condensation resins, such as polyamide, polyurethane, polyester, epoxy resin, polyketone and polycarbonate; and vinyl polymers such as polyvinylketone, polystyrene, poly-N-vinylcarbazole and polyacrylamide, can be used.

Other conventional electrically insulating and adhesive resins can be used as the binder agent in the present invention. When necessary, there can be added to the binder resins a plasticizer, for example, halogenated paraffin, polybiphenyl chloride, dimethylnaphthalene and dibutyl phthalate.

In the above described photoconductors according to the present invention, if necessary, an adhesive layer or a barrier layer can be disposed between the electroconductive support material and the photosensitive layer. The adhesive layer or the barrier layer can be made of, for example, polyamide, nitrocellulose or aluminum oxide. It is preferable that the thickness of the adhesive layer or barrier layer be about 1 μm or less.

When copying is performed by use of the photoconductors according to the present invention, the surface of the photoconductor is charged uniformly in the dark to a predetermined polarity. The uniformly charged photoconductor is exposed to a light image so that a latent electrostatic image is formed on the photoconductor. The thus formed latent electrostatic image is developed by a developer to a visible image, and, when necessary, the developed image can be transferred to a sheet of paper. The photoconductors according to the present invention have high photosensitivity and excellent flexibility.

Preparation of embodiments of an electrophotographic photoconductors according to the present invention will now be explained in detail by referring to the following examples.

EXAMPLE P-1

The following components were ground and dispersed in a ball mill to prepare a charge generating layer formation liquid:

| | Parts by Weight |
|---|---|
| Diane Blue (C.I. Pigment Blue 25, C.I. 21180, a charge generating pigment of the following formula (CG-1)) | 76 |
| 2% tetrahydrofuran solution of a polyester resin (Vylon 200 made by Toyobo Co., Ltd.) | 1,260 |
| Tetrahydrofuran | 3,700 |

(CG-1)

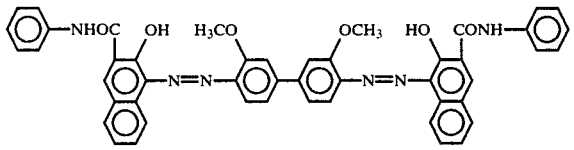

The thus prepared charge generating layer formation liquid was applied by a doctor blade to the aluminum-evaporated surface of an aluminum-evaporated polyester base film, which served as an electroconductive support material, so that a charge generating layer, with a thickness of about 1 μm when dried at room temperature, was formed on the electroconductive support material.

Then the following components were mixed and dissolved, whereby a charge transporting layer formation liquid was prepared:

| | Parts by Weight |
|---|---|
| 4-methoxy-4'-N,N—diphenylaminostilbene (Prepared in Synthesis Example 1; Stilbene Derivative No. 36 in Table 5) | 2 |
| Polycarbonate resin (Panlite K 1300 made by Teijin Limited.) | 2 |
| Tetrahydrofuran | 16 |

The thus prepared charge transporting layer formation liquid was applied to the aforementioned charge generating layer by a doctor blade and was dried at 80° C. for 2 minutes and then at 105° C. for 5 minutes, so that a charge transporting layer with a thickness of about 20 μm was formed on the charge generating layer; thus, an electrophotographic photoconductor No. 1 according to the present invention was prepared.

The electrophotographic photoconductor No. 1 was charged negatively in the dark under application of −6 kV of corona charge for 20 seconds and was then allowed to stand in the dark for 20 seconds without applying any charge thereto. At this moment, the surface potential Vpo (V) of the photoconductor was measured by a Paper Analyzer (Kawaguchi Electro Works, Model SP-428). The photoconductor was then illuminated by a tungsten lamp in such a manner that the illuminance on the illuminated surface of the photoconductor was 20 lux, and the exposure $E_{\frac{1}{2}}$ (lux·seconds) required to reduce the initial surface potential Vpo (V) to ½ the initial surface potential Vpo (V) was measured. The results showed that Vpo (V) = −1020 V and $E_{\frac{1}{2}}$ = 1.3 lux·seconds.

EXAMPLES P-2 THROUGH P-27

Example P-1 was repeated except that the charge generating material and the charge transporting material (Stilbene Derivative No. 36 in Table 5) employed in Example P-1 were respectively replaced by the charge generating materials and the charge transporting materials (stilbene derivatives) listed in Table 6, whereby electrophotographic photoconductors No. 2 through No. 27 according to the present invention were prepared.

$V_{po}$ and $E_{178}$ of each electrophotographic photoconductor are also shown in Table 7.

TABLE 6

| Example No. and Photoconductor No. | Charge Generating Material | Charge Transporting Material Stilbene Derivative No. in Table 5 |
|---|---|---|
| 1 | 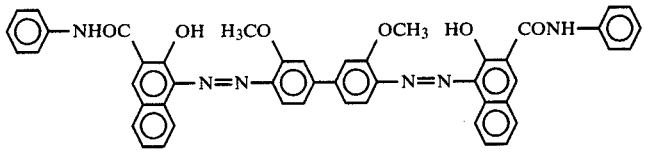 (CG-1) | 36 |
| 2 | 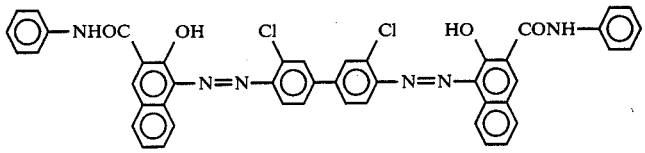 (CG-2) | 36 |
| 3 | 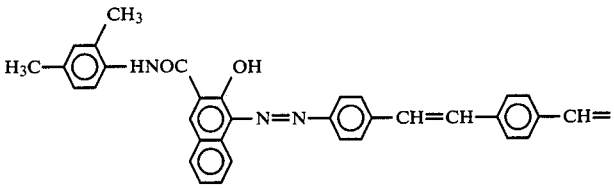 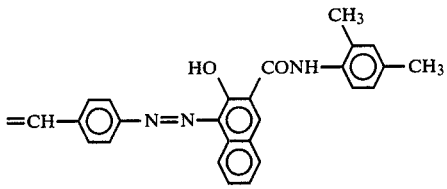 (CG-3) | 36 |
| 4 | 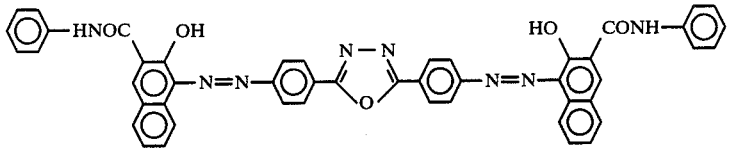 (CG-4) | 36 |
| 5 | 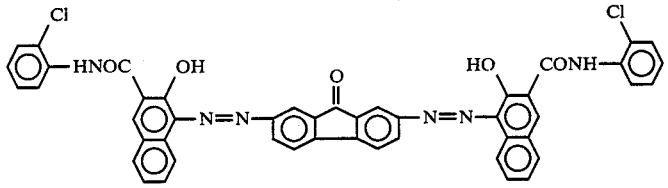 (CG-5) | 36 |

TABLE 6-continued
| Example No. and Photo-conductor No. | Charge Generating Material | Charge Transporting Material Stilbene Derivative No. in Table 5 |
|---|---|---|
| 6 | 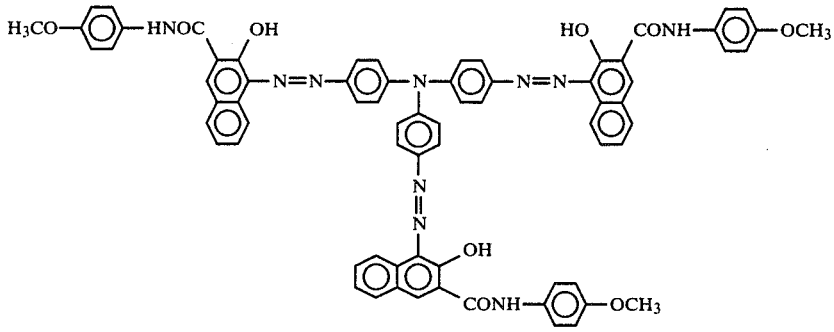 (CG-6) | 36 |
| 7 | β-Type Copper Phthalocyanine | 36 |
| 8 | 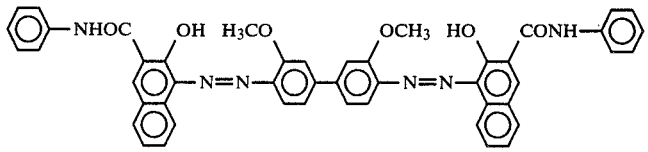 (CG-1) | 94 |
| 9 | 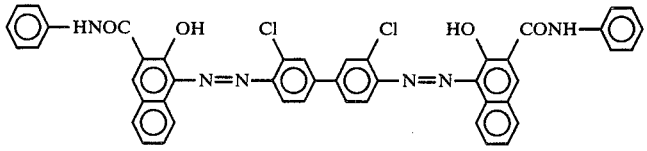 (CG-2) | 94 |
| 10 | 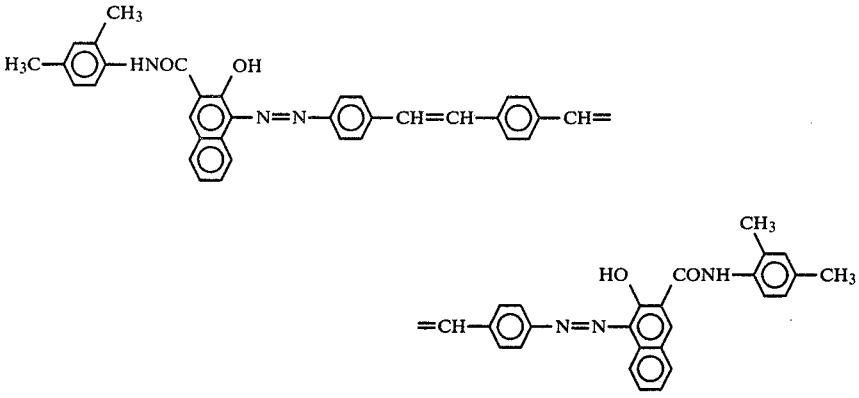 (CG-3) | 94 |
| 11 | 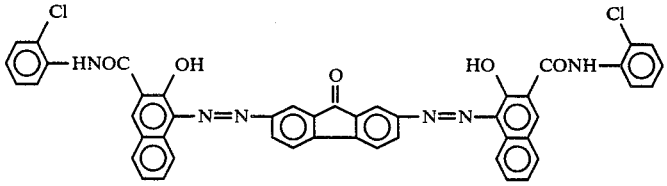 (CG-5) | 94 |

TABLE 6-continued
| Example No. and Photo-conductor No. | Charge Generating Material | Charge Transporting Material Stilbene Derivative No. in Table 5 |
|---|---|---|
| 12 | 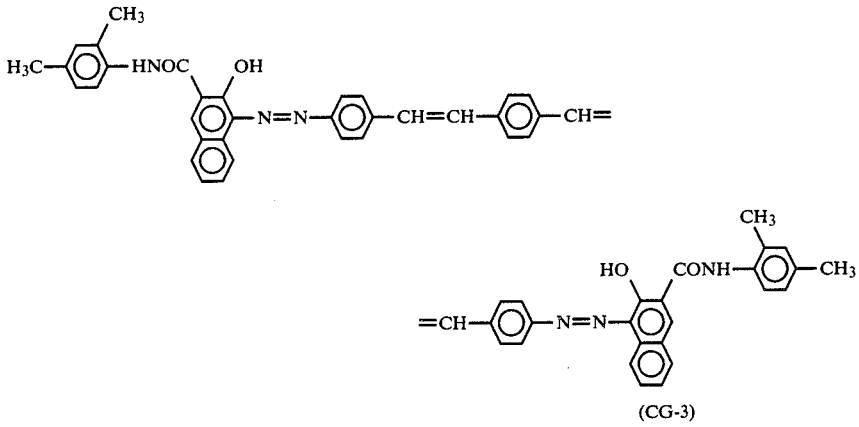 (CG-3) | 130 |
| 13 | 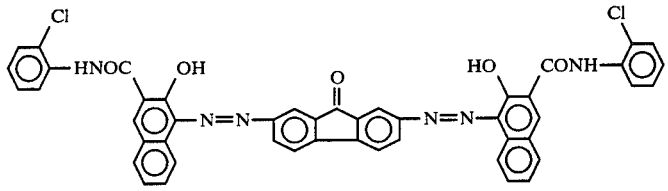 (CG-5) | 130 |
| 14 | 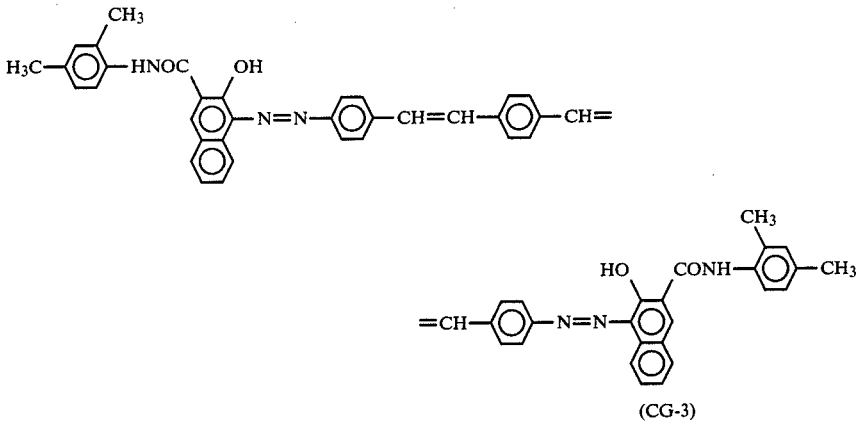 (CG-3) | 100 |
| 15 | 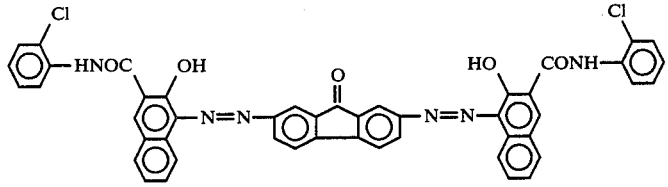 (CG-5) | 100 |
| 16 | 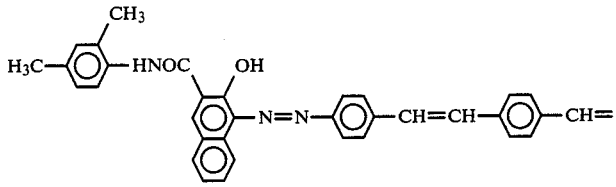 | 169 |

TABLE 6-continued
| Example No. and Photo-conductor No. | Charge Generating Material | Charge Transporting Material Stilbene Derivative No. in Table 5 |
|---|---|---|
| | 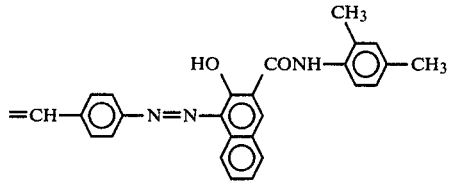 (CG-3) | |
| 17 | 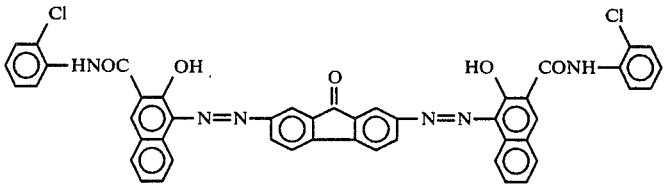 (CG-5) | 169 |
| 18 | 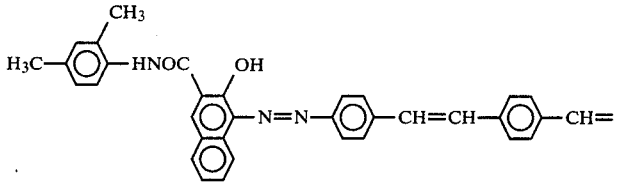 | 173 |
| | 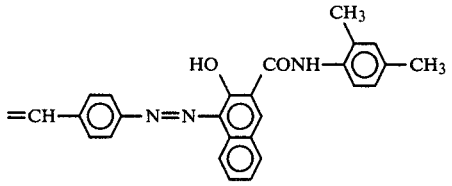 (CG-3) | |
| 19 | 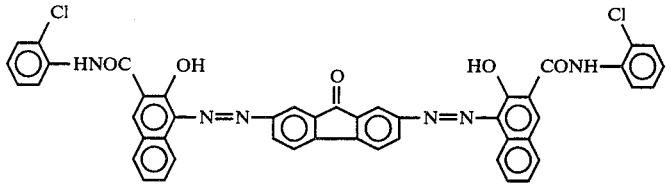 (CG-5) | 173 |
| 20 | 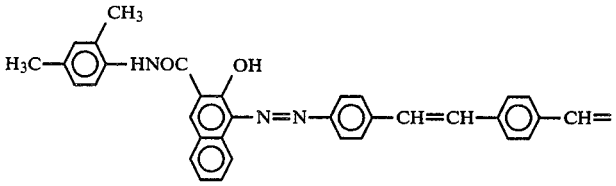 | 111 |
| | 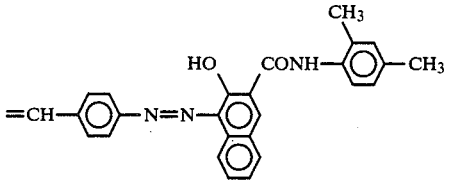 (CG-3) | |

TABLE 6-continued
| Example No. and Photo-conductor No. | Charge Generating Material | Charge Transporting Material Stilbene Derivative No. in Table 5 |
|---|---|---|
| 21 | 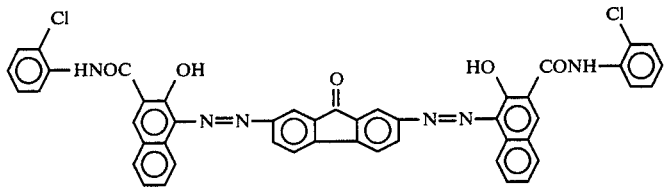 (CG-5) | 111 |
| 22 | 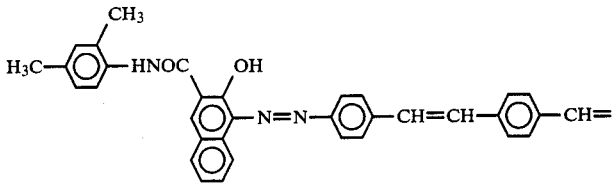 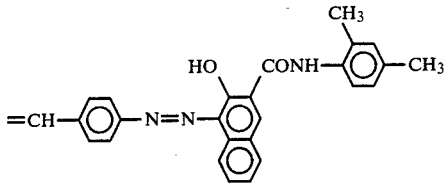 (CG-3) | 37 |
| 23 | 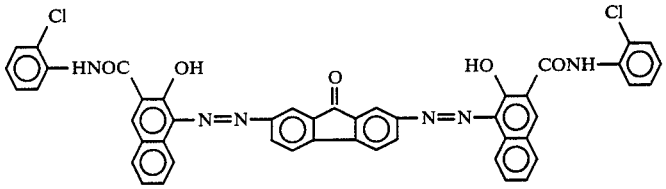 (CG-5) | 37 |
| 24 | 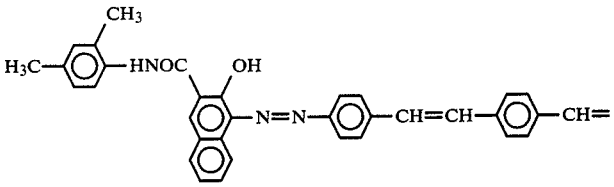 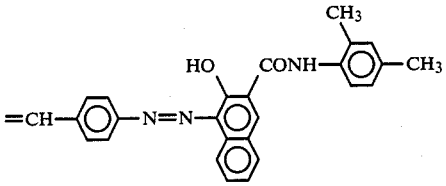 (CG-3) | 38 |

TABLE 6-continued

| Example No. and Photoconductor No. | Charge Generating Material | Charge Transporting Material Stilbene Derivative No. in Table 5 |
|---|---|---|
| 25 | 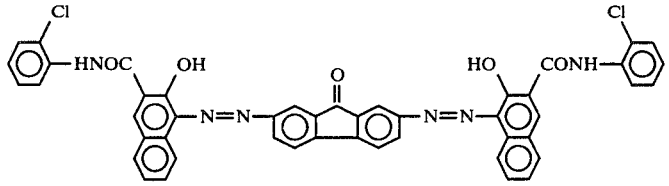 (CG-5) | 38 |
| 26 | 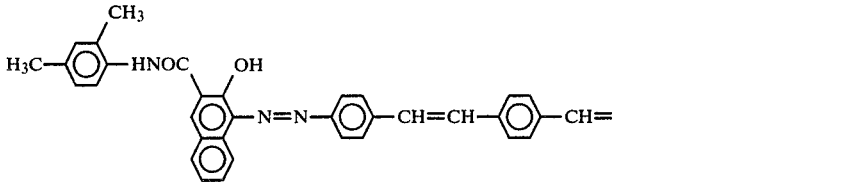 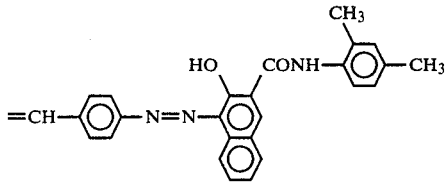 (CG-3) | 133 |
| 27 | 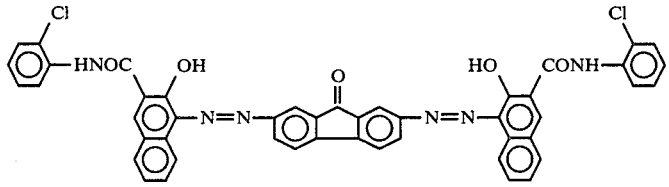 (CG-5) | 133 |

EXAMPLE P-28

Selenium was vacuum-evaporated with a thickness of approximately 1.0 μm on an approximately 300 μm thick aluminum plate so that a charge generating layer was formed on the aluminum plate.

A charge transporting layer liquid was prepared by mixing and dispersing the following components:

| | Parts by Weight |
|---|---|
| Stilbene derivative No. 36 (prepared in Synthesis Example 1 which was the same as that employed in Example P-1) | 2 |
| Polyester resin (Polyester Adhesive 49000 made by Du Pont Co.) | 3 |
| Tetrahydrofuran | 45 |

The thus prepared charge transporting layer liquid was applied to the aforementioned selenium charge generating layer by a doctor blade, dried at room temperature and then dried under reduced pressure, so that a charge transporting layer about 10 μm thick was formed on the charge generating layer; thus, an electrophotographic photoconductor No. 28 according to the present invention was prepared.

Vpo and $E_{178}$ were measured. The results showed that Vpo = −1250 V and $E_{\frac{1}{2}}$ = 2.4 lux·seconds.

EXAMPLE P-29

A perylene pigment C.I. Vat Red 23 (C.I. 71,130) of the following formula was vacuum-evaporated with a thickness of about 0.3 μm on an approximately 300 μm thick aluminum plate so that a charge generating layer was formed.

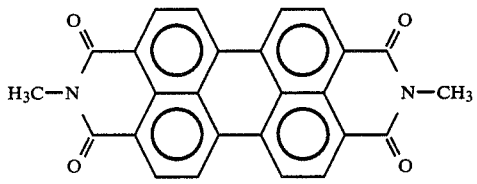

A charge transporting layer liquid was prepared by mixing and dispersing the following components:

| | Parts by Weight |
|---|---|
| Stilbene derivative No. 94 (prepared in Synthesis Example 5) | 2 |
| Polyester resin (Polyester Adhesive 49000 made by Du Pont Co.) | 3 |
| Tetrahydrofuran | 45 |

The thus prepared charge transporting layer liquid was applied to the aforementioned selenium charge generating layer by a doctor blade, dried at room temperature and then dried under reduced pressure, whereby a charge transporting layer about 10 μm thick was formed on the charge generating layer; thus, an electrophotographic photoconductor No. 29 according to the present invention was prepared.

Vpo and $E_{\frac{1}{2}}$ were measured. The results showed that Vpo = −1290 V and $E_{\frac{1}{2}}$ = 5.2 lux·seconds.

EXAMPLE P-30

One part by weight of Diane Blue (C.I. Pigment Blue 25, C.I. 21,180) which was the same as that employed in Example P-1 was added to 158 parts by weight of tetrahydrofuran, and the mixture was ground and dispersed in a ball mill. To this mixture, 12 parts by weight of Stilbene Derivative No. 36 and 18 parts by weight of a polyester resin (Polyester Adhesive 49000 made by Du Pont Co.) were added and mixed, whereby a photosensitive layer formation liquid was prepared.

The thus prepared photosensitive layer formation liquid was applied to an aluminum-evaporated polyester film by a doctor blade and was dried at 100° C. for 30 minutes, so that a photosensitive layer with a thickness of about 16 μm was formed on the aluminum-evaporated polyester film, thus, an electrophotographic photoconductor No. 30 according to the present invention was prepared.

The electrophotographic photoconductor No. 30 was charged positively in the dark under application of +6 kV of corona charge for 20 seconds and was then allowed to stand in the dark for 20 seconds without applying any charge thereto. At this moment, the surface potential Vpo (V) of the photoconductor was measured by a Paper Analyzer (Kawaguchi Electro Works, Model SP-428). The photoconductor was then illuminated by a tungsten lamp in such a manner that the illuminance on the illuminated surface of the photoconductor was 20 lux, so that the exposure $E_{\frac{1}{2}}$ (lux·seconds) required to reduce the initial surface potential Vpo (V) to ½ the initial surface potential Vpo (V) was measured. The results showed that Vpo (V) = +1030 V and $E_{\frac{1}{2}}$ = 2.2 lux·seconds.

The charge generating material, the charge transporting material, $V_{po}$ and $E_{\frac{1}{2}}$ of each of the electrophotographic photoconductors No. 1 through No. 30 are summarized in the following Table 7:

TABLE 7

| Photo-Conductor | Charge Generating Material | Charge Transporting Material (Stilbene Derivative) | $V_{po}$ (V) | $E_{\frac{1}{2}}$ (lux · seconds) |
|---|---|---|---|---|
| No. 1 | CG-1 | No. 36 | −1020 | 1.3 |
| No. 2 | CG-2 | No. 36 | −920 | 1.0 |
| No. 3 | CG-3 | No. 36 | −1210 | 1.2 |
| No. 4 | CG-4 | No. 36 | −1100 | 4.1 |
| No. 5 | CG-5 | No. 36 | −710 | 0.8 |
| No. 6 | CG-6 | No. 36 | −990 | 0.9 |

TABLE 7-continued

| Photo-Conductor | Charge Generating Material | Charge Transporting Material (Stilbene Derivative) | $V_{po}$ (V) | $E_{\frac{1}{2}}$ (lux · seconds) |
|---|---|---|---|---|
| No. 7 | β-type Copper Phthalocyanine | No. 36 | −780 | 2.5 |
| No. 8 | CG-1 | No. 94 | −1120 | 1.6 |
| No. 9 | CG-2 | No. 94 | −890 | 1.2 |
| No. 10 | CG-3 | No. 94 | −1190 | 1.2 |
| No. 11 | CG-5 | No. 94 | −1130 | 1.1 |
| No. 12 | CG-3 | No. 130 | −1220 | 1.0 |
| No. 13 | CG-5 | No. 130 | −1000 | 1.1 |
| No. 14 | CG-3 | No. 100 | −970 | 1.3 |
| No. 15 | CG-5 | No. 100 | −620 | 1.1 |
| No. 16 | CG-3 | No. 169 | −1310 | 1.7 |
| No. 17 | CG-5 | No. 169 | −1140 | 1.5 |
| No. 18 | CG-3 | No. 173 | −1270 | 1.4 |
| No. 19 | CG-5 | No. 173 | −1190 | 1.5 |
| No. 20 | CG-3 | No. 111 | −1110 | 1.7 |
| No. 21 | CG-5 | No. 111 | −1060 | 1.9 |
| No. 22 | CG-3 | No. 37 | −980 | 0.9 |
| No. 23 | CG-5 | No. 37 | −850 | 0.8 |
| No. 24 | CG-3 | No. 38 | −1240 | 1.3 |
| No. 25 | CG-5 | No. 38 | −1120 | 0.9 |
| No. 26 | CG-3 | No. 133 | −1140 | 1.4 |
| No. 27 | CG-5 | No. 133 | −1050 | 1.1 |
| No. 28 | Se | No. 36 | −1250 | 2.4 |
| No. 29 | Perylene Pigment | No. 94 | −1290 | 5.2 |
| No. 30 | CG-1 | No. 36 | +1030 | 2.2 |

Each of the electrophotographic photoconductors prepared in Examples P-1 through P-29 was negatively charged, while the electrophotographic photoconductor prepared in Example P-30 was positively charged, by a commercially available copying machine, so that a latent electrostatic image was formed on each photoconductor and was developed with a dry type developer. The developed images were transferred to a high quality transfer sheet and were fixed to the transfer sheet. As a result, clear images were obtained from each of the electrophotographic photoconductors.

When a wet type developer was used instead of the dry type developer, a clear image was also obtained from each of the electrophotographic photoconductor.

Of the stilbene derivatives of the previously described formula (I), a stilbene derivative of the following formula (Ib) can be synthesized as follows. A phenyl derivative of the formula (IIb) is allowed to react with an aldehyde derivative of the formula (IIIb) under the same reaction conditions using one of the previously described catalysts.

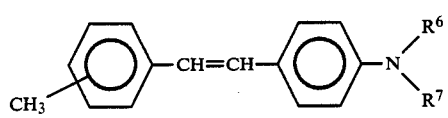

(Ib)

wherein $R^6$ and $R^7$ each represent a lower alkyl group, a benzyl group or an unsubstituted or substituted phenyl group.

In the above formula, the substituents of the phenyl group in $R^6$ and $R^7$ are, for example, an alkyl group, an alkoxy group, halogen, a dialkylamino group, a hydroxy group, a carboxyl group and an ester group thereof, an acetyl group, an allyloxy group, a nitro group and a cyano group.

(IIb)

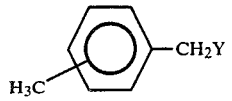

wherein Y represents a triphenylphosphonium group of the formula

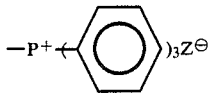

in which $Z^{\ominus}$ indicates a halogen ion, or a dialkoxyphosphorous group of the formula —PO(OR)2 in which R indicates a lower alkyl group.

(IIIb)

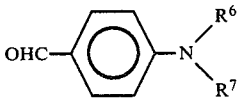

wherein $R^6$ and $R^7$ each represent a lower alkyl group, a benzyl group or an unsubstituted or substituted phenyl group.

Stilbene derivatives of the formula (Ib) can be prepared in the same manner as in the case of previously described the stilbene derivatives of the formula (Ia). Specific examples of the preparation are as follows:

SYNTHESIS EXAMPLE 19 (Synthesis of Stilbene Derivative No. 231 in Table 10)

4.85 g (0.02 mol) of diethyl 4-methylbenzylphosphonate and 5.47 g (0.02 mol) of 4-N,N-diphenylaminobenzaldehyde were dissolved in 30 ml of N,N-dimethylformamide. To this mixture, 5.79 g of a 28% methanol solution of sodium methylate was added dropwise over a period of 15 minutes. After the addition of the methanol solution of sodium methylate, the reaction mixture was stirred at temperatures ranging from 49° C. to 50° C. for 5 hours, cooled to room temperature and then diluted with 30 ml of methanol. Crystals separated from the reaction mixture, which were separated by filtration, washed with water and dried. The yield was 6.44 g (89.2%). The melting point of the thus obtained crystals was 160.5°–162.0° C.

Upon recrystallization of the crystals from a mixed solvent of ethyl acetate and ethanol, 4-methyl-4'-N,N-diphenylaminostilbene (Stilbene Derivative No. 231 in Table 10) precipitated as light yellow needle-like crystals. The melting point of the thus obtained 4-methyl-4'-N,N-diphenylaminostilbene was at 162.0°–163.0° C.

The results of the elemental analysis of the thus obtained 4-methyl-4'-N,N-diphenylaminostilbene were as follows:

| | % C | % H | % N |
|---|---|---|---|
| Found | 89.74 | 6.39 | 3.85 |
| Calculated | 89.70 | 6.43 | 3.88 |

The above calculation was based on the formula for 4-methyl-4'-N,N-diphenylaminostilbene of $CH_{27}H_{23}N$.

Figure 6:
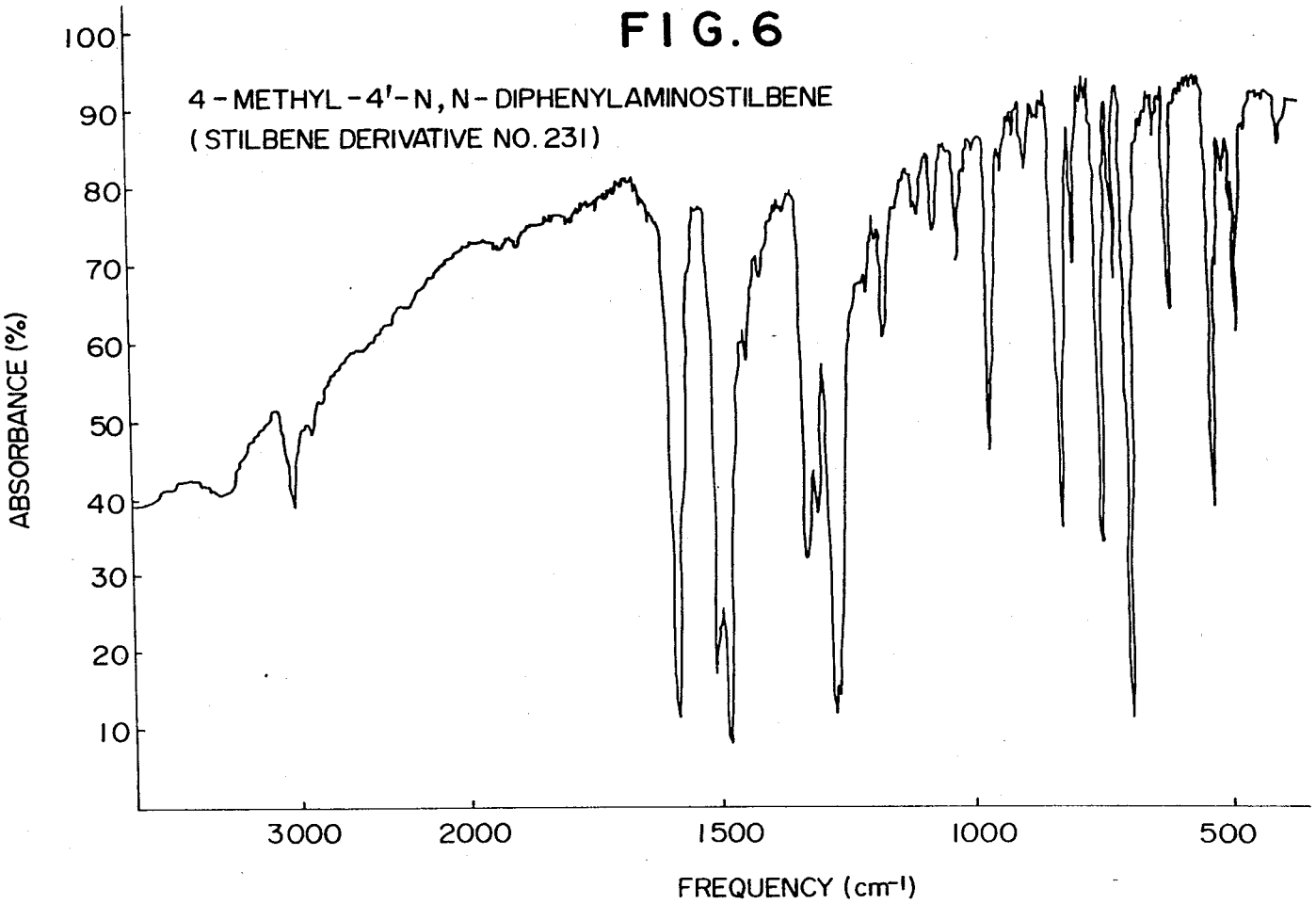
FIG. 6 is an infrared spectrum of 4-methyl-4'-N,N-diphenylaminostilbene, which is Stilbene Derivative No. 231 in Table 10.

An infrared spectrum of the 4-methyl-4'-N,N-diphenylaminostilbene, taken by use of a KBr pellet, indicated a peak at 960 $cm^{-1}$ which is characteristic of the out-of-plane =CH (trans) deformation vibrations as shown in FIG. 6.

SYNTHESIS EXAMPLE 20

4.03 g (0.01 mol) of 4-methylbenzyltriphenylphosphonium chloride and 2.74 g (0.01 mol) of 4-N,N-diphenylaminobenzylaldehyde were added 20 ml of N,N-dimethylformamide. To this mixture, 2.90 g of a 28% methanol solution of sodium methylate was added dropwise at temperatures ranging from 23° C. to 30° C. over a period of 20 minutes. After the dropwise addition of the methanol solution of sodium methylate, the reaction mixture was stirred at room temperature for 5 hours. The reaction mixture was then diluted with 30 ml of water. The product was extracted with toluene. The organic layer portion was washed with water and was then dried. The toluene was removed by evaporation from the organic layer portion, whereby light yellow crystals were obtained. The thus obtained light yellow crystals were recrystallized from a mixed solvent of toluene and n-hexane in the presence of a small amount of iodine, whereby 2.60 g (71.8%) of 4-methyl-4'-N,N-diphenylaminostilbene (Stilbene Derivative No. 231 in Table 10) was obtained as light yellow needle-like crystals. The melting point of the product was at 161.5°–162.5° C.

The results of the elemental analysis of the thus obtained 4-methyl-4'-N,N-diphenylaminostilbene were as follows:

| | % C | % H | % N |
|---|---|---|---|
| Found | 89.67 | 6.44 | 3.78 |
| Calculated | 89.70 | 6.43 | 3.88 |

The above calculation was based on the formula for 4-methyl-4'-N,N-diphenylaminostilbene of $C_{27}H_{23}N$.

An infrared spectrum of the 4-methyl-4'-N,N-diphenylaminostilbene taken by use of a KBr pellet was exactly the same as that shown in FIG. 6.

SYNTHESIS EXAMPLES 21 THROUGH 36

Synthesis Example 19 was repeated except that the diethyl 4-methylbenzylphosphonate and 4-N,N-diphenylbenzaldehyde employed in Synthesis Example 19 were respectively replaced by the diethylphosphonate derivatives and the aldehydes as listed in Table 8, whereby novel stilbene derivatives listed in Table 8 were prepared.

The yields and melting points and the results of the elemental analyses of the above stilbene derivatives prepared in Synthesis Examples 21 through 36 are shown in Table 9.

TABLE 8
| Synthesis Example | Diethylphosphonate | Aldehyde | Stilbene Derivative | Stilbene Derivative No. in Table 10 |
|---|---|---|---|---|
| 21 | 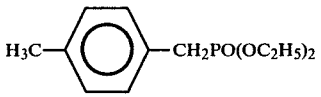 | 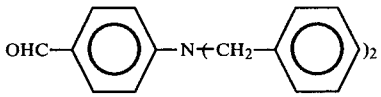 | 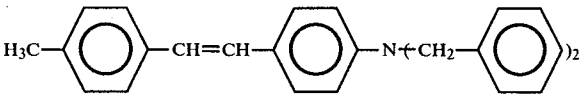 | 209 |
| 22 | 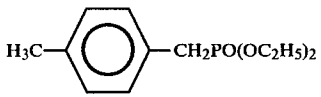 | 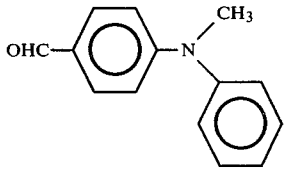 | 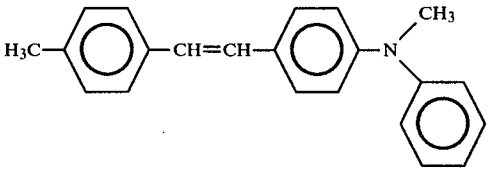 | 277 |
| 23 | 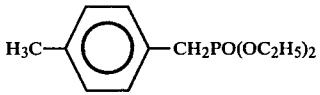 | 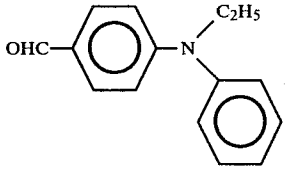 | 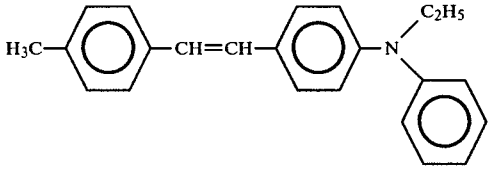 | 278 |
| 24 | 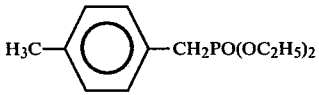 | 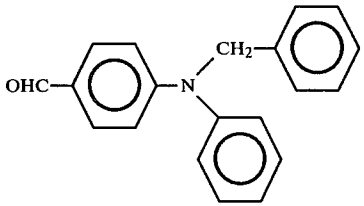 | 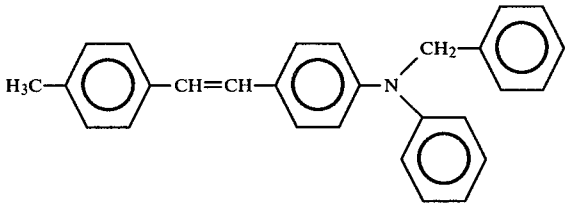 | 286 |
| 25 | 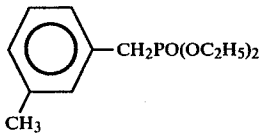 | 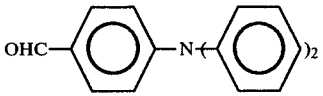 | 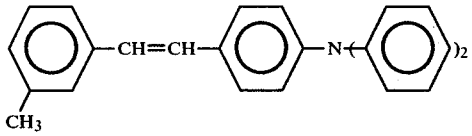 | 232 |

TABLE 8-continued
| Synthesis Example | Diethylphosphonate | Aldehyde | Stilbene Derivative | Stilbene Derivative No. in Table 10 |
|---|---|---|---|---|
| 26 | 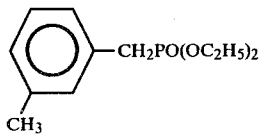 | 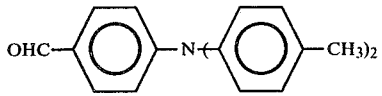 | 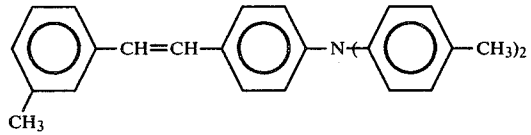 | 238 |
| 27 | 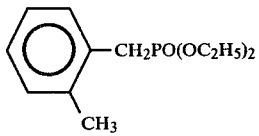 | 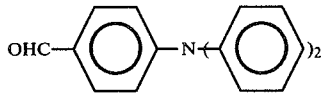 | 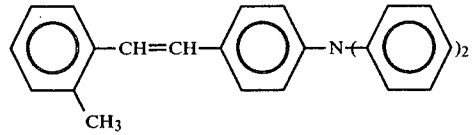 | 233 |
| 28 | 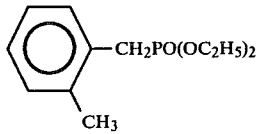 | 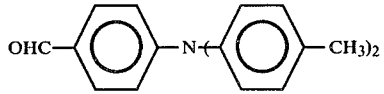 | 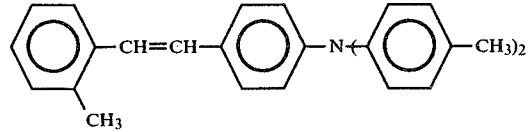 | 239 |
| 29 | 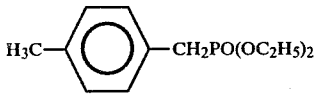 | 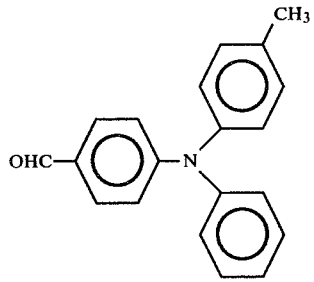 | 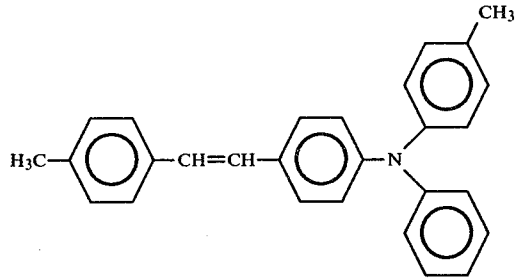 | 245 |

TABLE 8-continued
| Synthesis Example | Diethylphosphonate | Aldehyde | Stilbene Derivative | Stilbene Derivative No. in Table 10 |
|---|---|---|---|---|
| 30 | 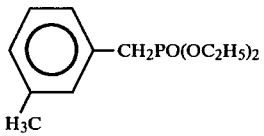 | 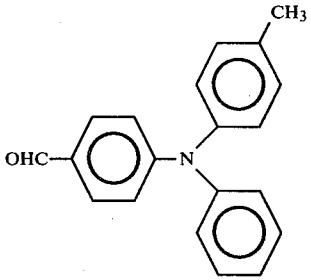 | 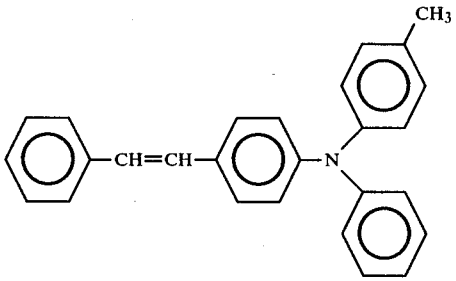 | 302 |
| 31 | 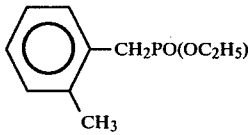 | 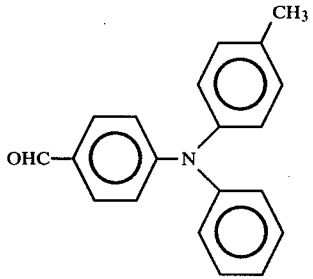 | 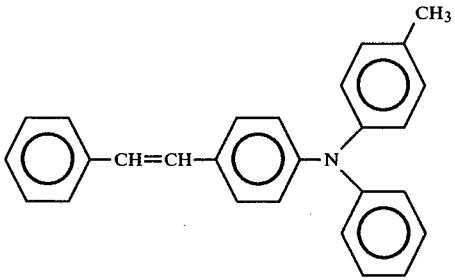 | 303 |
| 32 | 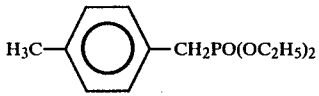 | 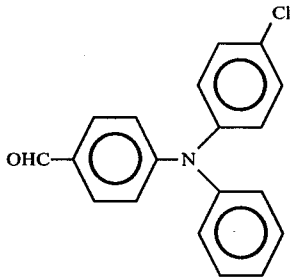 | 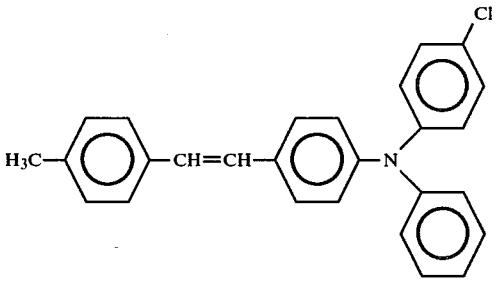 | 246 |

TABLE 8-continued
| Synthesis Example | Diethylphosphonate | Aldehyde | Stilbene Derivative | Stilbene Derivative No. in Table 10 |
|---|---|---|---|---|
| 33 | 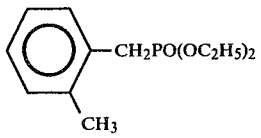 | 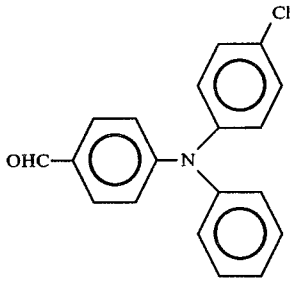 | 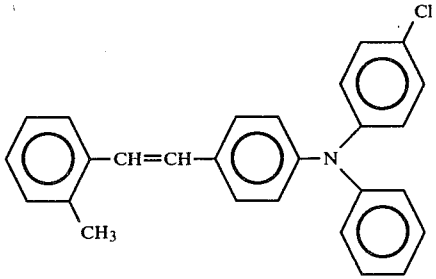 | 304 |
| 34 | 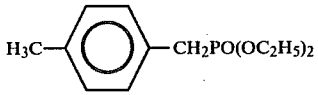 | 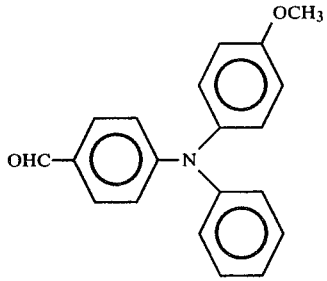 | 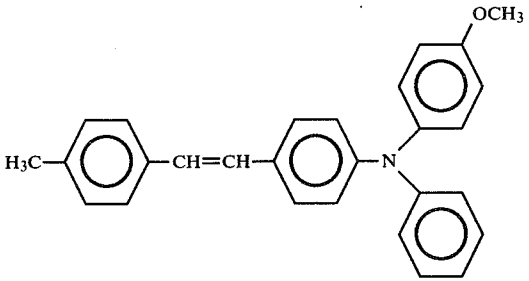 | 261 |
| 35 | 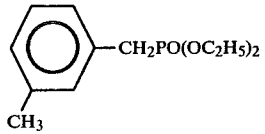 | 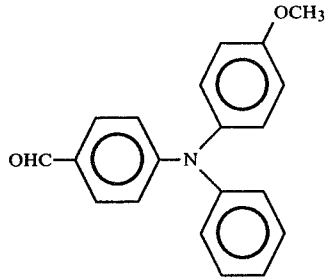 | 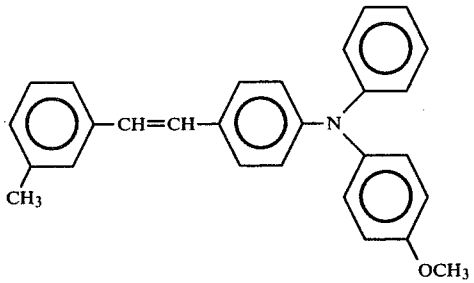 | 305 |

TABLE 8-continued
| Synthesis Example | Diethylphosphonate | Aldehyde | Stilbene Derivative | Stilbene Derivative No. in Table 10 |
|---|---|---|---|---|
| 36 | 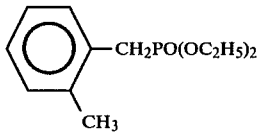 | 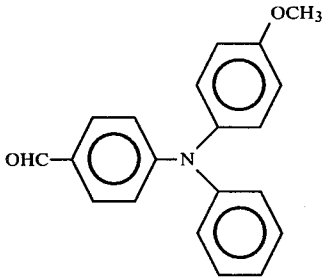 | 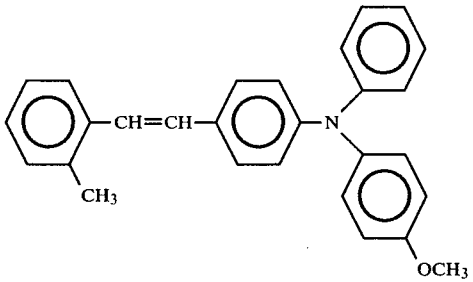 | 306 |

TABLE 9

| Synthesis Example No. | Yield (%) | Melting Point (°C.) | Elemental Analysis Found/Calculated % C | % H | % N |
|---|---|---|---|---|---|
| 21 | 81.0 | 147.5~148.5 | 89.34/89.40 | 7.01/7.00 | 3.52/3.60 |
| 22 | 85.3 | 148.5~149.0 | 88.17/88.24 | 6.98/7.08 | 4.52/4.68 |
| 23 | 79.3 | 119.5~120.5 | 88.28/88.12 | 7.40/7.41 | 4.35/4.47 |
| 24 | 92.0 | 109.5~110.5 | 89.58/89.55 | 6.70/6.72 | 3.69/3.73 |
| 25 | 78.5 | 83.5~85.0 | 89.80/89.70 | 6.47/6.43 | 3.86/3.88 |
| 26 | 79.0 | 89.0~91.0 | 89.31/89.40 | 7.01/7.00 | 3.57/3.60 |
| 27 | 89.0 | 101.5~102.5 | 89.71/89.70 | 6.40/6.43 | 3.88/3.88 |
| 28 | 75.8 | 117.5~118.5 | 89.37/89.40 | 6.92/7.00 | 3.61/3.60 |
| 29 | 92.3 | 139.5~140.5 | 89.44/89.55 | 6.59/6.72 | 3.83/3.73 |
| 30 | 87.0 | 92.0~95.5 | 89.54/89.55 | 6.69/6.72 | 3.71/3.73 |
| 31 | 89.0 | 100.0~101.5 | 89.48/89.55 | 6.71/6.72 | 3.70/3.73 |
| 32 | 94.7 | 110.0~111.5 | 81.99/81.90 | 5.59/5.61 | 3.58/3.54 |
| 33 | 90.0 | 97.0~99.5 | 81.85/81.90 | 5.53/5.61 | 3.57/3.54 |
| 34 | 89.0 | 124.0~125.0 | 85.91/85.89 | 6.39/6.45 | 3.60/3.58 |
| 35 | 92.5 | 92.5~94.5 | 85.76/85.89 | 6.39/6.45 | 3.62/3.58 |

TABLE 9-continued

| Synthesis Example No. | Yield (%) | Melting Point (°C.) | Elemental Analysis Found/Calculated % C | % H | % N |
|---|---|---|---|---|---|
| 36 | 98.0 | 100.0~102.0 | 85.81/85.89 | 6.39/6.45 | 3.61/3.58 |

In addition to the stilbene derivatives described in Synthesis Examples 19 through 36, other stilbene derivatives of the following formula, listed in the following Table 10, are also useful in the present invention.

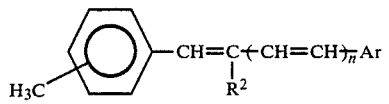

TABLE 10

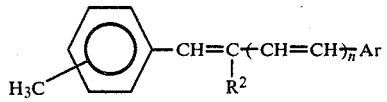

| Stilbene Derivative No. | n | Substituted Position | R | Ar |
|---|---|---|---|---|
| 191 | 0 | 4- | H | 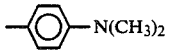 |
| 192 | 0 | 4- | H | 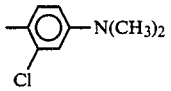 |
| 193 | 0 | 4- | H | 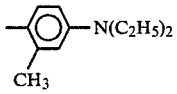 |
| 194 | 0 | 4- | H | 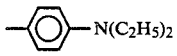 |
| 195 | 0 | 3- | H | 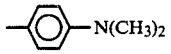 |
| 196 | 0 | 2- | H | 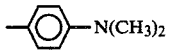 |
| 197 | 0 | 3- | H | 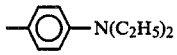 |
| 198 | 0 | 4- | $CH_3$ | 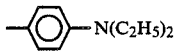 |
| 199 | 0 | 4- | 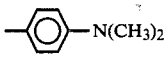 | 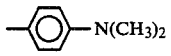 |
| 200 | 0 | 4- | H | 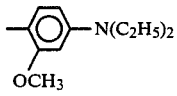 |

TABLE 10-continued
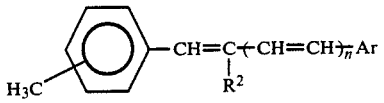
| Stilbene Derivative No. | n | Substituted Position | R | Ar |
|---|---|---|---|---|
| 201 | 1 | 4- | H | 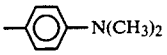 |
| 202 | 1 | 4- | H | 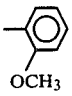 |
| 203 | 1 | 3- | H | 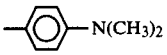 |
| 204 | 1 | 2- | H | 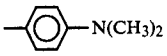 |
| 205 | 0 | 4- | H | 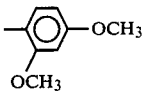 |
| 206 | 0 | 4- | H | 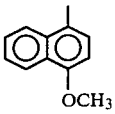 |
| 207 | 0 | 4- | H | 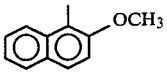 |
| 208 | 0 | 4- | H | 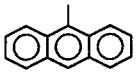 |
| 209 | 0 | 4- | H | 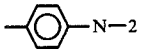 |
| 210 | 0 | 4- | H | 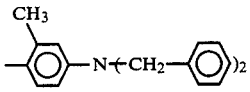 |
| 211 | 0 | 4- | H | 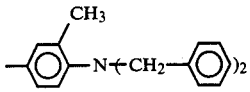 |
| 212 | 0 | 4- | H | 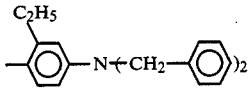 |
| 213 | 0 | 4- | H | 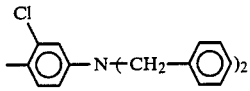 |

TABLE 10-continued
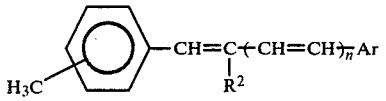
| Stilbene Derivative No. | n | Substituted Position | R | Ar |
|---|---|---|---|---|
| 214 | 0 | 4- | H | 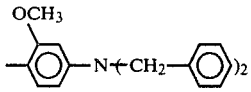 |
| 215 | 0 | 4- | H | 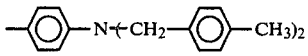 |
| 216 | 0 | 4- | H | 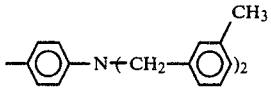 |
| 217 | 0 | 4- | H | 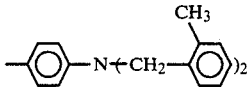 |
| 218 | 0 | 4- | H | 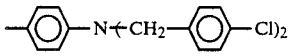 |
| 219 | 0 | 4- | H | 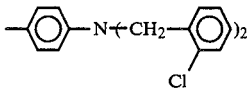 |
| 220 | 0 | 4- | H | 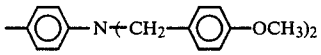 |
| 221 | | 3- | H | 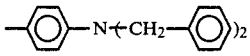 |
| 222 | 0 | 2- | H | 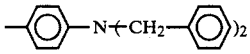 |
| 223 | 0 | 4- | H | 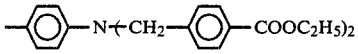 |
| 224 | 0 | 4- | H | 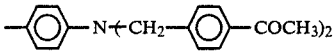 |
| 225 | 0 | 4- | H | 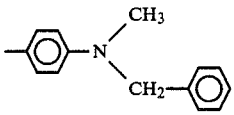 |
| 226 | 0 | 4- | H | 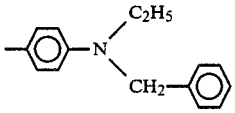 |
| 227 | 0 | 4- | H | 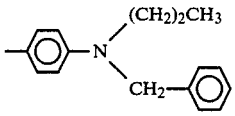 |

TABLE 10-continued
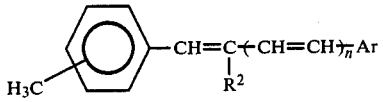
| Stilbene Derivative No. | n | Substituted Position (H3C) | R | Ar |
|---|---|---|---|---|
| 228 | 0 | 4- | H | 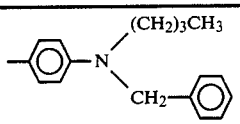 |
| 229 | 0 | 4- | H | 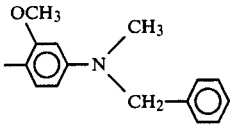 |
| 230 | 0 | 4- | H | 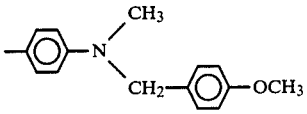 |
| 231 | 0 | 4- | H | 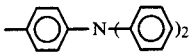 |
| 232 | 0 | 3- | H | 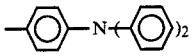 |
| 233 | 0 | 3- | H | 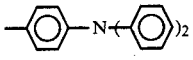 |
| 234 | 0 | 4- | H | 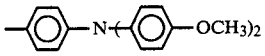 |
| 235 | 0 | 3- | H | 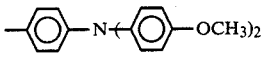 |
| 236 | 0 | 2- | H | 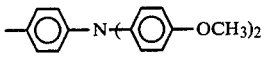 |
| 237 | 0 | 4- | H | 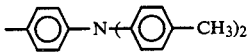 |
| 238 | 0 | 3- | H | 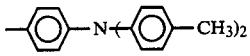 |
| 239 | 0 | 2- | H | 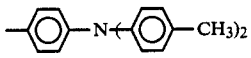 |
| 240 | 0 | 4- | H | 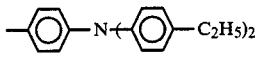 |
| 241 | 0 | 4- | H | 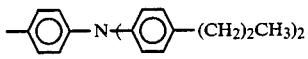 |
| 242 | 0 | 4- | H | 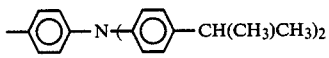 |

TABLE 10-continued
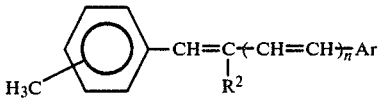
| Stilbene Derivative No. | n | Substituted Position 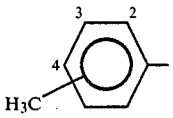 | R | Ar |
|---|---|---|---|---|
| 243 | 0 | 4- | H | 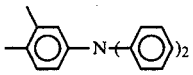 |
| 244 | 0 | 4- | H | 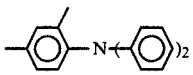 |
| 245 | 0 | 4- | H | 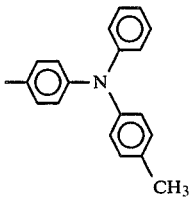 |
| 246 | 0 | 4- | H | 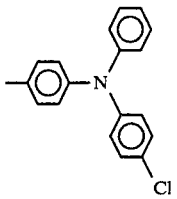 |
| 247 | 0 | 4- | H | 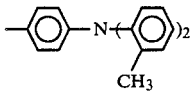 |
| 248 | 0 | 3- | H | 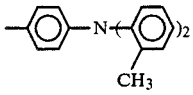 |
| 249 | 0 | 2- | H | 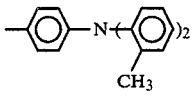 |
| 250 | 0 | 3- | H | 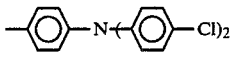 |
| 251 | 0 | 4- | H | 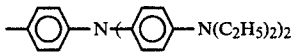 |
| 252 | 0 | 4- | H | 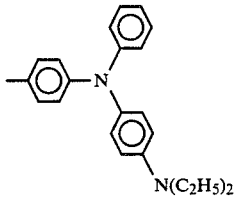 |

TABLE 10-continued
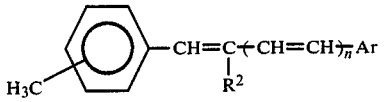
| Stilbene Derivative No. | n | Substituted Position 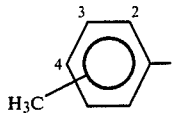 | R | Ar |
|---|---|---|---|---|
| 253 | 0 | 4- | H | 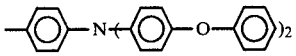 |
| 254 | 0 | 3- | H | 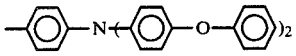 |
| 255 | 0 | 4- | H | 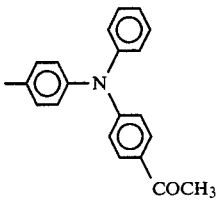 |
| 256 | 0 | 4- | H | 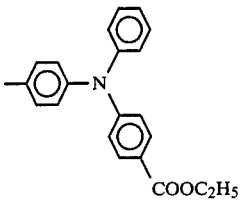 |
| 257 | 0 | 4- | H | 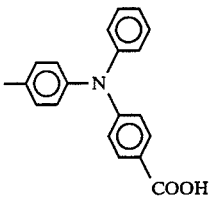 |
| 258 | 0 | 4- | H | 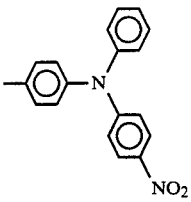 |
| 259 | 0 | 4- | H | 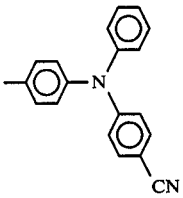 |

TABLE 10-continued
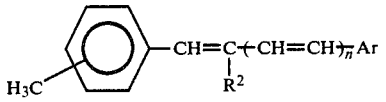
| Stilbene Derivative No. | n | Substituted Position 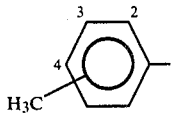 | R | Ar |
|---|---|---|---|---|
| 260 | 0 | 4- | H | 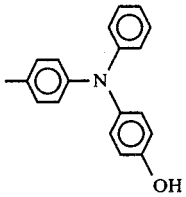 |
| 261 | 0 | 4- | H | 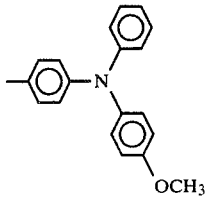 |
| 262 | 0 | 4- | H | 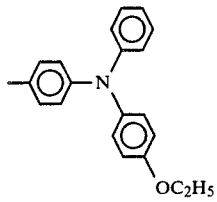 |
| 263 | 0 | 4- | H | 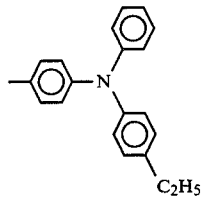 |
| 264 | 0 | 4- | H | 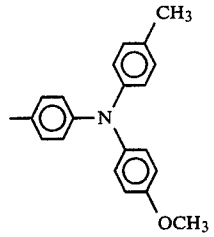 |
| 265 | 0 | 4- | H | 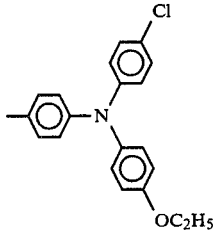 |

TABLE 10-continued
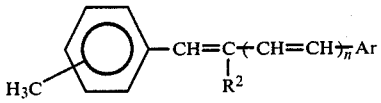
| Stilbene Derivative No. | n | Substituted Position | R | Ar |
|---|---|---|---|---|
| 266 | 0 | 4- | H | 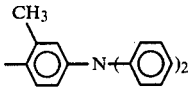 |
| 267 | 0 | 3- | H | 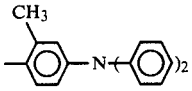 |
| 268 | 0 | 2- | H | 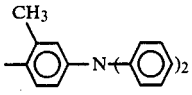 |
| 269 | 0 | 4- | H | 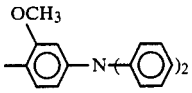 |
| 270 | 0 | 4- | H | 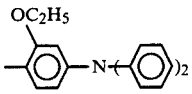 |
| 271 | 0 | 4- | H | 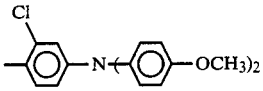 |
| 272 | 0 | 3- | H | 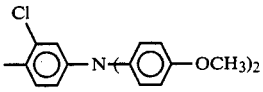 |
| 273 | 0 | 2- | H | 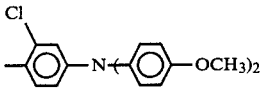 |
| 274 | 0 | 4- | H | 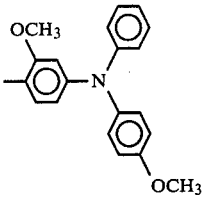 |
| 275 | 0 | 4- | H | 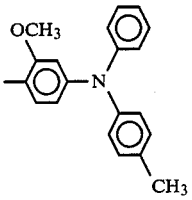 |

TABLE 10-continued
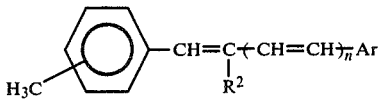
| Stilbene Derivative No. | n | Substituted Position 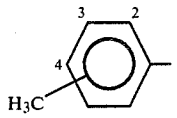 | R | Ar |
|---|---|---|---|---|
| 276 | 0 | 4- | H | 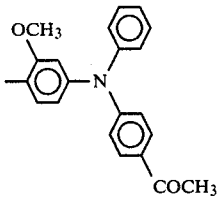 |
| 277 | 0 | 4- | H | 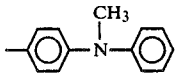 |
| 278 | 0 | 4- | H | 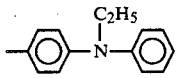 |
| 279 | 0 | 3- | H | 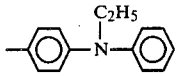 |
| 280 | 0 | 2- | H | 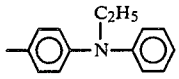 |
| 281 | 0 | 4- | H | 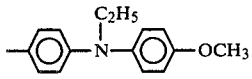 |
| 282 | 0 | 4- | H | 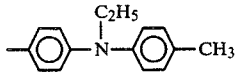 |
| 283 | 0 | 4- | H | 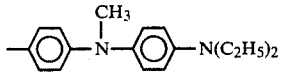 |
| 284 | 0 | 4- | H | 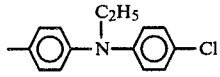 |
| 285 | 0 | 4- | H | 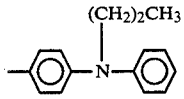 |
| 286 | 0 | 4- | H | 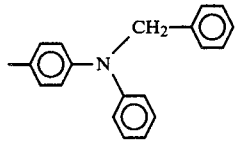 |
| 287 | 0 | 3- | H | 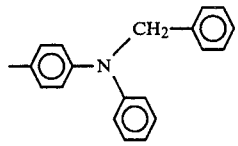 |

TABLE 10-continued
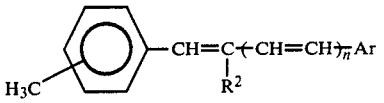
| Stilbene Derivative No. | n | Substituted Position | R | Ar |
|---|---|---|---|---|
| 288 | 0 | 2- | H | 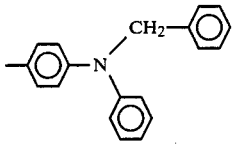 |
| 289 | 0 | 4- | H | 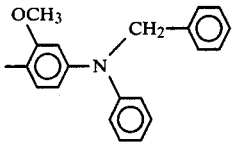 |
| 290 | 0 | 4- | H | 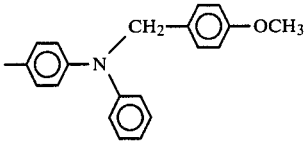 |
| 291 | 0 | 4- | H | 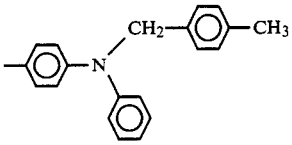 |
| 292 | 0 | 4- | H | 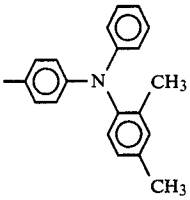 |
| 293 | 0 | 3- | H | 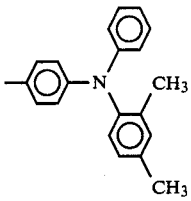 |
| 294 | 0 | 2- | H | 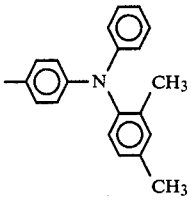 |

TABLE 10-continued
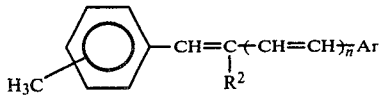
| Stilbene Derivative No. | n | Substituted Position (H3C) | R | Ar |
|---|---|---|---|---|
| 295 | 0 | 4- | H | 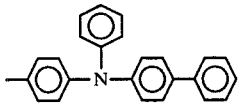 |
| 296 | 0 | 3- | H | 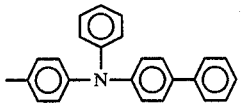 |
| 297 | 0 | 2- | H | 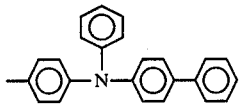 |
| 298 | 0 | 4- | H | 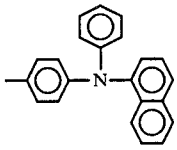 |
| 299 | 0 | 3- | H | 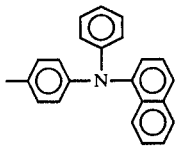 |
| 300 | 0 | 2- | H | 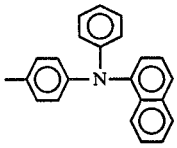 |
| 301 | 0 | 4- | H | 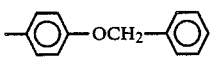 |
| 302 | 0 | 3- | H | 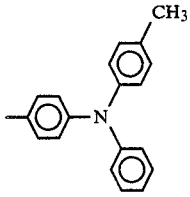 |

TABLE 10-continued

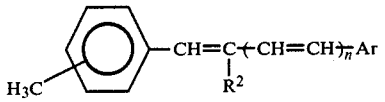

| Stilbene Derivative No. | n | Substituted Position $H_3C$ | R | Ar |
|---|---|---|---|---|
| 303 | 0 | 2- | H | 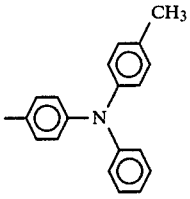 |
| 304 | 0 | 2- | H | 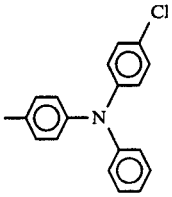 |
| 305 | 0 | 3- | H | 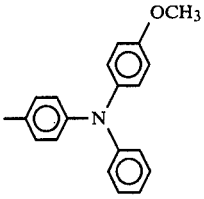 |
| 306 | 0 | 2- | H | 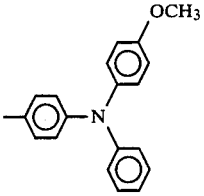 |

The above listed stilbene derivatives can be used in the electrophotographic photoconductors with the structures as shown in FIGS. 1, 2 and 3 according to the present invention.

The following are embodiments of such electrophotographic photoconductors using the stilbene derivatives.

EXAMPLE P-31

The following components were ground and dispersed in a ball mill to prepare a charge generating layer formation liquid:

| | Parts by Weight |
|---|---|
| Diane Blue (C.I. Pigment Blue 25, C.I. 21180, a charge generating pigment of the following formula (CG-1)) | 76 |
| 2% tetrahydrofuran solution of a polyester resin (Vylon 200 made by Toyobo Co., Ltd.) | 1,260 |
| Tetrahydrofuran | 3,700 |

-continued

| | Parts by Weight |
|---|---|
| 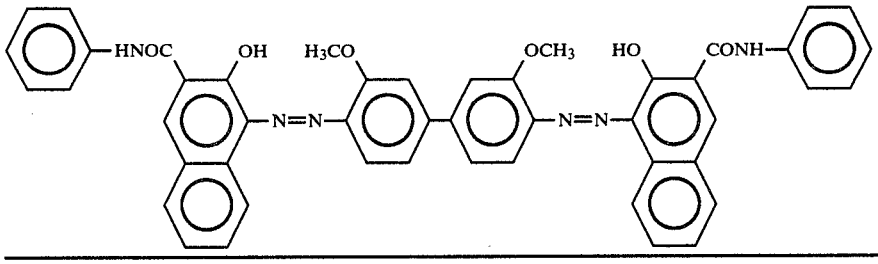 (CG-1) | |

The thus prepared charge generating layer formation liquid was applied by a doctor blade to the aluminum-evaporated surface of an aluminum-evaporated polyester base film, which served as an electroconductive support material, so that a charge generating layer, with a thickness of about 1 μm, when dried at room temperature, was formed on the electroconductive support material.

Then the following components were mixed and dissolved, whereby a charge transporting layer formation liquid was prepared:

| | Parts by Weight |
|---|---|
| Stilbene Derivative No. 232 in Table 10 | 2 |
| Polycarbonate resin (Panlite K 1300 made by Teijin Limited.) | 2 |
| Tetrahydrofuran | 16 |

The thus prepared charge transporting layer formation liquid was applied to the aforementioned charge generating layer by a doctor blade and was dried at 80° C. for 2 minutes and then at 105° C. for 5 minutes, so that a charge transporting layer with a thickness of about 20 μm was formed on the charge generating layer; thus, an electrophotographic photoconductor No. 31 according to the present invention was prepared.

The electrophotographic photoconductor No. 31 was charged negatively in the dark under application of −6 kV of corona charge for 20 seconds and was then allowed to stand in the dark for 20 seconds without applying any charge thereto. At this moment, the surface potential Vpo (V) of the photoconductor was measured by a Paper Analyzer (Kawaguchi Electro Works, Model SP-428). The photoconductor was then illuminated by a tungsten lamp in such a manner that the illuminance on the illuminated surface of the photoconductor was 20 lux, and the exposure $E_{\frac{1}{2}}$ (lux·seconds) required to reduce the initial surface potential Vpo (V) to ½ the initial surface potential Vpo (V) was measured. The results showed that Vpo (V)=−1210 V and $E_{\frac{1}{2}}$=2.6 lux·seconds.

EXAMPLES P-32 THROUGH P-77

Example P-31 was repeated except that the charge generating material and the charge transporting material (Stilbene Derivative No. 232 in Table 10) employed in Example 31 were respectively replaced by the charge generating materials and the charge transporting materials (stilbene derivatives) listed in Table 11, whereby electrophotographic photoconductors No. 32 through No. 77 according to the present invention were prepared.

$V_{po}$ and $E_{178}$ of each electrophotographic photoconductor are also shown in Table 12.

TABLE 11

| Example No. and Photoconductor No. | Charge Generating Material | Charge Transporting Material Stilbene Derivative No. in Table 10 |
|---|---|---|
| 31 | 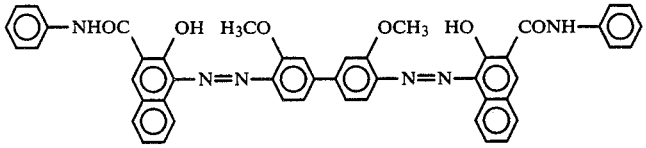 (CG-1) | 232 |
| 32 | 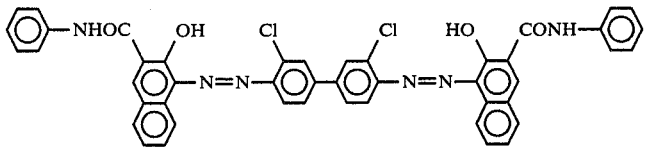 (CG-2) | 232 |

TABLE 11-continued
| Example No. and Photo-conductor No. | Charge Generating Material | Charge Transporting Material Stilbene Derivative No. in Table 10 |
|---|---|---|
| 33 | 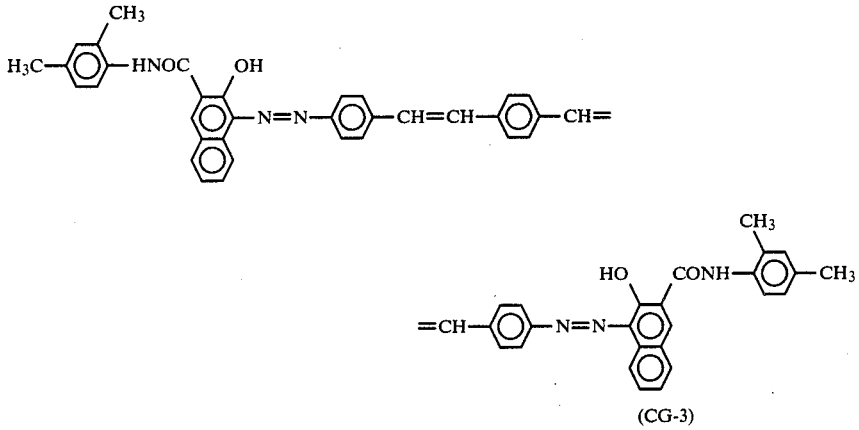 (CG-3) | 232 |
| 34 | 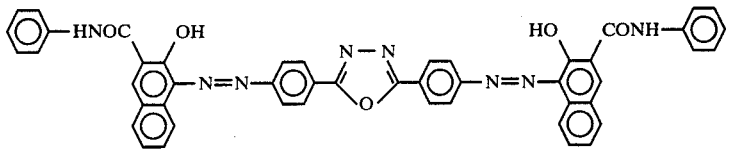 (CG-4) | 232 |
| 35 | 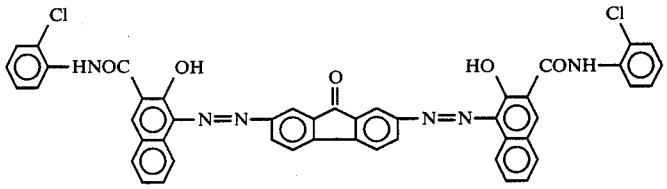 (CG-5) | 232 |
| 36 | 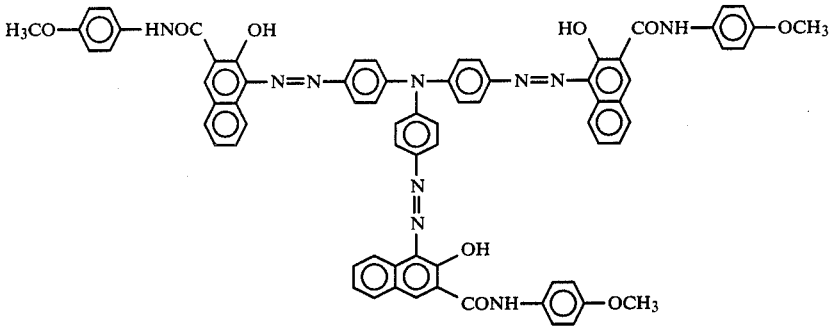 (CG-6) | 232 |
| 37 | β-Type Copper Phthalocyanine | 232 |
| 38 | 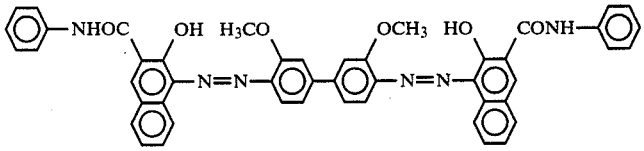 (CG-1) | 231 |

TABLE 11-continued
| Example No. and Photo-conductor No. | Charge Generating Material | Charge Transporting Material Stilbene Derivative No. in Table 10 |
|---|---|---|
| 39 | 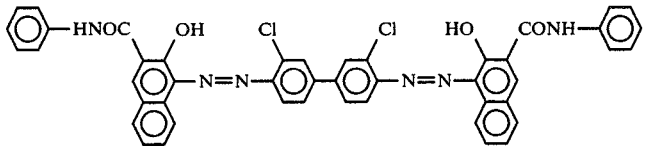 (CG-2) | 231 |
| 40 | 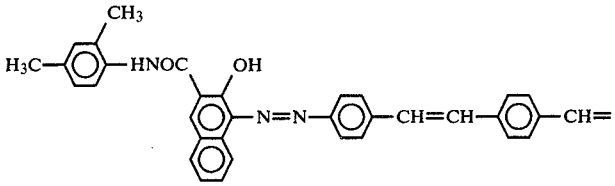 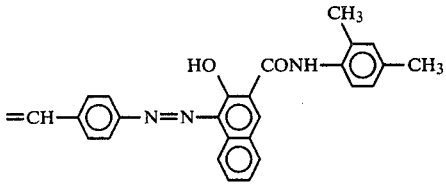 (CG-3) | 231 |
| 41 | 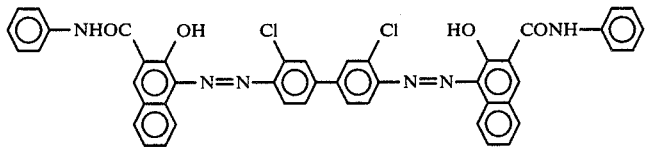 (CG-5) | 231 |
| 42 | 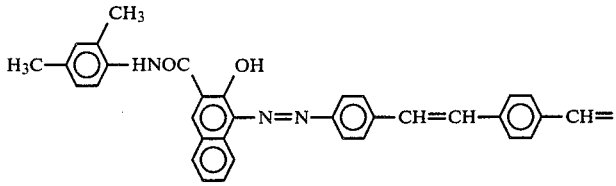 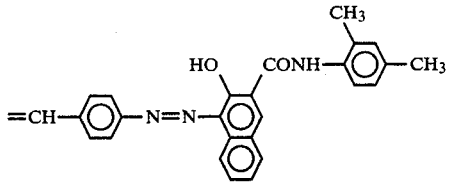 (CG-3) | 233 |
| 43 | 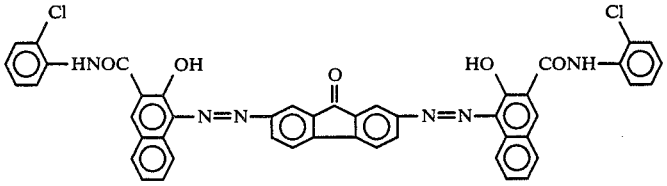 (CG-5) | 233 |

TABLE 11-continued
| Example No. and Photo-conductor No. | Charge Generating Material | Charge Transporting Material Stilbene Derivative No. in Table 10 |
|---|---|---|
| 44 | 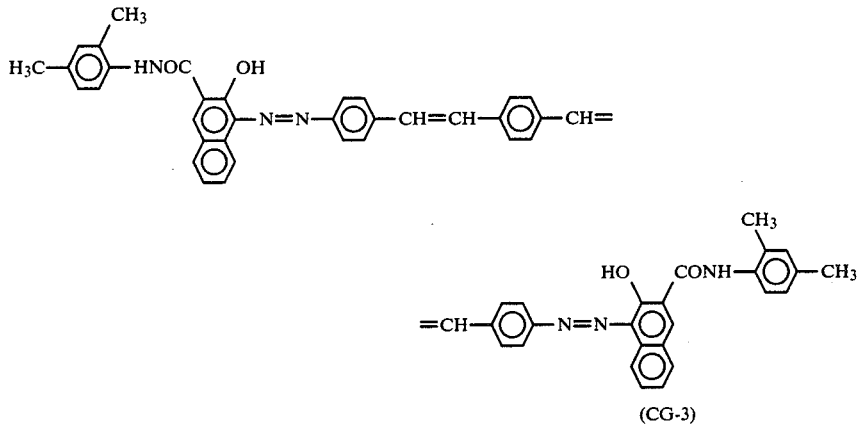 (CG-3) | 209 |
| 45 | 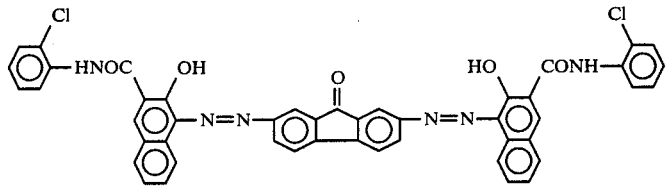 (CG-5) | 209 |
| 46 | 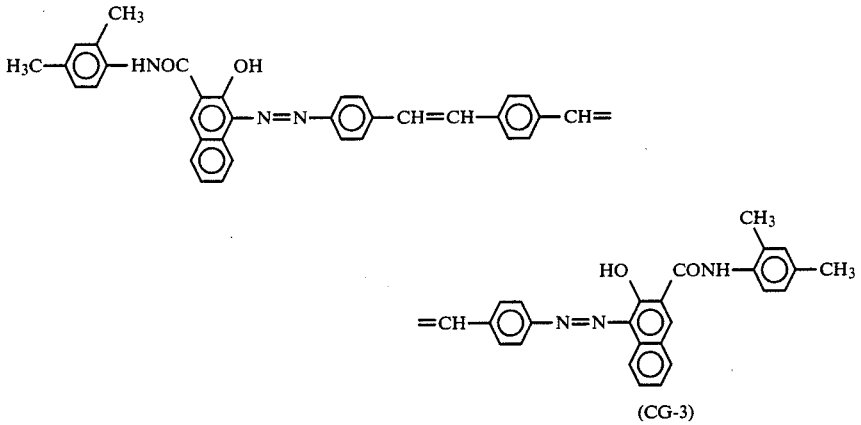 (CG-3) | 278 |
| 47 | 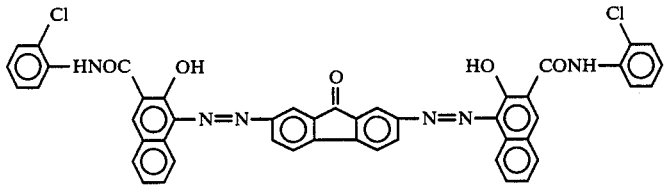 (CG-5) | 278 |
| 48 | 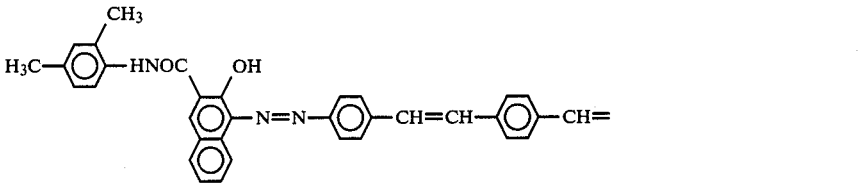 | 286 |

TABLE 11-continued
| Example No. and Photo-conductor No. | Charge Generating Material | Charge Transporting Material Stilbene Derivative No. in Table 10 |
|---|---|---|
| | 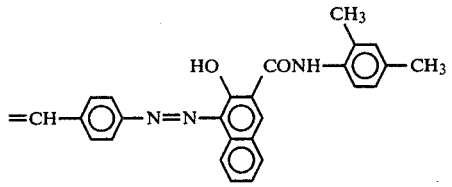 (CG-3) | |
| 49 | 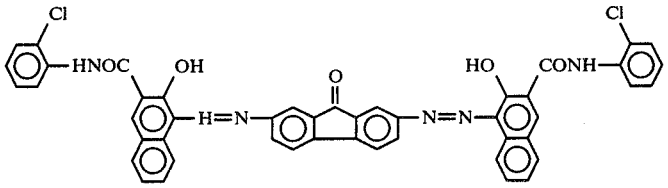 (CG-5) | 286 |
| 50 | 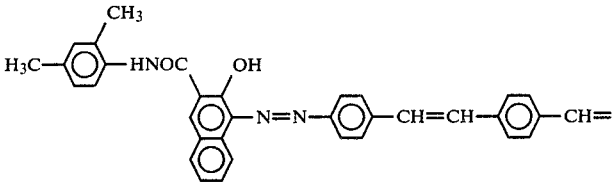 | 277 |
| | 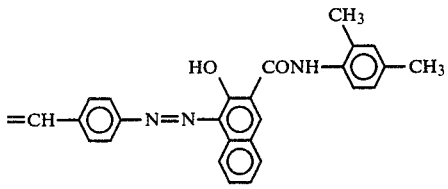 (CG-3) | |
| 51 | 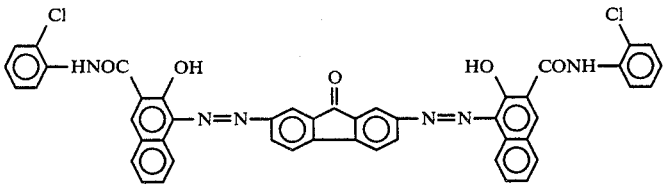 (CG-5) | 277 |
| 52 | 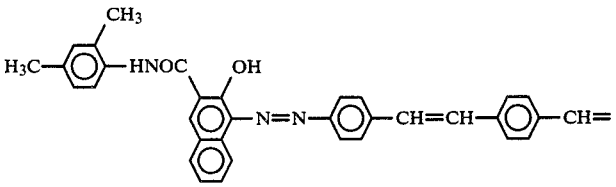 | 194 |
| | 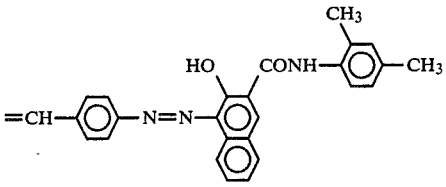 (CG-3) | |

TABLE 11-continued
| Example No. and Photo-conductor No. | Charge Generating Material | Charge Transporting Material Stilbene Derivative No. in Table 10 |
|---|---|---|
| 53 | 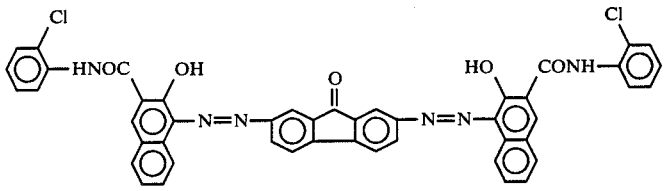 (CG-5) | 194 |
| 54 | 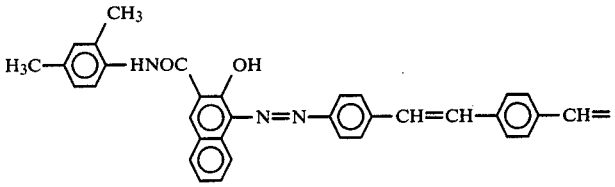 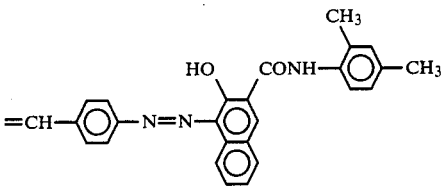 (CG-3) | 202 |
| 55 | 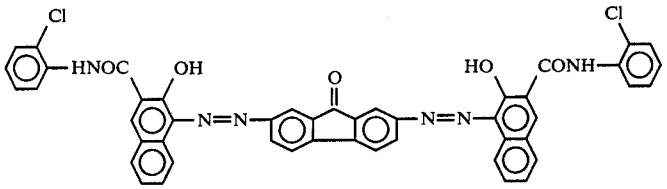 (CG-5) | 202 |
| 56 | 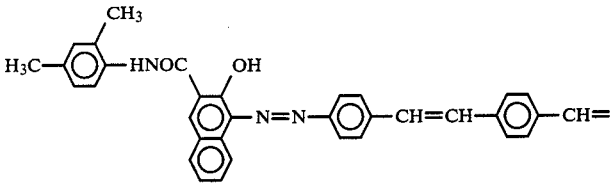 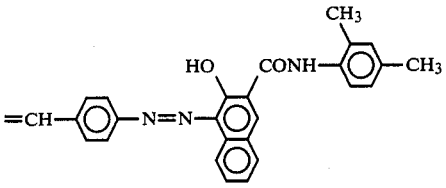 (CG-3) | 206 |

TABLE 11-continued
| Example No. and Photo-conductor No. | Charge Generating Material | Charge Transporting Material Stilbene Derivative No. in Table 10 |
|---|---|---|
| 57 | 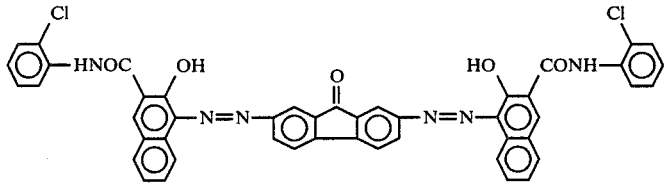 (CG-5) | 206 |
| 58 | 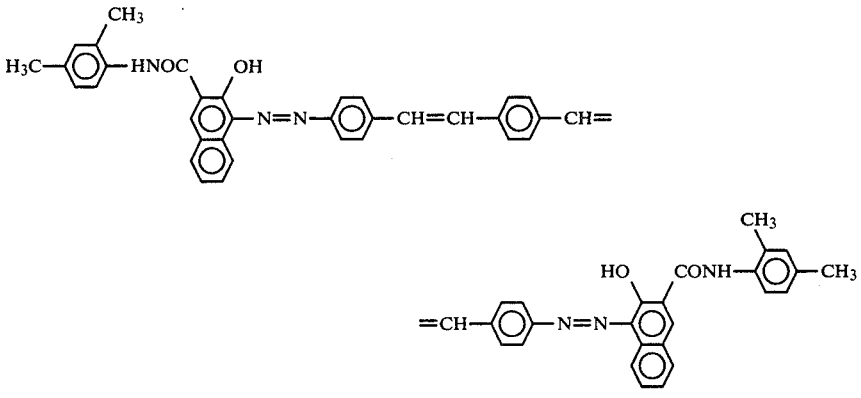 (CG-3) | 238 |
| 59 | 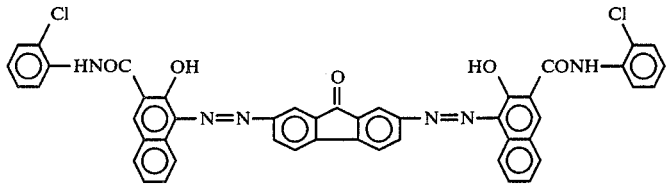 (CG-5) | 238 |
| 60 | 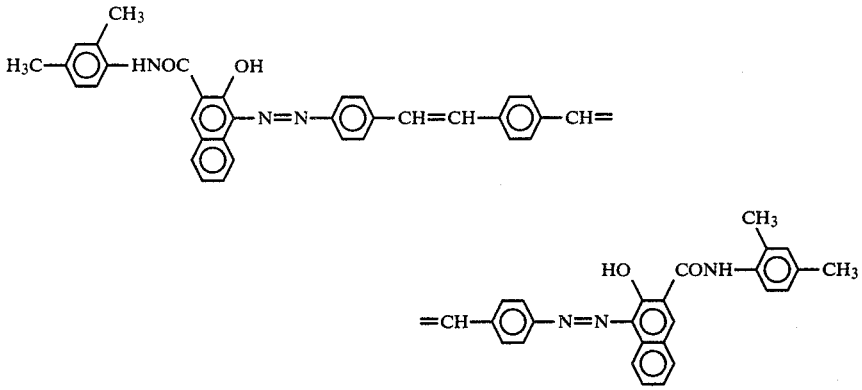 (CG-3) | 238 |
| 61 | 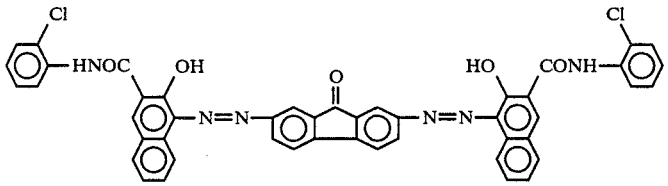 (CG-5) | 238 |

TABLE 11-continued
| Example No. and Photo-conductor No. | Charge Generating Material | Charge Transporting Material Stilbene Derivative No. in Table 10 |
|---|---|---|
| 62 | 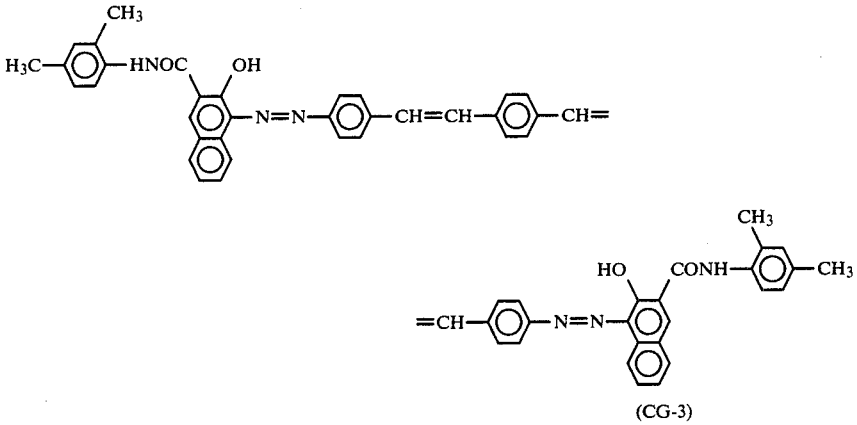 (CG-3) | 245 |
| 63 | 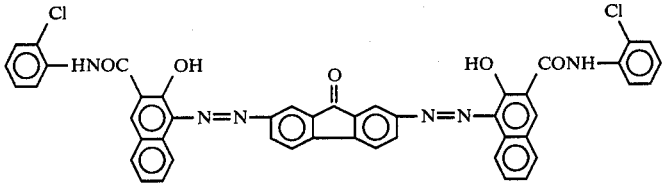 (CG-5) | 245 |
| 64 | 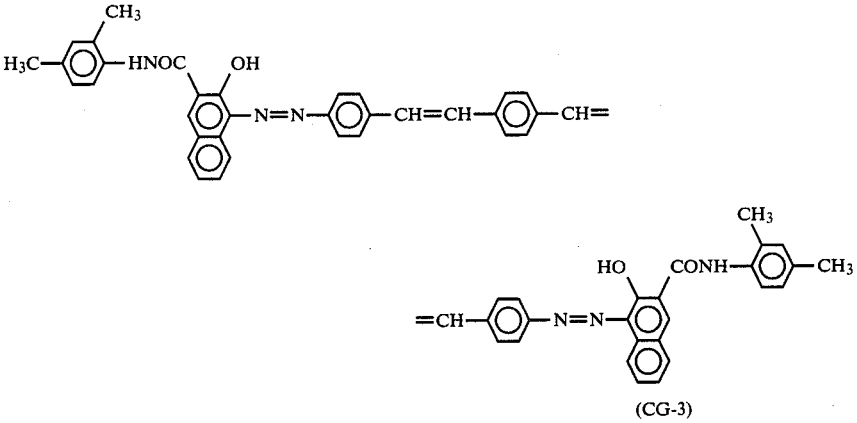 (CG-3) | 302 |
| 65 | 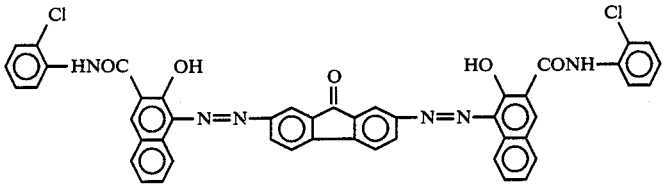 (CG-5) | 302 |
| 66 | 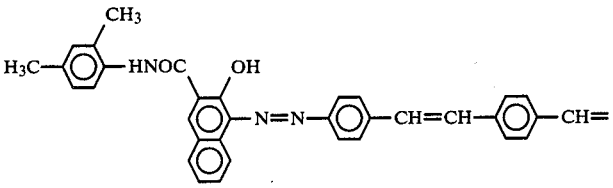 | 303 |

TABLE 11-continued
| Example No. and Photo-conductor No. | Charge Generating Material | Charge Transporting Material Stilbene Derivative No. in Table 10 |
|---|---|---|
| | 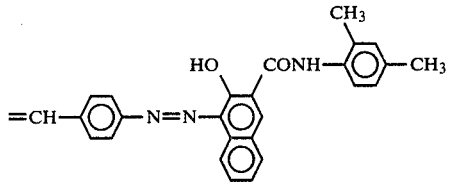 (CG-3) | |
| 67 | 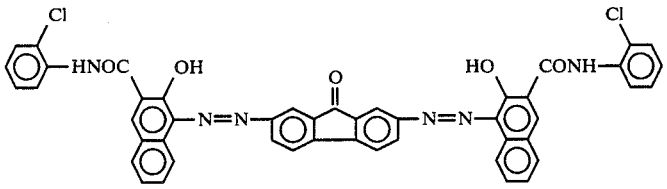 (CG-5) | 303 |
| 68 | 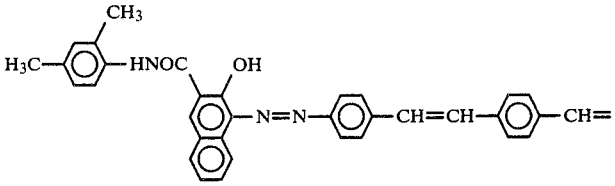 | 246 |
| | 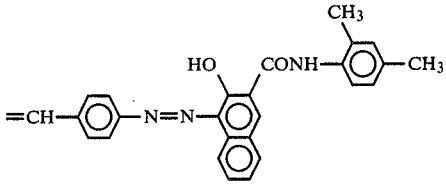 (CG-3) | |
| 69 | 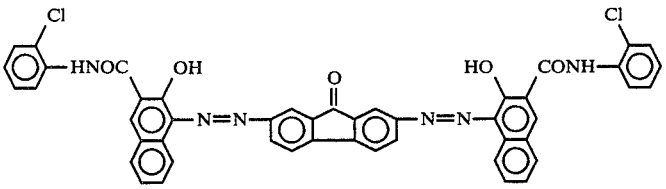 (CG-5) | 246 |
| 70 | 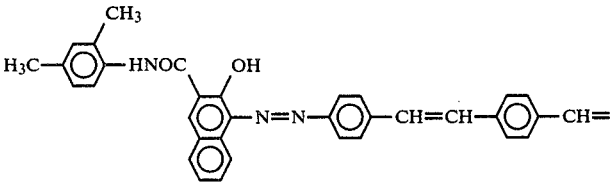 | 304 |

TABLE 11-continued
| Example No. and Photo-conductor No. | Charge Generating Material | Charge Transporting Material Stilbene Derivative No. in Table 10 |
|---|---|---|
| | 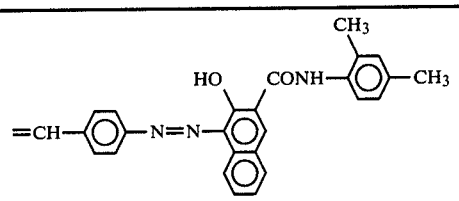 (CG-3) | |
| 71 | 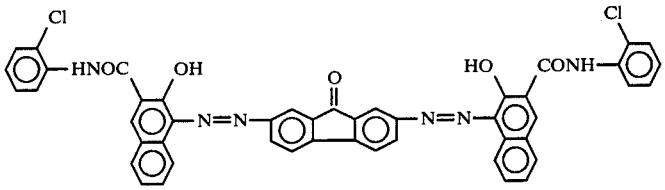 (CG-5) | 304 |
| 72 | 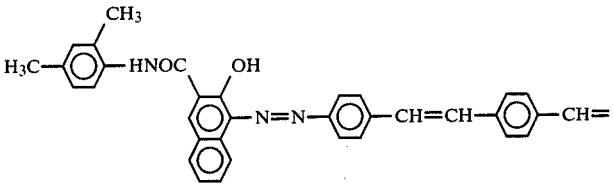 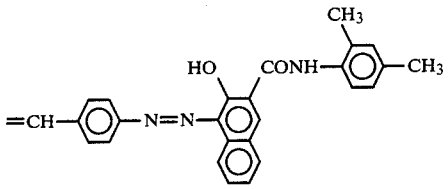 (CG-3) | 261 |
| 73 | 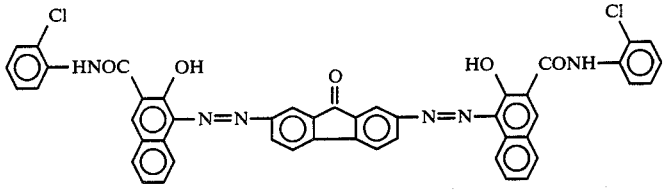 (CG-5) | 261 |
| 74 | 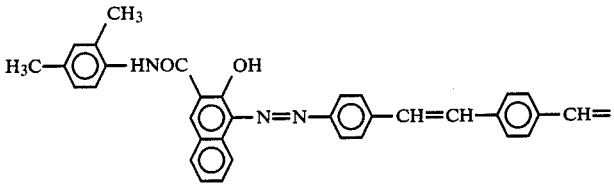 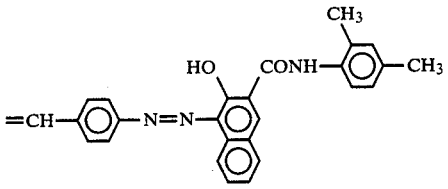 (CG-3) | 305 |

TABLE 11-continued

| Example No. and Photo-conductor No. | Charge Generating Material | Charge Transporting Material Stilbene Derivative No. in Table 10 |
|---|---|---|
| 75 | 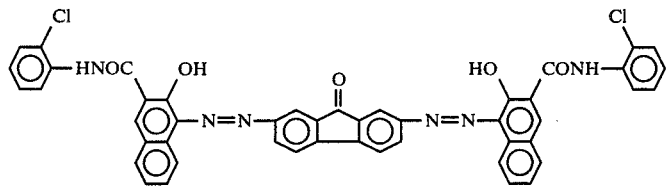 (CG-5) | 305 |
| 76 | 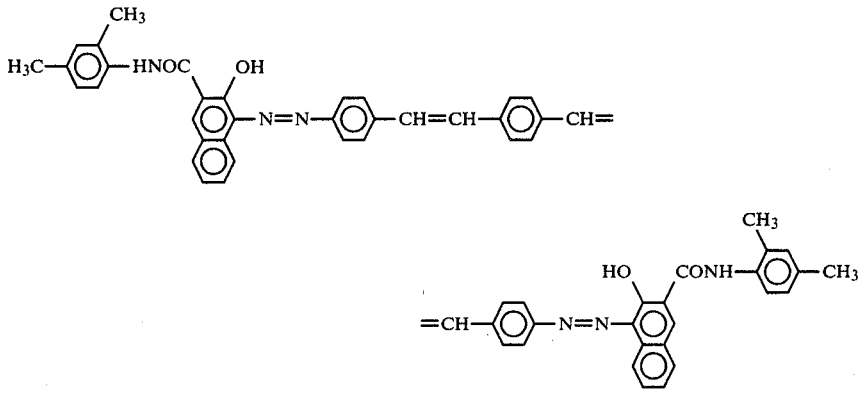 (CG-3) | 306 |
| 77 | 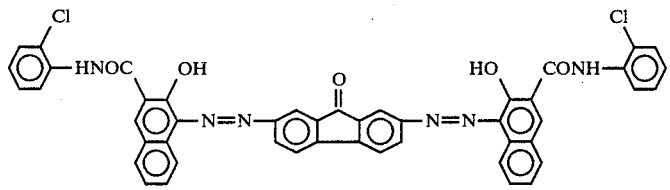 (CG-5) | 306 |

EXAMPLE P-78

Selenium was vacuum-evaporated with a thickness of approximately 1.0 μm on an approximately 300 μm thick aluminum plate so that a charge generating layer was formed on the aluminum plate.

A charge transporting layer liquid was prepared by mixing and dispersing the following components:

| | Parts by Weight |
|---|---|
| Stilbene derivative No. 232 in Table 10 | 2 |
| Polyester resin (Polyester Adhesive 49000 made by Du Pont Co.) | 3 |
| Tetrahydrofuran | 45 |

The thus prepared charge transporting layer liquid was applied to the aforementioned selenium charge generating layer by a doctor blade, dried at room temperature and then dried under reduced pressure, so that a charge transporting layer about 10 μm thick was formed on the charge generating layer; thus, an electrophotographic photoconductor No. 78 according to the present invention was prepared.

Vpo and $E_{178}$ were measured. The results showed that Vpo = −1220 V and $E_{\frac{1}{2}}$ = 2.6 lux·seconds.

EXAMPLE P-79

A perylene pigment C.I. Vat Red 23 (C.I. 71130) employed in Example P-29 was vacuum-evaporated with a thickness of about 0.3 μm on an approximately 300 μm thick aluminum plate so that a charge generating layer was formed.

A charge transporting layer liquid was prepared by mixing and dispersing the following components:

| | Parts by Weight |
|---|---|
| Stilbene derivative No. 231 in Table 10 | 2 |
| Polyester resin (Polyester Adhesive 49000 made by Du Pont Co.) | 3 |
| Tetrahydrofuran | 45 |

The thus prepared charge transporting layer liquid was applied to the aforementioned selenium charge generating layer by a doctor blade, dried at room temperature and then dried under reduced pressure, whereby a charge transporting layer about 10 μm thick was formed on the charge generating layer; thus, an electrophotographic photoconductor No. 79 according to the present invention was prepared.

Vpo and $E_{\frac{1}{2}}$ were measured. The results showed that Vpo = −1310 V and $E_{\frac{1}{2}}$ = 4.1 lux·seconds.

EXAMPLE P-80

One part by weight of Diane Blue (C.I. Pigment Blue 25, C.I. 21180) which was the same as that employed in Example P-31 was added to 158 parts by weight of tetrahydrofuran, and the mixture was ground and dispersed in a ball mill. To this mixture, 12 parts by weight of Stilbene Derivative No. 232 and 18 parts by weight of a polyester resin (Polyester Adhesive 49000 made by Du Pont Co.) were added and mixed, whereby a photosensitive layer formation liquid was prepared.

The thus prepared photosensitive layer formation liquid was applied to an aluminum-evaporated polyester film by a doctor blade and was dried at 100° C. for 30 minutes, so that a photosensitive layer with a thickness of about 16 μm was formed on the aluminum-evaporated polyester film, thus, an electrophotographic photoconductor No. 80 according to the present invention was prepared.

The electrophotographic photoconductor No. 80 was charged positively in the dark under application of +6 KV of corona charge for 20 seconds and was then allowed to stand in the dark for 20 seconds without applying any charge thereto. At this moment, the surface potential Vpo (V) of the photoconductor was measured by a Paper Analyzer (Kawaguchi Electro Works, Model SP-428). The photoconductor was then illuminated by a tungsten lamp in such a manner that the illuminance on the illuminated surface of the photoconductor was 20 lux, so that the exposure $E_{\frac{1}{2}}$(lux·seconds) required to reduce the initial surface potential Vpo (V) to ½ the initial surface potential Vpo (V) was measured. The results showed that Vpo (V) = +1100 V and $E_{\frac{1}{2}}$ = 2.3 lux·seconds.

The charge generating material, the charge transporting material, $V_{po}$ and $E_{178}$ of each of the electrophotographic photoconductors No. 31 through No. 80 are summarized in the following Table 12:

TABLE 12

| Photo-Conductor | Charge Generating Material | Charge Transporting Material (Stilbene Derivative) | $V_{po}$ (V) | $E_{\frac{1}{2}}$ (lux · seconds) |
|---|---|---|---|---|
| No. 31 | CG-1 | No. 232 | −1210 | 2.6 |
| No. 32 | CG-2 | No. 232 | −990 | 2.1 |
| No. 33 | CG-3 | No. 232 | −1210 | 1.1 |
| No. 34 | CG-4 | No. 232 | −1320 | 4.0 |
| No. 35 | CG-5 | No. 232 | −940 | 0.9 |
| No. 36 | CG-6 | No. 232 | −1050 | 1.0 |
| No. 37 | β-type Copper Phthalocyanine | No. 232 | −990 | 2.7 |
| No. 38 | CG-1 | No. 231 | −1250 | 2.8 |
| No. 39 | CG-2 | No. 231 | −1000 | 2.6 |
| No. 40 | CG-3 | No. 231 | −1300 | 1.2 |
| No. 41 | CG-5 | No. 231 | −1185 | 1.1 |
| No. 42 | CG-3 | No. 233 | −1290 | 1.3 |
| No. 43 | CG-5 | No. 233 | −970 | 1.2 |
| No. 44 | CG-3 | No. 209 | −1330 | 1.3 |
| No. 45 | CG-5 | No. 209 | −1115 | 1.1 |
| No. 46 | CG-3 | No. 278 | −1420 | 1.5 |
| No. 47 | CG-5 | No. 278 | −1080 | 1.3 |
| No. 48 | CG-3 | No. 286 | −1400 | 1.6 |
| No. 49 | CG-5 | No. 286 | −1240 | 1.4 |
| No. 50 | CG-3 | No. 277 | −970 | 2.1 |
| No. 51 | CG-5 | No. 277 | −580 | 1.6 |
| No. 52 | CG-3 | No. 194 | −1495 | 2.4 |

TABLE 12-continued

| Photo-Conductor | Charge Generating Material | Charge Transporting Material (Stilbene Derivative) | $V_{po}$ (V) | $E_{\frac{1}{2}}$ (lux · seconds) |
|---|---|---|---|---|
| No. 53 | CG-5 | No. 194 | −1090 | 2.0 |
| No. 54 | CG-3 | No. 202 | −1480 | 1.6 |
| No. 55 | CG-5 | No. 202 | −1300 | 2.1 |
| No. 56 | CG-3 | No. 206 | −1410 | 1.4 |
| No. 57 | CG-5 | No. 206 | −1160 | 1.6 |
| No. 58 | CG-3 | No. 238 | −1130 | 1.0 |
| No. 59 | CG-5 | No. 238 | −890 | 0.7 |
| No. 60 | CG-3 | No. 238 | −1130 | 1.0 |
| No. 61 | CG-5 | No. 238 | −930 | 0.8 |
| No. 62 | CG-3 | No. 245 | −1300 | 1.1 |
| No. 63 | CG-5 | No. 245 | −780 | 0.7 |
| No. 64 | CG-3 | No. 302 | −1260 | 1.1 |
| No. 65 | CG-5 | No. 302 | −830 | 0.7 |
| No. 66 | CG-3 | No. 303 | −1310 | 1.2 |
| No. 67 | CG-2 | No. 303 | −880 | 0.8 |
| No. 68 | CG-3 | No. 246 | −1450 | 1.4 |
| No. 69 | CG-5 | No. 246 | −1070 | 1.4 |
| No. 70 | CG-3 | No. 304 | −1410 | 1.3 |
| No. 71 | CG-5 | No. 304 | −1140 | 1.3 |
| No. 72 | CG-3 | No. 261 | −310 | 1.2 |
| No. 73 | CG-5 | No. 261 | −740 | 0.7 |
| No. 74 | CG-3 | No. 305 | −470 | 1.3 |
| No. 75 | CG-5 | No. 305 | −660 | 0.7 |
| No. 76 | CG-3 | No. 306 | −550 | 0.8 |
| No. 77 | CG-5 | No. 306 | −720 | 0.7 |
| No. 78 | Se | No. 232 | −1220 | 2.6 |
| No. 79 | Perylene Pigment | No. 231 | −1310 | 4.1 |
| No. 80 | CG-1 | No. 232 | +1100 | 2.3 |

Each of the electrophotographic photoconductors prepared in Examples P-31 through P-79 was negatively charged, while the electrophotographic photoconductor prepared in Example P-80 was positively charged, by a commercially available copying machine, so that latent electrostatic images were formed on each photoconductor and were developed with a dry type developer. The developed images were transferred to a high quality transfer sheet and were fixed to the transfer sheet. As a result, clear images were obtained from each of the electrophotographic photoconductors.

When a wet type developer was used instead of the dry type developer, clear images were also obtained from each of the electrophotographic photoconductors.

Of the stilbene derivatives of the previously described formula (I), stilbene derivatives of the following formula (Ic) can be synthesized as follows. A phenyl derivative of the formula (IIc) is allowed to react with a carbonyl derivative of the formula (IIIc) under the same reaction conditions as in the case of the stilbene derivatives of the formula (I), using one of the previously described catalysts.

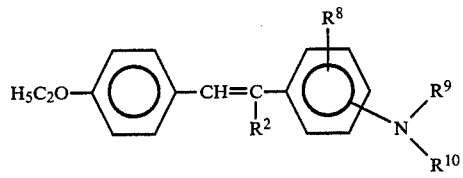

(Ic)

wherein $R^2$ is the same as that defined in the formula (I), $R^8$ represents hydrogen, an alkyl group, an alkoxy group or halogen, $R^9$ and $R^{10}$ each represent an alkyl group, an unsubstituted or substituted aralkyl group or an unsubstituted or substituted aryl group.

(IIc)

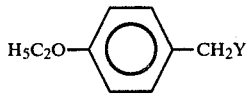

wherein Y represents a triphenylphosphonium group of the formula

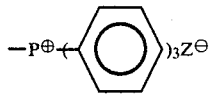

in which $Z^{\ominus}$ indicates a halogen ion, or a dialkoxyphosphorous group of the formula $-PO(OR)_2$ in which R indicates a lower alkyl group.

(IIIc)

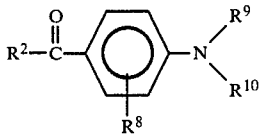

wherein $R^2$ represents hydrogen or an unsubstituted or substituted phenyl group, $R^8$ represents hydrogen, a lower alkyl group, a lower alkoxy group or halogen, $R^9$ and $R^{10}$ each represent a lower alkyl group, an unsubstituted or substituted benzyl group or an unsubstituted or substituted phenyl group.

Stilbene derivatives of the formula (Ic) can be prepared in the same manner as in the case of the previously described stilbene derivatives of the formula (Ia).

Specific examples of the preparation of stilbene derivatives of the formula (Ic) are as follows:

SYNTHESIS EXAMPLE 37 (SYNTHESIS OF STILBENE DERIVATIVE NO. 367 IN TABLE 15)

0.96 g of a 60% sodium hydride was dispersed in 20 ml of ethylene glycol dimethyl ether. To this mixture, there was added 5.44 g (0.020 mol) of diethyl p-ethoxybenzylphosphonate at room temperature. To this mixture, there was added a solution consisting of 5.47 g (0.020 mol) of 4-(N,N-diphenylamino) benzaldehyde and 25 ml of N,N-dimethylformamide, and the reaction mixture was stirred at room temperature for 6 hours. The reaction mixture was added to 300 ml of water. A yellow precipitate separated from the reaction mixture, which was separated by filtration, washed with water and dried. The yield was 6.53 g (83.4%). Upon recrystallization of the precipitate from cyclohexane, 4-ethoxy-4'-N,N-diphenylaminostilbene (Stilbene Derivative No. 367 in Table 15) was obtained in the form of light yellow needle-like crystals. The melting point of the thus obtained 4-ethoxy-4'-N,N-diphenylaminostilbene was at 168.5°–170.0° C.

The results of the elemental analysis of the thus obtained 4-ethoxy-4'-N,N-diphenylaminostilbene were as follows:

| | % C | % H | % N |
|---|---|---|---|
| Found | 85.90 | 6.44 | 3.58 |
| Calculated | 85.85 | 6.36 | 3.27 |

The above calculation was based on the formula for 4-ethoxy-4'-N,N-diphenylaminostilbene of $C_{28}H_{25}NO$.

Figure 7:
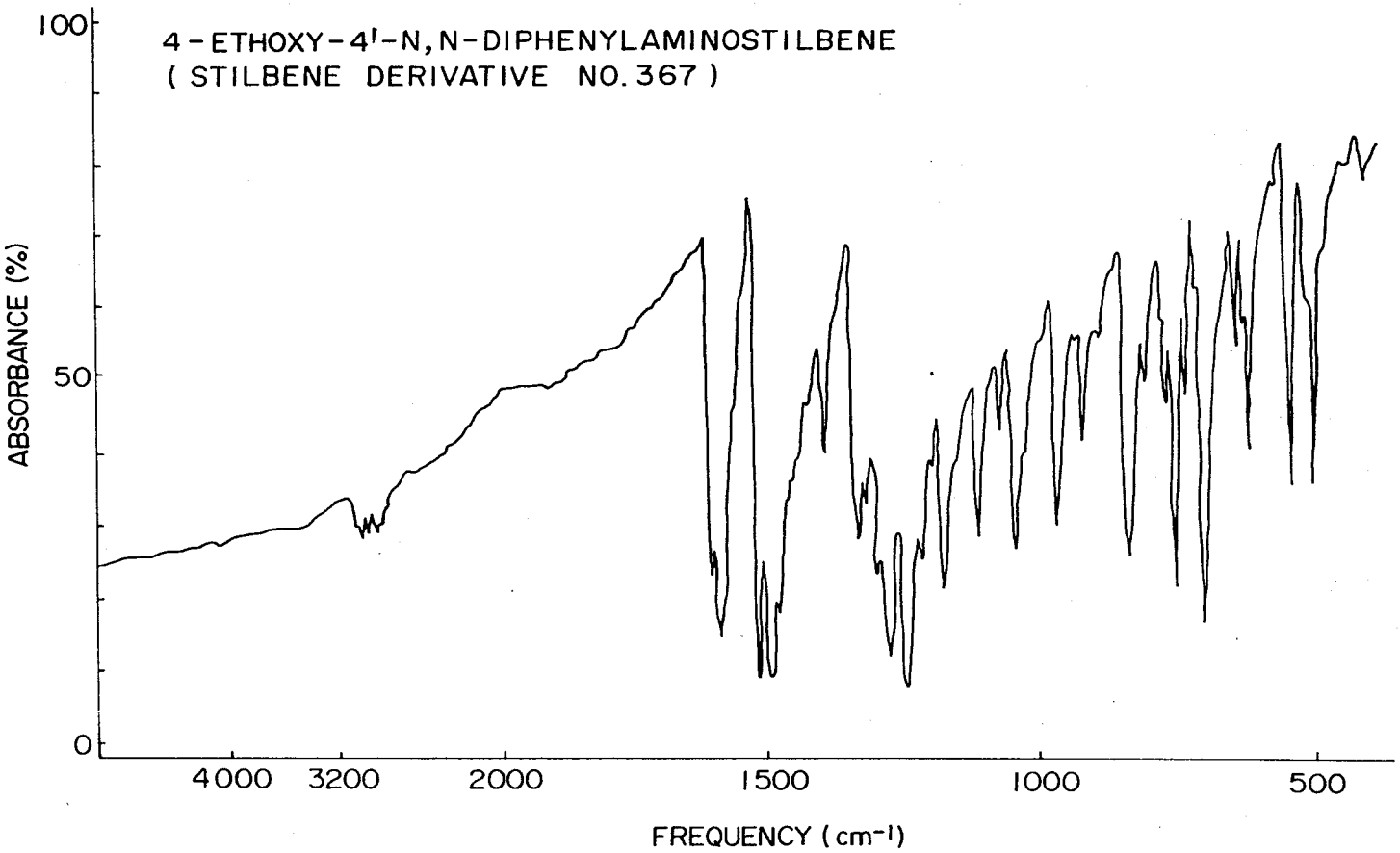
FIG. 7 is an infrared spectrum of 4-ethoxy-4'-N,N-diphenylaminostilbene, which is Stilbene Derivative No. 367 in Table 15.
Figure 8:
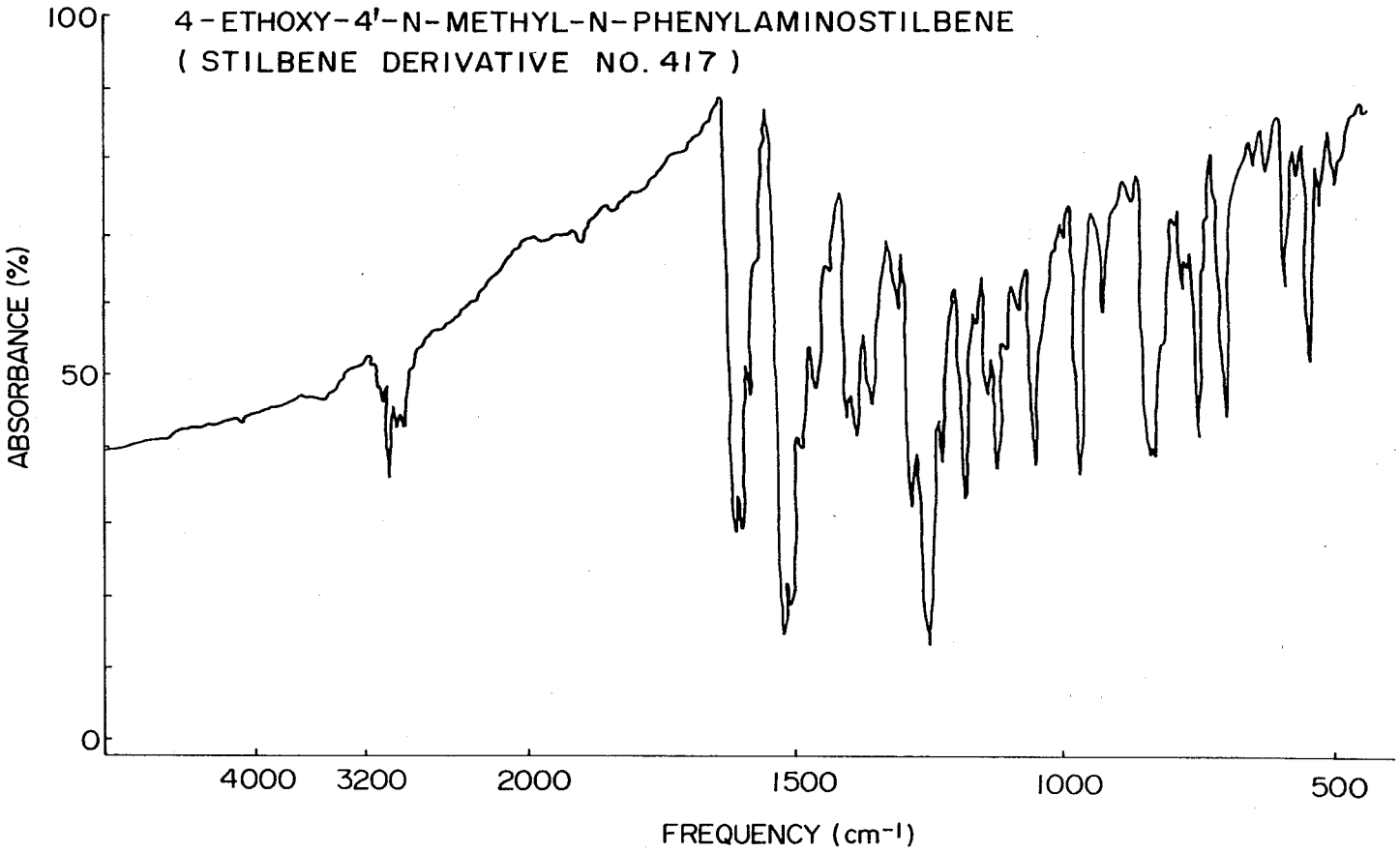
FIG. 8 is an infrared spectrum of 4-ethoxy-4'-N-methyl-N-phenylaminostilbene, which is Stilbene Derivative No. 417 in Table 15.

An infrared spectrum of the 4-ethoxy-4'-N,N-diphenylaminostilbene, taken by use of a KBr pellet, indicated a peak at 965 $cm^{-1}$ which is characteristic of the out-of-plane =CH (trans) deformation vibrations as shown in FIG. 7.

SYNTHESIS EXAMPLES 38 THROUGH 44.

Synthesis Example 37 was repeated except that 4-N,N-diphenylaminobenzaldehyde employed in Synthesis Example 37 was replaced by the respective aldehydes as listed in Table 13, whereby the novel stilbene derivatives listed in Table 13 were obtained.

TABLE 13

| Synthesis Example | Aldehyde | Stilbene Derivative | Stilbene Derivative No. in Table 15 |
|---|---|---|---|
| 38 | 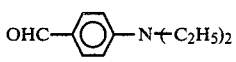 | 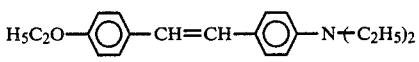 | 367 |
| 39 | 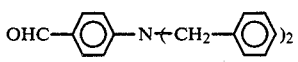 | 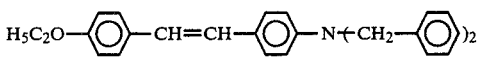 | 307 |
| 40 | 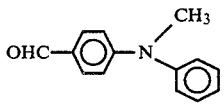 | 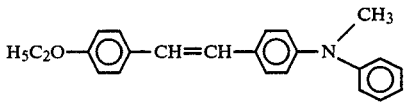 | 417 |
| 41 | 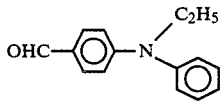 | 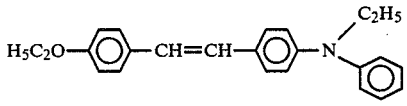 | 427 |
| 42 | 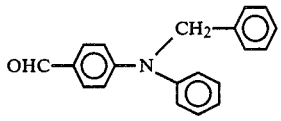 | 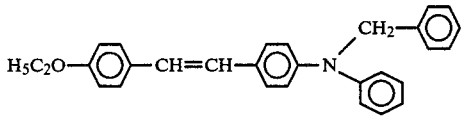 | 447 |

TABLE 13-continued

| Synthesis Example | Aldehyde | Stilbene Derivative | Stilbene Derivative No. in Table 15 |
|---|---|---|---|
| 43 | OHC—⟨○⟩—N(—⟨○⟩—$CH_3)_2$ | $H_5C_2O$—⟨○⟩—CH=CH—⟨○⟩—N(—⟨○⟩—$CH_3)_2$ | 368 |
| 44 | OHC—⟨○⟩—N(—⟨○⟩—$OCH_3)_2$ | $H_5C_2O$—⟨○⟩—CH=CH—⟨○⟩—N(—⟨○⟩—$OCH_3)_2$ | 392 |

The yields and melting points and the results of the elemental analyses of the stilbene derivatives prepared in Synthesis Examples 38 through 44 are in the following Table 14.

TABLE 14

| Synthesis Example No. | Yield (%) | Melting Point (°C.) | Elemental Analysis Found/Calculated % C | % H | % N |
|---|---|---|---|---|---|
| 38 | 29.2 | 117.5~119.5 | 81.44/81.31 | 8.58/8.53 | 4.57/4.74 |
| 39 | 59.3 | 137.5~140.0 | 86.22/85.88 | 6.90/6.97 | 3.06/3.34 |
| 40 | 84.5 | 171.5~173.0 | 84.08/83.85 | 7.18/7.04 | 4.29/4.25 |
| 41 | 48.4 | 125.0~126.0 | 84.11/83.92 | 7.50/7.34 | 3.95/4.08 |
| 42 | 57.9 | 118.5~119.5 | 85.68/85.89 | 6.85/6.71 | 3.50/3.45 |
| 43 | 74.6 | 132.5~133.5 | 85.81/85.88 | 7.07/6.97 | 3.37/3.34 |
| 44 | 76.3 | 119.5~120.5 | 79.87/79.79 | 6.38/6.47 | 2.93/3.10 |

In addition to the above-described stilbene derivatives in Synthesis Examples 38 through 44, other stilbene derivatives of the following formula,

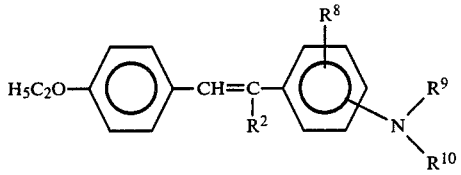

which are listed in the following Table 15, are also useful in the present invention.

TABLE 15

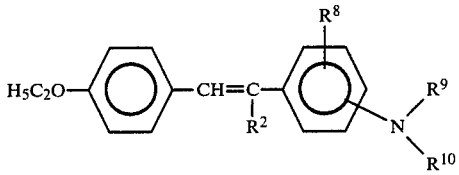

Substituted Position

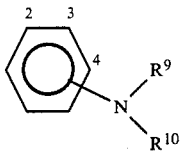

| Stilbene Derivative No. | $R^2$ | $R^8$ | | $R^9$ | $R^{10}$ |
|---|---|---|---|---|---|
| 307 | H | H | 4 | —$CH_2$—⟨○⟩ | —$CH_2$—⟨○⟩ |
| 308 | H | 2-$CH_3$ | 4 | —$CH_2$—⟨○⟩ | —$CH_2$—⟨○⟩ |
| 309 | H | 3-$CH_3$ | 4 | —$CH_2$—⟨○⟩ | —$CH_2$—⟨○⟩ |
| 310 | H | 2-$C_2H_5$ | 4 | —$CH_2$—⟨○⟩ | —$CH_2$—⟨○⟩ |

TABLE 15-continued
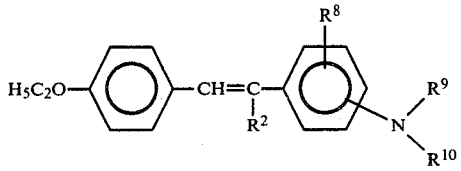
Substituted Position
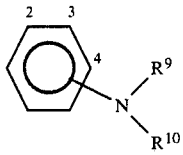
| Stilbene Derivative No. | $R^2$ | $R^8$ | | $R^9$ | $R^{10}$ |
|---|---|---|---|---|---|
| 311 | H | 3-$C_2H_5$ | 4 | $-CH_2-$ 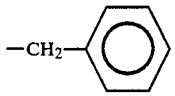 | $-CH_2-$ 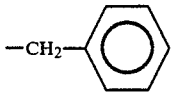 |
| 312 | H | 2-Cl | 4 | $-CH_2-$ 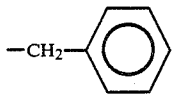 | $-CH_2-$ 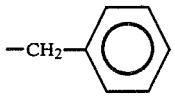 |
| 313 | H | 3-Cl | 4 | $-CH_2-$ 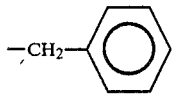 | $-CH_2-$ 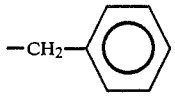 |
| 314 | H | 2-$OCH_3$ | 4 | $-CH_2-$ 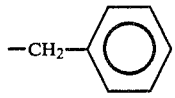 | $-CH_2-$ 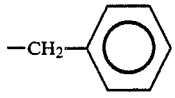 |
| 315 | H | 3-$OCH_3$ | 4 | $-CH_2-$ 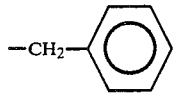 | $-CH_2-$ 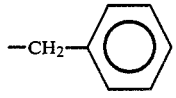 |
| 316 | H | 2-$OC_2H_5$ | 4 | $-CH_2-$ 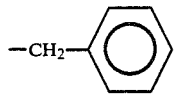 | $-CH_2-$ 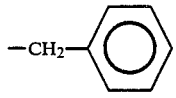 |
| 317 | H | H | 4 | $-C_2H_5$ | $-C_2H_5$ |
| 318 | H | H | 4 | $-CH_2-$ 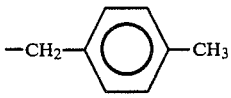 $-CH_3$ | $-CH_2-$ 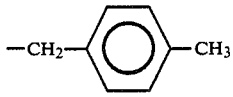 $-CH_3$ |
| 319 | H | H | 4 | $-CH_2-$ 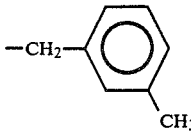 $CH_3$ | $-CH_2-$ 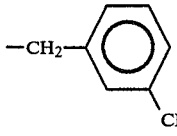 $CH_3$ |
| 320 | H | H | 4 | $-CH_2-$ 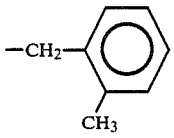 $CH_3$ | $-CH_2-$ 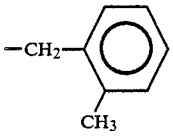 $CH_3$ |

TABLE 15-continued
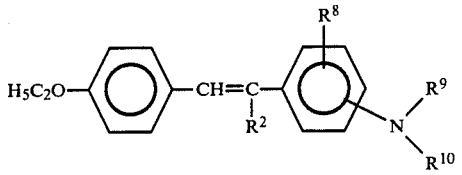
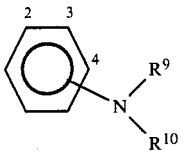
| Stilbene Derivative No. | $R^2$ | $R^8$ | Substituted Position | $R^9$ | $R^{10}$ |
|---|---|---|---|---|---|
| 321 | H | H | 4 | $-CH_2-C_6H_4-C_2H_5$ | $-CH_2-C_6H_4-C_2H_5$ |
| 322 | H | H | 4 | $-CH_2-C_6H_4-C_2H_5$ | $-CH_2-C_6H_4-C_2H_5$ |
| 323 | H | H | 4 | $-CH_2-C_6H_4-C_2H_5$ | $-CH_2-C_6H_4-C_2H_5$ |
| 324 | H | H | 4 | $-CH_2-C_6H_4-Cl$ | $-CH_2-C_6H_4-Cl$ |
| 325 | H | H | 4 | $-CH_2-C_6H_4-Cl$ | $-CH_2-C_6H_4-Cl$ |
| 326 | H | H | 4 | $-CH_2-C_6H_4-Cl$ | $-CH_2-C_6H_4-Cl$ |
| 327 | H | H | 2 | $-CH_2-C_6H_5$ | $-CH_2-C_6H_5$ |
| 328 | H | H | 3 | $-CH_2-C_6H_5$ | $-CH_2-C_6H_5$ |
| 329 | H | 2-$CH_3$ | 4 | $-CH_2-C_6H_4-CH_3$ | $-CH_2-C_6H_4-CH_3$ |

TABLE 15-continued
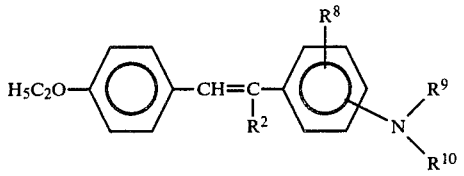
Substituted Position
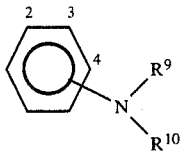
| Stilbene Derivative No. | $R^2$ | $R^8$ | | $R^9$ | $R^{10}$ |
|---|---|---|---|---|---|
| 330 | H | 2-$CH_3$ | 4 | 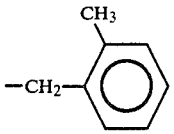 | 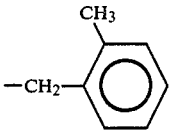 |
| 331 | H | 2-$CH_3$ | 4 | 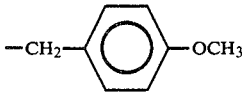 | 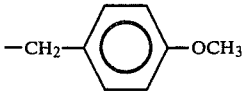 |
| 332 | H | 2-$CH_3$ | 4 | 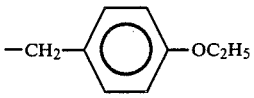 | 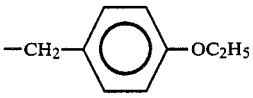 |
| 333 | H | 2-$CH_3$ | 4 | 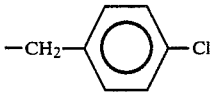 | 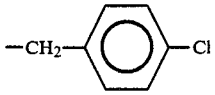 |
| 334 | H | 2-$CH_3$ | 4 | 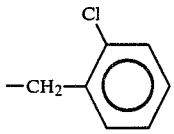 | 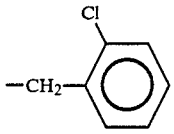 |
| 335 | H | 2-$OCH_3$ | 4 | 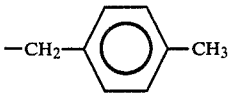 | 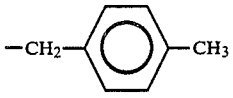 |
| 336 | H | 2-$OCH_3$ | 4 | 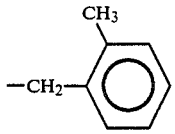 | 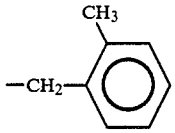 |
| 337 | H | 2-$OCH_3$ | 4 | 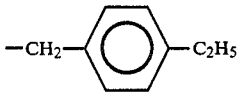 | 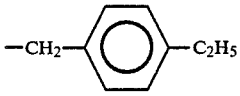 |
| 338 | H | 2-Cl | 4 | 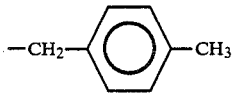 | 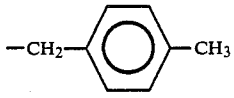 |

TABLE 15-continued
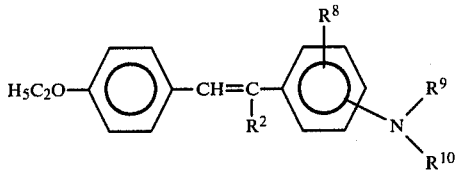
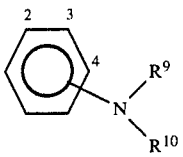
| Stilbene Derivative No. | $R^2$ | $R^8$ | Substituted Position | $R^9$ | $R^{10}$ |
|---|---|---|---|---|---|
| 339 | H | 2-Cl | 4 | $-CH_2-C_6H_4-OC_2H_5$ | $-CH_2-C_6H_4-OC_2H_5$ |
| 340 | H | 3-$CH_3$ | 4 | $-CH_2-C_6H_4-CH_3$ | $-CH_2-C_6H_4-CH_3$ |
| 241 | H | 3-$CH_3$ | 4 | $-CH_2-C_6H_4-CH_3$ | $-CH_2-C_6H_4-CH_3$ |
| 342 | H | 3-$CH_3$ | 4 | $-CH_2-C_6H_4-C_2H_5$ | $-CH_2-C_6H_4-C_2H_5$ |
| 343 | H | 2-$OC_2H_5$ | 4 | $-CH_2-C_6H_4-CH_3$ | $-CH_2-C_6H_4-CH_3$ |
| 344 | H | 3-Cl | 4 | $-CH_2-C_6H_4-CH_3$ | $-CH_2-C_6H_4-CH_3$ |
| 345 | H | 3-Cl | 4 | $-CH_2-C_6H_4-C_2H_5$ | $-CH_2-C_6H_4-C_2H_5$ |
| 346 | H | H | 2 | $-CH_2-C_6H_4-CH_3$ | $-CH_2-C_6H_4-CH_3$ |
| 347 | H | H | 3 | $-CH_2-C_6H_4-OCH_3$ | $-CH_2-C_6H_4-OCH_3$ |

TABLE 15-continued
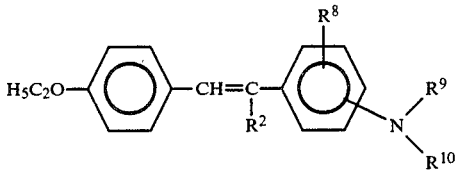
Substituted Position
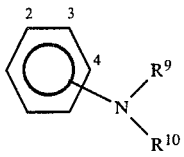
| Stilbene Derivative No. | $R^2$ | $R^8$ | | $R^9$ | $R^{10}$ |
|---|---|---|---|---|---|
| 348 | H | H | 4 | $-CH_3$ | $-CH_2-$ 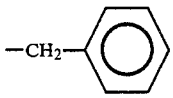 |
| 349 | H | H | 4 | $-C_2H_5$ | $-CH_2-$ 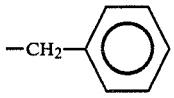 |
| 350 | H | H | 4 | $-(CH_2)_2CH_3$ | $-CH_2-$ 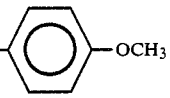 $-OCH_3$ |
| 351 | H | H | 4 | $-(CH_2)_3CH_3$ | $-CH_2-$ 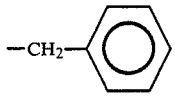 |
| 352 | H | H | 4 | $-CH(CH_3)CH_3$ | $-CH_2-$ 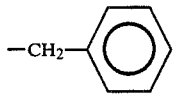 |
| 353 | H | H | 2 | $-CH_3$ | $-CH_2-$ 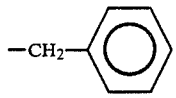 |
| 354 | H | H | 3 | $-CH_3$ | $-CH_2-$ 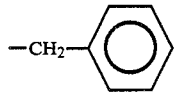 |
| 355 | H | 2-$CH_3$ | 4 | $-CH_3$ | $-CH_2-$ 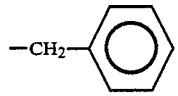 |
| 356 | H | 2-$C_2H_5$ | 4 | $-CH_3$ | $-CH_2-$ 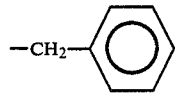 |
| 357 | H | 2-Cl | 4 | $-CH_3$ | $-CH_2-$ 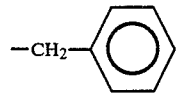 |

TABLE 15-continued
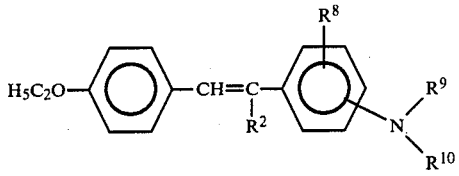
Substituted Position
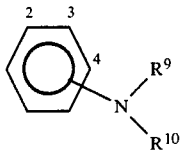
| Stilbene Derivative No. | $R^2$ | $R^8$ | | $R^9$ | $R^{10}$ |
|---|---|---|---|---|---|
| 358 | H | 2-$C_2H_5$ | 4 | $-CH_3$ | 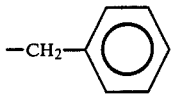 |
| 359 | H | 2-$OC_2H_5$ | 4 | $-CH_3$ | 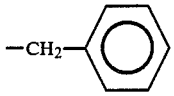 |
| 360 | H | 2-$CH_3$ | 4 | $-CH_3$ | 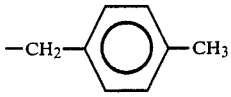 |
| 361 | H | 2-$CH_3$ | 4 | $-CH_3$ | 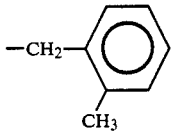 |
| 362 | H | 2-$CH_3$ | 4 | $-C_2H_5$ | 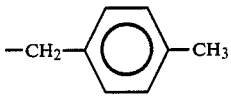 |
| 363 | H | 2-$OCH_3$ | 4 | $-CH_3$ | 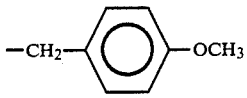 |
| 364 | H | 2-$OCH_3$ | 4 | $-CH_3$ | 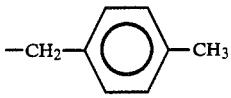 |
| 365 | H | H | 2 | $-CH_3$ | 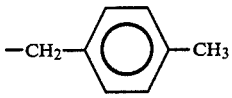 |
| 366 | H | H | 3 | $-CH_3$ | 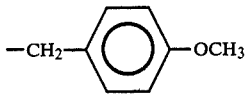 |
| 367 | H | H | 4 | 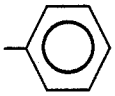 | 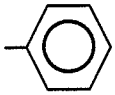 |

TABLE 15-continued
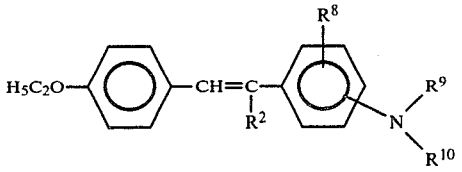
Substituted Position
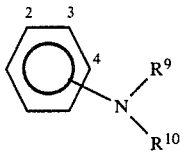
| Stilbene Derivative No. | $R^2$ | $R^8$ | | $R^9$ | $R^{10}$ |
|---|---|---|---|---|---|
| 368 | H | H | 4 | $CH_3$ | $CH_3$ |
| 369 | H | H | 4 | $C_2H_5$ | $C_2H_5$ |
| 370 | H | H | 4 | $(CH_2)_2CH_3$ | $(CH_2)_2CH_3$ |
| 371 | H | H | 4 | $CH(CH_3)CH_3$ | $CH(CH_3)CH_3$ |
| 372 | H | H | 4 | $(CH_2)_3CH_3$ | $(CH_2)_3CH_3$ |
| 373 | H | H | 4 | $C(CH_3)_3$ | $C(CH_3)_3$ |
| 374 | H | H | 4 | | $CH_3$ |
| 375 | H | H | 4 | | $C_2H_5$ |
| 376 | H | H | 4 | $CH_3$ | $CH_3$ |
| 377 | H | H | 4 | $CH_3$ | $CH_3$ |

TABLE 15-continued
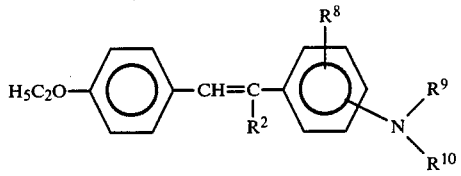
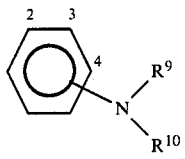
| Stilbene Derivative No. | $R^2$ | $R^8$ | | $R^9$ | $R^{10}$ |
|---|---|---|---|---|---|
| 378 | H | H | 4 | $C_2H_5$ | $C_2H_5$ |
| 379 | H | H | 4 | $CH_3$ | |
| 380 | H | H | 2 | | |
| 381 | H | H | 2 | $CH_3$ | $CH_3$ |
| 382 | H | H | 2 | $OCH_3$ | $OCH_3$ |
| 383 | H | H | 2 | $CH_3$ | $CH_3$ |
| 384 | H | H | 2 | $OCH_3$ | $OCH_3$ |
| 385 | H | H | 2 | $CH_3$ | $CH_3$ |
| 386 | H | H | 2 | $-CH_3$ | |

TABLE 15-continued
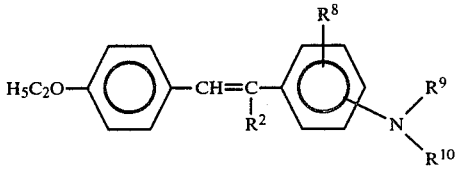
Substituted Position
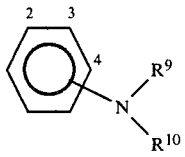
| Stilbene Derivative No. | $R^2$ | $R^8$ | | $R^9$ | $R^{10}$ |
|---|---|---|---|---|---|
| 387 | H | H | 2 | $-C_2H_5$ | 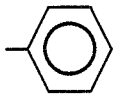 |
| 388 | H | H | 2 | $-CH_3$ | 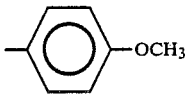 |
| 389 | H | H | 3 | 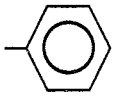 | 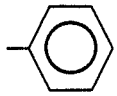 |
| 390 | H | H | 3 | 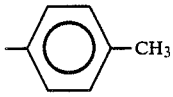 | 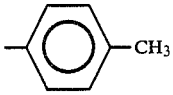 |
| 391 | H | H | 3 | 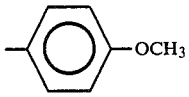 | 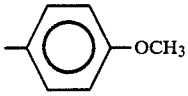 |
| 392 | H | H | 4 | 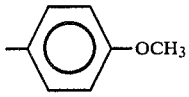 | 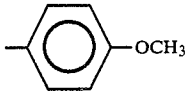 |
| 393 | H | H | 4 | 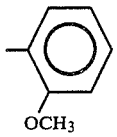 | 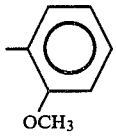 |
| 394 | H | H | 4 | 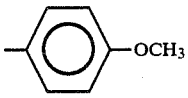 | 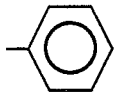 |
| 395 | H | H | 4 | 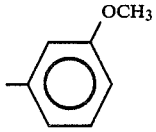 | 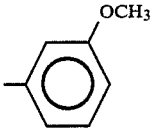 |
| 396 | H | H | 4 | 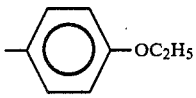 | 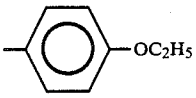 |

TABLE 15-continued
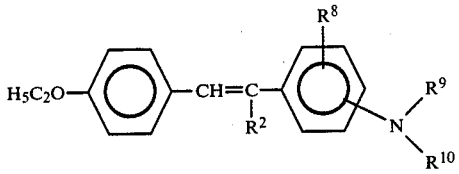
| Stilbene Derivative No. | $R^2$ | $R^8$ | Substituted Position 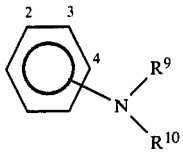 | $R^9$ | $R^{10}$ |
|---|---|---|---|---|---|
| 397 | H | H | 4 | 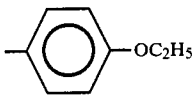 | 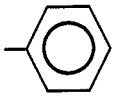 |
| 398 | H | H | 4 | 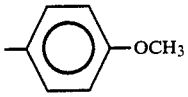 | 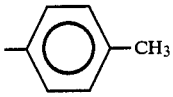 |
| 399 | H | H | 4 | 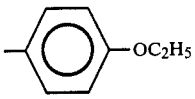 | 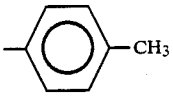 |
| 400 | H | H | 4 | 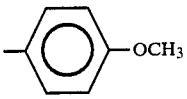 | 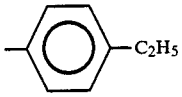 |
| 401 | H | H | 4 | 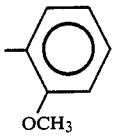 | 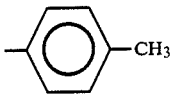 |
| 402 | H | H | 4 | 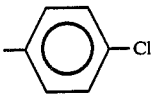 | 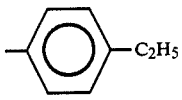 |
| 403 | H | H | 4 | 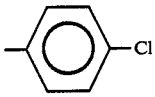 | 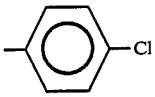 |
| 404 | H | H | 4 | 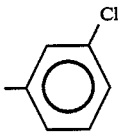 | 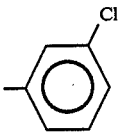 |
| 405 | H | H | 4 | 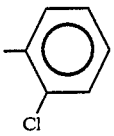 | 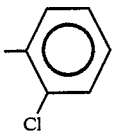 |

TABLE 15-continued
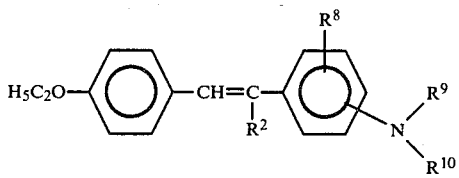
Substituted Position
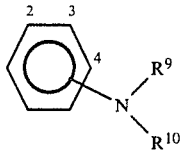
| Stilbene Derivative No. | $R^2$ | $R^8$ | | $R^9$ | $R^{10}$ |
|---|---|---|---|---|---|
| 406 | H | H | 4 | 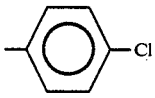 | 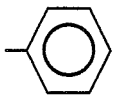 |
| 407 | H | H | 4 | 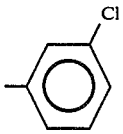 | 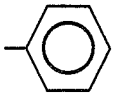 |
| 408 | H | H | 4 | 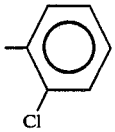 | 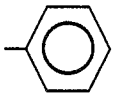 |
| 409 | H | H | 4 | 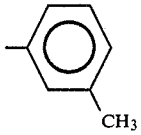 | 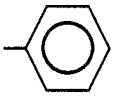 |
| 410 | H | H | 4 | 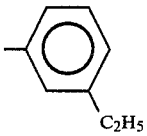 | 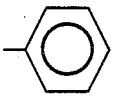 |
| 411 | H | H | 4 | 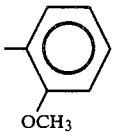 | 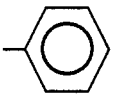 |
| 412 | H | H | 4 | 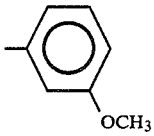 | 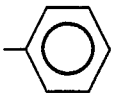 |
| 413 | H | H | 4 | 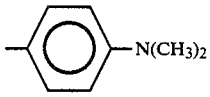 | 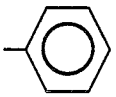 |
| 414 | H | H | 4 | 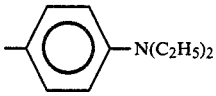 | 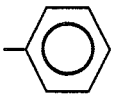 |

TABLE 15-continued
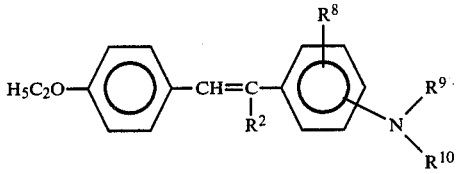
Substituted Position
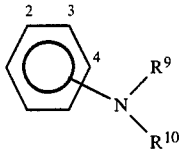
| Stilbene Derivative No. | $R^2$ | $R^8$ | Substituted Position | $R^9$ | $R^{10}$ |
|---|---|---|---|---|---|
| 415 | H | H | 4 | 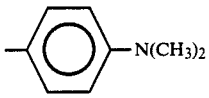  | 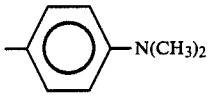  |
| 416 | H | H | 4 | 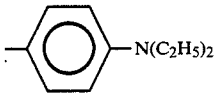  | 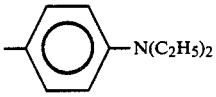  |
| 417 | H | H | 4 | $-CH_3$ | 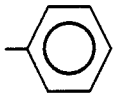 |
| 418 | H | H | 4 | $-CH_3$ | 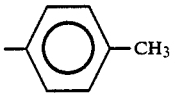  |
| 419 | H | H | 4 | $-CH_3$ | 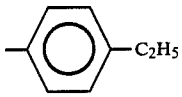  |
| 420 | H | H | 4 | $-CH_3$ | 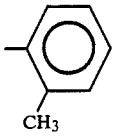  |
| 421 | H | H | 4 | $-CH_3$ | 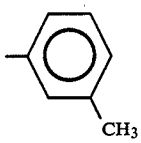  |
| 422 | H | H | 4 | $-CH_3$ | 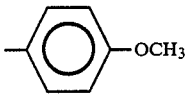  |
| 423 | H | H | 4 | $-CH_3$ | 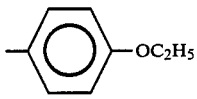  |

TABLE 15-continued
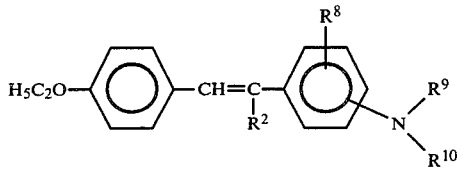
Substituted Position
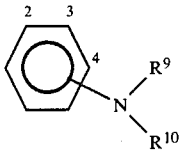
| Stilbene Derivative No. | $R^2$ | $R^8$ | | $R^9$ | $R^{10}$ |
|---|---|---|---|---|---|
| 424 | H | H | 4 | $-CH_3$ | 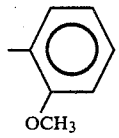  |
| 425 | H | H | 4 | $-CH_3$ | 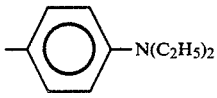  |
| 426 | H | H | 4 | $-CH_3$ | 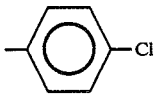  |
| 427 | H | H | 4 | $-C_2H_5$ | 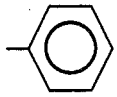 |
| 428 | H | H | 4 | $-C_2H_5$ | 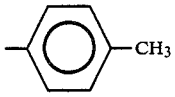  |
| 429 | H | H | 4 | $-C_2H_5$ | 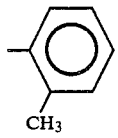  |
| 430 | H | H | 4 | $-C_2H_5$ | 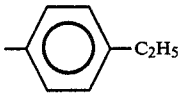  |
| 431 | H | H | 4 | $-C_2H_5$ | 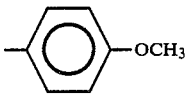  |
| 432 | H | H | 4 | $-C_2H_5$ | 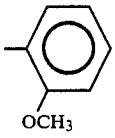  |

TABLE 15-continued
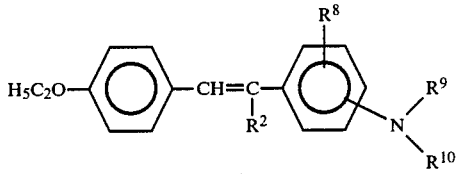
Substituted Position
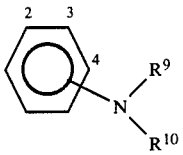
| Stilbene Derivative No. | $R^2$ | $R^8$ | | $R^9$ | $R^{10}$ |
|---|---|---|---|---|---|
| 433 | H | H | 4 | $-C_2H_5$ | 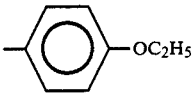 |
| 434 | H | H | 4 | $-C_2H_5$ | 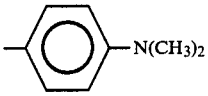 |
| 435 | H | H | 4 | $-C_2H_5$ | 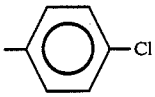 |
| 436 | H | H | 4 | $-(CH_2)_2CH_3$ | 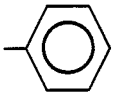 |
| 437 | H | H | 4 | $-(CH_2)_2CH_3$ | 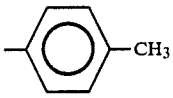 |
| 438 | H | H | 4 | $-(CH_2)_2CH_3$ | 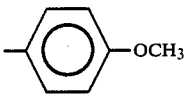 |
| 439 | H | H | 4 | $-(CH_2)_2CH_3$ | 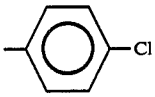 |
| 440 | H | H | 4 | $-(CH_2)_2CH_3$ | 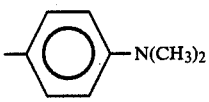 |
| 441 | H | H | 4 | $-(CH_2)_3CH_3$ | 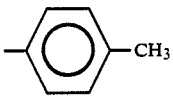 |
| 442 | H | H | 4 | $-(CH_2)_3CH_3$ | 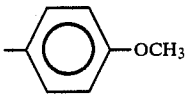 |

TABLE 15-continued
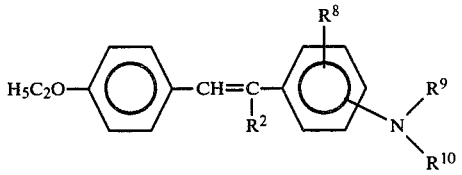
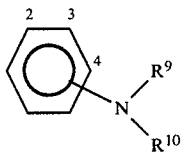
| Stilbene Derivative No. | $R^2$ | $R^8$ | Substituted Position | $R^9$ | $R^{10}$ |
|---|---|---|---|---|---|
| 443 | H | H | 4 | $-(CH_2)_3CH_3$ | 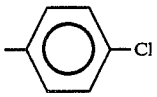 |
| 444 | H | H | 4 | $-(CH_2)_3CH_3$ | 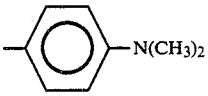 |
| 445 | H | H | 2 | $-CH_3$ | 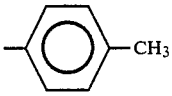 |
| 446 | H | H | 3 | $-CH_3$ | 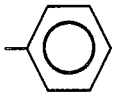 |
| 447 | H | H | 4 | 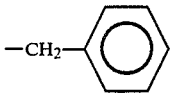 | 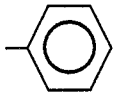 |
| 448 | H | H | 4 | 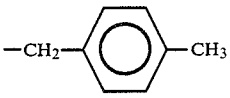 | 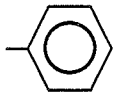 |
| 449 | H | H | 4 | 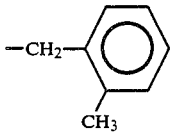 | 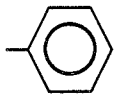 |
| 450 | H | H | 4 | 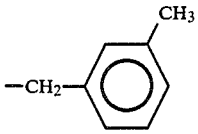 | 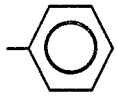 |
| 451 | H | H | 4 | 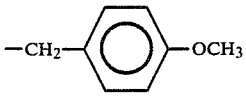 | 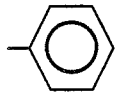 |
| 452 | H | H | 4 | 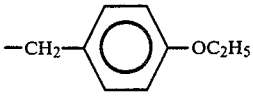 | 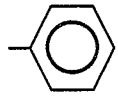 |

TABLE 15-continued
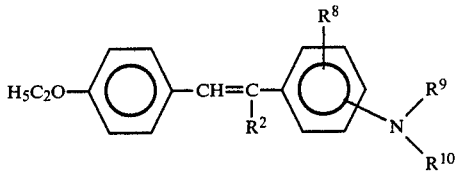
Substituted Position
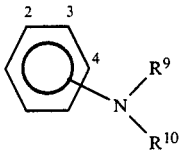
| Stilbene Derivative No. | $R^2$ | $R^8$ | Substituted Position | $R^9$ | $R^{10}$ |
|---|---|---|---|---|---|
| 453 | H | H | 4 | 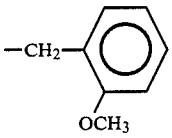 | 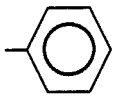 |
| 454 | H | H | 4 | 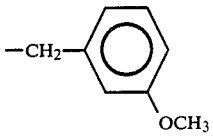 | 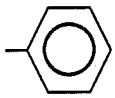 |
| 455 | H | H | 4 | 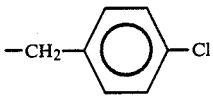 | 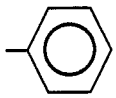 |
| 456 | H | H | 4 | 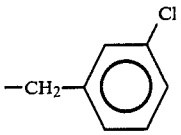 | 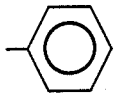 |
| 457 | H | H | 4 | 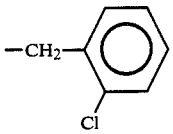 | 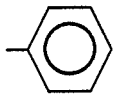 |
| 458 | H | H | 3 | 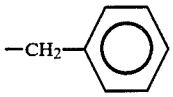 | 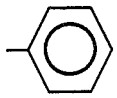 |
| 459 | H | H | 2 | 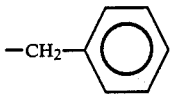 | 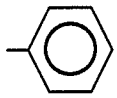 |
| 460 | 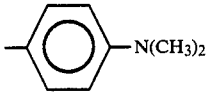 | H | 4 | $-CH_3$ | $-CH_3$ |
| 461 | 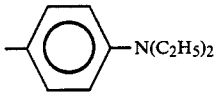 | H | 4 | $-C_2H_5$ | $-C_2H_5$ |

TABLE 15-continued

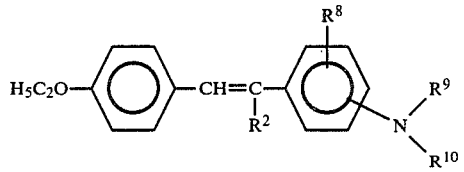

Substituted Position

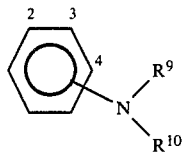

| Stilbene Derivative No. | $R^2$ | $R^8$ | | $R^9$ | $R^{10}$ |
|---|---|---|---|---|---|
| 462 | 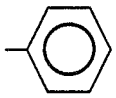 | H | 4 | $-CH_3$ | $-CH_3$ |
| 463 | 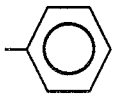 | H | 4 | $-C_2H_5$ | $-C_2H_5$ |
| 464 | H | H | 4 | 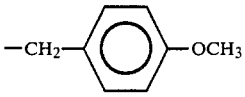 | 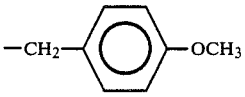 |
| 465 | H | H | 4 | 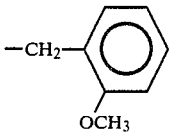 | 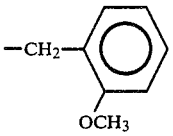 |

The above listed stilbene derivatives can also be used in the electrophotographic photoconductors with the structures as shown in FIGS. 1, 2 and 3 according to the present invention.

The following are embodiments of such electrophotographic photoconductors using the stilbene derivatives.

EXAMPLE P-81

The following components were ground and dispersed in a ball mill to prepare a charge generating layer formation liquid:

| | Parts by Weight |
|---|---|
| Diane Blue (C.I. Pigment Blue 25, C.I. 21180, a charge generating pigment of the following formula (CG-1)) | 76 |
| 2% tetrahydrofuran solution of a polyester resin (Vylon 200 made by Toyobo Co., Ltd.) | 1,260 |
| Tetrahydrofuran | 3,700 |

(CG-1)

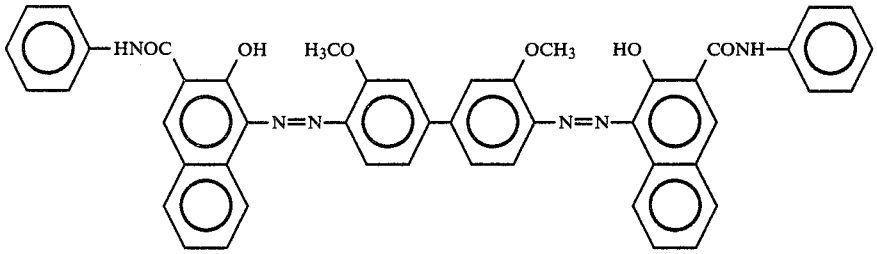

The thus prepared charge generating layer formation liquid was applied by a doctor blade to the aluminum-evaporated surface of an aluminum-evaporated polyester base film, which served as an electrocónductive support material, so that a charge generating layer, with a thickness of about 1 μm when dried at room temperature, was formed on the electroconductive support material.

Then the following components were mixed and dissolved, whereby a charge transporting layer formation liquid was prepared:

| | Parts by Weight |
|---|---|
| Stilbene Derivative No. 367 in Table 15 | 2 |
| Polycarbonate resin (Panlite K 1300 made by Teijin Limited.) | 2 |
| Tetrahydrofuran | 16 |

The thus prepared charge transporting layer formation liquid was applied to the aforementioned charge generating layer by a doctor blade and was dried at 80° C. for 2 minutes and then at 105° C. for 5 minutes, so that a charge transporting layer with a thickness of about 20 μm was formed on the charge generating layer; thus, an electrophotographic photoconductor No. 81 according to the present invention was prepared.

The electrophotographic photoconductor No. 81 was charged negatively in the dark under application of −6 kV of corona charge for 20 seconds and was then allowed to stand in the dark for 20 seconds without applying any charge thereto. At this moment, the surface potential Vpo (V) of the photoconductor was measured by a Paper Analyzer (Kawaguchi Electro Works, Model SP-428). The photoconductor was then illuminated by a tungsten lamp in such a manner that the illuminance on the illuminated surface of the photoconductor was 20 lux, and the exposure $E_{\frac{1}{2}}$ (lux.seconds) required to reduce the initial surface potential Vpo (V) to ½ the initial surface potential Vpo (V) was measured. The results showed that Vpo (V)=1329 V and $E_{\frac{1}{2}}$=1.8 lux.seconds.

EXAMPLE P-82 THROUGH P-90

Example P-81 was repeated except that the charge generating material and the charge transporting material (Stilbene Derivative No. 367 in Table 15) employed in Example P-81 were respectively replaced by the charge generating materials and the charge transporting materials (stilbene derivatives) listed in Table 16, whereby electrophotographic photoconductors No. 82 through No. 90 according to the present invention were prepared.

$V_{po}$ and $E_{\frac{1}{2}}$ of each electrophotographic photoconductor are shown in Table 17.

TABLE 16

| Example No. and Photo-conductor No. | Charge Generating Material | Charge Transporting Material Stilbene Derivative No. in Table 15 |
|---|---|---|
| 81 | 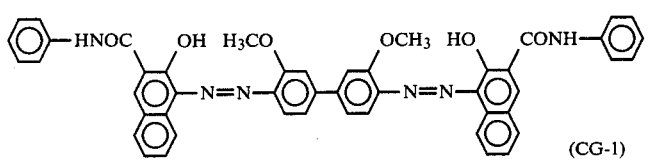 (CG-1) | 367 |
| 82 | 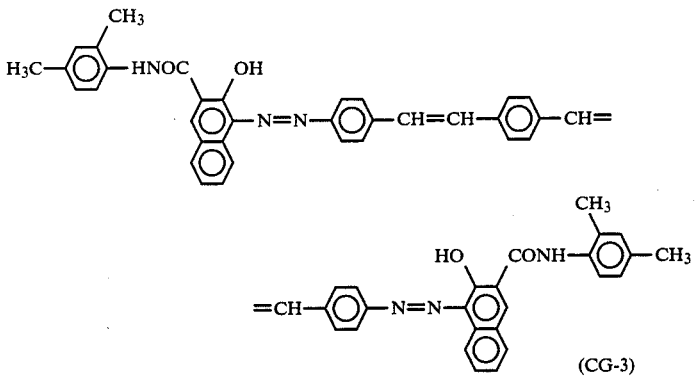 (CG-3) | 307 |
| 83 | 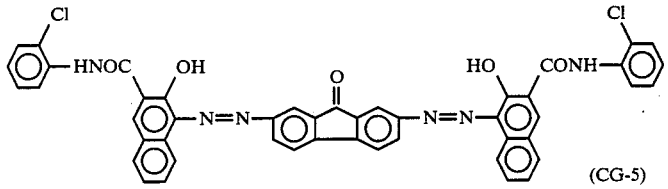 (CG-5) | 317 |

TABLE 16-continued
| Example No. and Photoconductor No. | Charge Generating Material | Charge Transporting Material Stilbene Derivative No. in Table 15 |
|---|---|---|
| 84 | 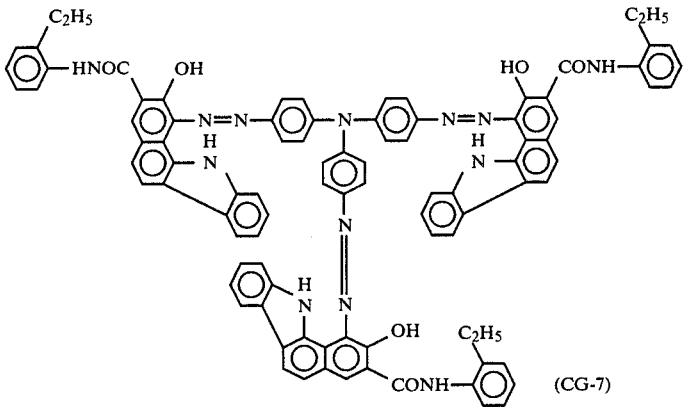 (CG-7) | 368 |
| 85 | 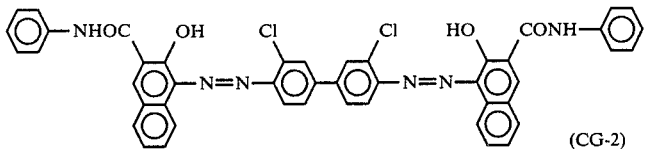 (CG-2) | 392 |
| 86 | 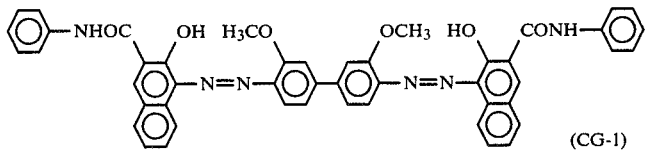 (CG-1) | 427 |
| 87 | 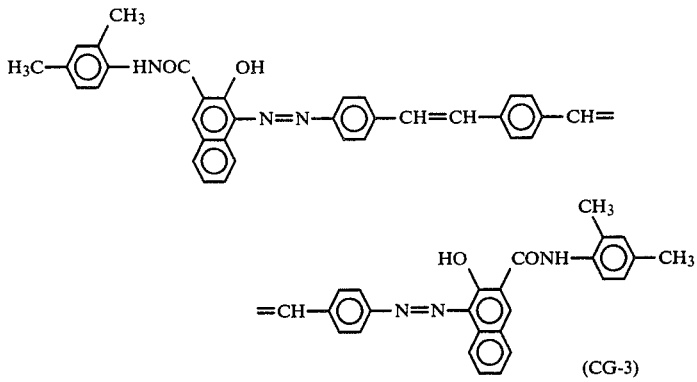 (CG-3) | 460 |
| 88 | 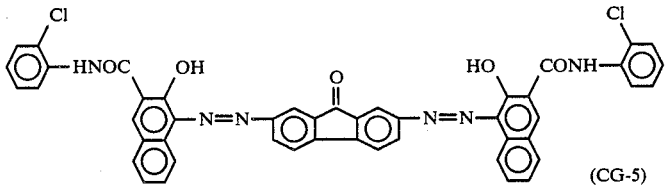 (CG-5) | 314 |

TABLE 16-continued

| Example No. and Photoconductor No. | Charge Generating Material | Charge Transporting Material Stilbene Derivative No. in Table 15 |
|---|---|---|
| 89 | 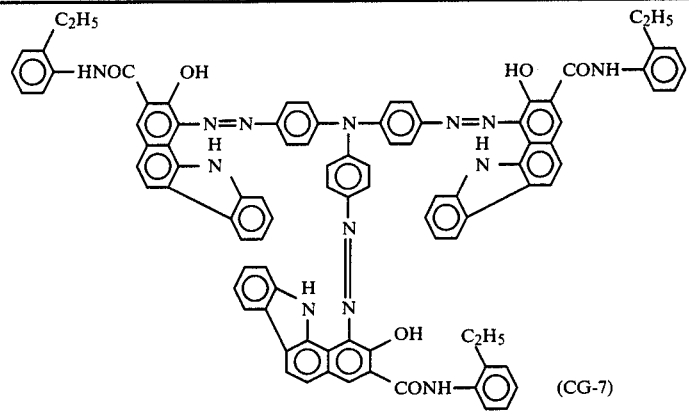 (CG-7) | 447 |
| 90 | 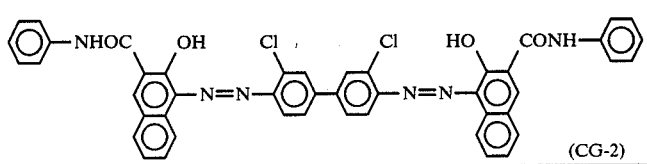 (CG-2) | 324 |

EXAMPLE P-91

Selenium was vacuum-evaporated with a thickness of approximately 1.0 μm on an approximately 300 μm thick aluminum plate so that a charge generating layer was formed on the aluminum plate.

A charge transporting layer liquid was prepared by mixing and dispersing the following components:

| | Parts by Weight |
|---|---|
| Stilbene derivative No. 307 in Table 15 | 2 |
| Polyester resin (Polyester Adhesive 49000 made by Du Pont Co.) | 3 |
| Tetrahydrofuran | 45 |

The thus prepared charge transporting layer liquid was applied to the aforementioned selenium charge generating layer by a doctor blade, dried at room temperature and then dried under reduced pressure, so that a charge transporting layer about 12 μm thick was formed on the charge generating layer; thus, an electrophotographic photoconductor No. 91 according to the present invention was prepared.

Vpo and $E_{\frac{1}{2}}$ were measured likewise. The results showed that Vpo = −927 V and $E_{\frac{1}{2}}$ = 5.0 lux·seconds.

EXAMPLE P-92

A perylene pigment C.I. Vat Red 23 (C.I. 71130) of the following formula was vacuum-evaporated with a thickness of about 0.3 μm on an approximately 300 μm thick aluminum plate so that a charge generating layer was formed.

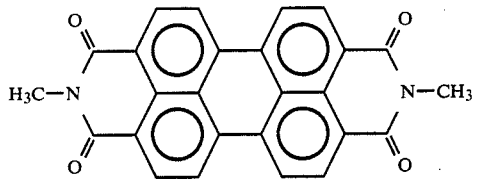

A charge transporting layer liquid was prepared by mixing and dispersing the following components:

| | Parts by Weight |
|---|---|
| Stilbene derivative No. 368 in Table 15 | 2 |
| Polyester resin (Polyester Adhesive 49000 made by Du Pont Co.) | 3 |
| Tetrahydrofuran | 45 |

The thus prepared charge transporting layer liquid was applied to the aforementioned selenium charge generating layer by a doctor blade, dried at room temperature and then dried under reduced pressure, whereby a charge transporting layer about 10 μm thick was formed on the charge generating layer; thus, an electrophotographic photoconductor No. 92 according to the present invention was prepared.

Vpo and $E_{\frac{1}{2}}$ were measured. The results showed that Vpo = −1204 V and $E_{\frac{1}{2}}$ = 6.6 lux·seconds.

EXAMPLE P-93

One part by weight of Diane Blue (C.I. Pigment Blue 25, C.I. 21180) which was the same as that employed in Example P-81 was added to 158 parts by weight of tetrahydrofuran, and the mixture was ground and dispersed in a ball mill. To this mixture, 12 parts by weight of Stilbene Derivative No. 367 and 18 parts by weight of a polyester resin (Polyester Adhesive 49000 made by Du Pont Co.) were added and mixed, whereby a photosensitive layer formation liquid was prepared.

The thus prepared photosensitive layer formation liquid was applied to an aluminum-evaporated polyester film by a doctor blade and was dried at 100° C. for 30 minutes, so that a photosensitive layer with a thickness of about 13 μm was formed on the aluminum-evaporated polyester film, thus, an electrophotographic photoconductor No. 93 according to the present invention was prepared.

The electrophotographic photoconductor No. 93 was charged positively in the dark under application of +6 kV of corona charge for 20 seconds and was then allowed to stand in the dark for 20 seconds without applying any charge thereto. At this moment, the surface potential Vpo (V) of the photoconductor was measured by a Paper Analyzer (Kawaguchi Electro Works, Model SP-428). The photoconductor was then illuminated by a tungsten lamp in such a manner that the illuminance on the illuminated surface of the photoconductor was 20 lux, so that the exposure $E_{\frac{1}{2}}$ (lux·seconds) required to reduce the initial surface potential Vpo (V) to ½ the initial surface potential Vpo (V) was measured. The results showed that Vpo (V)=+612 V and $E_{\frac{1}{2}}$=4.6 lux·seconds.

The charge generating material, the charge transporting material, $V_{po}$ and $E_{\frac{1}{2}}$ of each of the electrophotographic photoconductors No. 81 through No.93 are summarized in the following Table 17:

TABLE 17

| Photo-Conductor | Charge Generating Material | Charge Transporting Material (Stilbene Derivative) | $V_{po}$ (V) | $E_{\frac{1}{2}}$ (lux · seconds) |
|---|---|---|---|---|
| 81 | CG-1 | No. 367 | −1329 | 1.8 |
| 82 | CG-3 | No. 307 | −1084 | 2.4 |
| 83 | CG-5 | No. 317 | −1192 | 2.7 |
| 84 | CG-7 | No. 368 | −824 | 1.5 |
| 85 | CG-2 | No. 392 | −1123 | 2.6 |
| 86 | CG-1 | No. 427 | −992 | 3.0 |
| 87 | CG-3 | No. 460 | −1133 | 1.2 |
| 88 | CG-5 | No. 314 | −1051 | 2.5 |
| 89 | CG-7 | No. 447 | −1166 | 0.9 |
| 90 | CG-2 | No. 324 | −1006 | 3.6 |
| 91 | Se | No. 307 | −927 | 5.0 |
| 92 | Perylene Pigment | No. 368 | −1204 | 6.6 |
| 93 | CG-1 | No. 367 | +612 | 4.6 |

Each of the electrophotographic photoconductors prepared in Examples P-81 through P-92 was negatively charged, while the electrophotographic photoconductor prepared in Example P-93 was positively charged, by a commercially available copying machine, so that latent electrostatic images were formed on each photoconductor and was developed with a dry type developer. The developed images were transferred to a high quality transfer sheet and were fixed to the transfer sheet. As a result, clear images were obtained from each of the electrophotographic photoconductors.

When a wet type developer was used instead of the dry type developer, clear images were also obtained from each of the electrophotographic photoconductors.

What is claimed is:

1. An electrophotographic photoconductor comprising an electroconductive support material and a photosensitive layer comprising at least one stilbene derivative of the formula

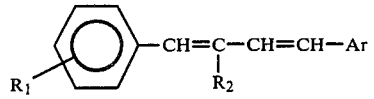

wherein $R^1$ represents a lower alkyl group, an alkoxy group, an unsubstituted or substituted phenoxy group or a hydroxyl group, $R^2$ represents hydrogen, a lower alkyl group or an unsubstituted or substituted phenyl group; Ar represents

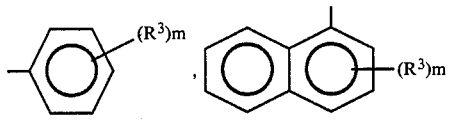

or a 9-anthryl group, $R^3$ represents hydrogen, an alkyl group, an alkoxy group, halogen or a substituted amino group represented by

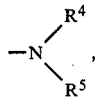

in which $R^4$ and $R^5$ each represent an alkyl group, an unsubstituted or substituted aralkyl group, or an unsubstituted or substituted aryl group, and m is an integer of 0, 1, 2 or 3.

2. An electrophotographic photoconductor comprising an electroconductive support material and a photosensitive layer comprising at least one stilbene derivative of the formula

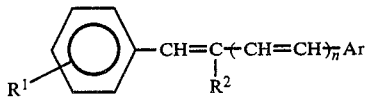

wherein $R^1$ represents an unsubstituted or substituted phenoxy group, $R^2$ represents hydrogen, a lower alkyl group or an unsubstituted or substituted phenyl group; Ar represents

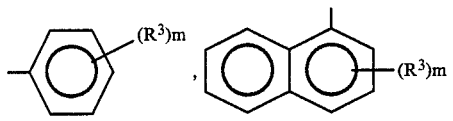

or a 9-anthryl group, $R^3$ represents hydrogen, an alkyl group, an alkoxy group, halogen or substituted amino group represented by

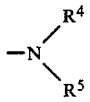

in which $R^4$ and $R^5$ each represent an alkyl group, an unsubstituted or substituted aralkyl group, or an unsubstituted or substituted aryl group, m is an integer of 0, 1, 2 or 3 and n is an integer of 0 or 1.

* * * * *